US006942740B2

(12) United States Patent
Hayakawa et al.

(10) Patent No.: US 6,942,740 B2
(45) Date of Patent: Sep. 13, 2005

(54) GRAIN-ORIENTED MAGNETIC STEEL SHEET HAVING NO UNDERCOAT FILM COMPRISING FORSTERITE AS PRIMARY COMPONENT AND HAVING GOOD MAGNETIC CHARACTERISTICS

(75) Inventors: Yasuyuki Hayakawa, Kurashiki (JP); Mitsumasa Kurosawa, Kurashiki (JP); Seiji Okabe, Kurashiki (JP); Takeshi Imamura, Kurashiki (JP)

(73) Assignee: JFE Steel Corporation (JP)

( * ) Notice: Subject to any disclaimer, the term of this patent is extended or adjusted under 35 U.S.C. 154(b) by 216 days.

(21) Appl. No.: 10/312,663

(22) PCT Filed: Jan. 17, 2002

(86) PCT No.: PCT/JP02/00291

§ 371 (c)(1),
(2), (4) Date: Nov. 27, 2002

(87) PCT Pub. No.: WO02/057503

PCT Pub. Date: Jul. 25, 2002

(65) Prior Publication Data

US 2004/0074565 A1 Apr. 22, 2004

(30) Foreign Application Priority Data

| | | |
|---|---|---|
| Jan. 19, 2001 | (JP) | 2001-11409 |
| Jan. 19, 2001 | (JP) | 2001-11410 |
| Jan. 26, 2001 | (JP) | 2001-18104 |
| Jan. 30, 2001 | (JP) | 2001-21467 |

(51) Int. Cl.[7] ..... H01F 1/14
(52) U.S. Cl. ..... 148/308; 148/307
(58) Field of Search ..... 148/307, 308; 420/117

(56) References Cited

U.S. PATENT DOCUMENTS 6,248,185 B1 * 6/2001 Kondo et al. ..... 148/306

FOREIGN PATENT DOCUMENTS

| | | |
|---|---|---|
| EP | 0 997 540 A1 | 5/2000 |
| EP | 1 004 680 A1 | 5/2000 |
| EP | 1 108 794 A1 | 6/2001 |
| JP | 08 134542 | 5/1996 |

* cited by examiner

*Primary Examiner*—John P. Sheehan
(74) *Attorney, Agent, or Firm*—DLA Piper Rudnick Gray Cary US LLP

(57) ABSTRACT

A grain oriented electromagnetic steel sheet is free from an undercoating mainly composed of forsterite ($Mg_2SiO_4$), excellent in processability and magnetic properties and useful to production cost, and has a composition containing, by % by mass, 2.0 to 8.0% of Si, wherein secondary recrystallized grains contains fine crystal grains having a grain diameter of 0.15 mm to 0.50 mm at a rate of 2 grains/cm$^2$ or more. In the process of producing the steel sheet, inhibitors are not utilized, and the fine crystal grains are achieved by high purification and low temperature final annealing.

10 Claims, 20 Drawing Sheets

MACRO STRUCTURE AFTER FINAL ANNEALING

1cm

MACRO STRUCTURE AFTER FINAL ANNEALING

GRAIN-ORIENTED MAGNETIC STEEL SHEET HAVING NO UNDERCOAT FILM COMPRISING FORSTERITE AS PRIMARY COMPONENT AND HAVING GOOD MAGNETIC CHARACTERISTICS

TECHNICAL FIELD

The present invention relates to a grain oriented electromagnetic steel sheet suitably used for iron core materials of transformers, motors, electric generators, etc., and a method of producing the steel sheet. The present invention can be suitably used for general ion cores, and EI cores particularly used as iron cores of small transformers, and iron core materials of power supply transformers and control elements, which are used at frequencies of 100 to 10000 Hz higher than the commercial frequency, etc.

BACKGROUND ART

Grain oriented electromagnetic steel sheets are widely used as iron cores of transformers, motors, and the like. These materials have crystal orientations highly accumulated in {110} <001> orientation referred to as "Goss orientation", and the properties thereof are mainly evaluated by electromagnetic properties such as magnetic permeability, iron loss, etc.

In the process for producing a grain oriented electromagnetic steel sheet, an undercoating (glass coating) mainly composed of forsterite ($Mg_2SiO_4$) is generally formed on the surface thereof and suitably used as an insulating film and tension applying film. However, this film has the following problems.

In using a grain oriented electromagnetic steel sheet for an iron core of a transformer, a motor, or the like, the steel sheet must be processed into a predetermined shape by punching or shearing. Therefore, the grain oriented electromagnetic steel sheet is required to have the above electromagnetic properties and good processability. Particularly, a small-sized iron core called an EI core used for a power supply adapter, a fluorescent lamp, and the like comprises many laminated steel sheets, and thus punching quality of the electromagnetic steel sheet is an important problem which determines productivity of EI cores in mass production thereof.

The EI core will be described in detail below. FIG. 1 shows an example of the shape of the El core. The EI core is produced by punching, but an effective processing method producing only a small amount of scrap in punching is used.

As an iron core material for the EI core, both a non-oriented electromagnetic steel sheet and a grain oriented electromagnetic steel sheet are used at present.

The grain oriented electromagnetic steel sheet has good magnetic properties in the rolling direction, but has much interior magnetic properties in the direction perpendicular to the rolling direction. However, in the EI core, a magnetic flux flows at an area ratio of about 20% in the direction perpendicular to the rolling direction, and flows at an area ratio of about 80% in the rolling direction. Therefore, when the grain oriented electromagnetic steel sheet is used as an ion core material of the EI core, much better properties can be obtained, as compared with the non-oriented electromagnetic steel sheet. Thus, the grain oriented electromagnetic steel sheet is used for many cases in which an iron loss is regarded as important.

As described above, the EI core is produced by punching a steel sheet using a die, but the forsterite undercoating is extremely harder than an organic resin film coated on the non-oriented electromagnetic steel sheet, thereby causing great abrasion of the punching die. Therefore, the die must be early re-polished or exchanged, causing deterioration in the working efficiency of core processing by a user and an increase in cost. Also, the presence of the forsterite undercoating deteriorates a slit property and cutting property.

The surface of the grain oriented electromagnetic steel sheet used for this purpose is required be free from the forsterite undercoating firstly, and many proposals have been made. An example of conceivable methods is a method in which a forsterite undercoating is formed, and then removed by pickling, chemical polishing, electropolishing, or the like. However, this method has a large problem in which the cost is increased, and the surface properties are worsened to deteriorate magnetic properties.

In recent, an attempt has been made to control the components of an annealing separator so as not to form a forsterite undercoating or decompose the forsterite undercoating immediately after the forsterite undercoating is formed, producing a grain oriented electromagnetic steel sheet having good processability.

For example, Japanese Unexamined Patent Application Publication No. 60-39123 discloses a method of inhibiting the production of a forsterite undercoating by using $Al_2O_3$ as a main component of an annealing separator. Also, Japanese Unexamined Patent Application Publication No. 6-17137 discloses a method of adding at least one of chlorides, carbonates, nitrates, sulfates and sulfides of Li, K, Na, Ba, Ca, Mg, Zn, Fe, Zr, Sn, Sr, Al, and the like to an annealing separator comprising MgO as a main component to decompose the formed forsterite undercoating. Furthermore, Japanese Unexamined Patent Application Publication No. 7-18333 discloses a method of removing a $SiO_2$ undercoating formed in decarburization annealing by using an annealing separator containing 0.2% to 15% of Bi chloride and setting the nitrogen partial pressure of the final annealing atmosphere to 25% or more.

These means are capable of producing a grain oriented electromagnetic steel sheet without forming the forsterite undercoating. However, any one of these methods comprises the step of producing the forsterite undercoating or the oxide undercoating composed of $SiO_2$ as a main component and then decomposing the undercoating, and requires a special releasing agent or auxiliary agent, thereby inevitably complicating the production process and causing the problem of increasing the cost.

For example, Japanese Examined Patent Application Publication No. 6-49948 and Japanese Examined Patent Application Publication No. 6-49949 propose a technique for suppressing the formation of a forsterite undercoating by mixing an agent with an annealing separator mainly composed of MgO and used for final annealing, and Japanese Unexamined Patent Application Publication No. 8-134542 proposes a technique for suppressing the formation of a forsterite undercoating by using an annealing separator mainly composed of silica and alumina for a material containing Mn. However, these methods can remove the adverse effect of the forsterite undercoating, but the problem of the coarse crystal grains of the grain oriented electromagnetic steel sheet is left unsolved.

Namely, the crystal grains of the grain oriented electromagnetic steel sheet are generally coarsened (usually about 10 to 50 mm) in the process of obtaining the strong Goss texture. Therefore, there is the problem of causing a large change in shape such as shear dropping or the like during punching, as compared with the non-oriented electromagnetic steel sheet generally comprising fine crystal grains of 0.03 to 0.20 mm. On the other hand, a usual method of suppressing the formation of coarse grains deteriorates the magnetic properties such as core loss, etc.

Therefore, means for satisfying both good punching ability and the magnetic properties such as core loss, etc. of the grain oriented electromagnetic steel sheet has not yet been established.

Furthermore, as described above, the grain oriented electromagnetic steel sheet has good magnetic properties in the rolling direction, but poor magnetic properties in the direction perpendicular to the rolling direction. Therefore, in application to the EI core in which a magnetic flux also flows in the direction perpendicular to the rolling direction, it is not said to make sufficient use of the properties of the grain oriented electromagnetic steel sheet.

For this problem, a method of developing a (100)<001> texture (regular cubic texture) by secondary recrystallization, i.e., a method of producing a so-called two-direction oriented electromagnetic steel sheet, has been investigated from old times.

For example, Japanese Examined Patent Application Publication No. 35-2657 discloses, a method comprising performing cold rolling in one direction, performing cold rolling in a direction crossing the one direction to perform cross rolling, and then performing annealing for a short time and annealing at a high temperature of 900 to 1300° C. to obtain a strong cube texture in which regular cubic orientation grains are integrated by secondary recrystallization (using an inhibitor). Japanese Unexamined Patent Application Publication No. 4-362132 discloses a method comprising performing cold rolling with a rolling reduction of 50 to 90% in the direction perpendicular to the hot rolling direction, performing annealing for primary recrystallization, and then performing final annealing for secondary recrystallization and purification to secondarily recrystallize the regular cubic-orientation grains by using AlN.

Although a two-direction oriented electromagnetic steel sheet having good magnetic properties in both the rolling direction and the direction perpendicular to the rolling direction is most useful from the viewpoint of magnetic properties, cross rolling with very low productivity is required for producing the two-direction oriented electromagnetic steel sheet. Therefore, such a two-direction oriented electromagnetic steel sheet has not yet been put into industrial mass production.

Furthermore, in order to apply to the split core of a motor, Japanese Unexamined Patent Application Publication No. 2000-87139 discloses a technique of decreasing inhibitor components to develop the Goss orientation with a low degree of integration, decreasing anisotropy of the magnetic properties of the grain oriented electromagnetic steel sheet. However, this technique deteriorates the degree of integration of the Goss orientation and limits the Si amount to less than 3.0% by mass, and thus in an example, the iron loss $W_{15/50}$ in the rolling direction is 2.1 W/kg or more, which is, at best, substantially the same as a high-quality non-oriented electromagnetic steel sheet, and is notably worse than the level of $W_{15/50}$<1.4 W/kg of the grain oriented electromagnetic steel sheet. Therefore, this technique does not satisfy the requirements of users.

Apart from the above-described requirements, in some cases, iron core materials are required to exhibit a low iron loss in a high frequency region. Although whether or not this property is affected by the forsterite undercoating has not been known, the inventors found that a steel sheet without the forsterite undercoating developed by the inventors is very suitable for improving the high-frequency iron loss. Therefore, the technical background of this field is described here.

As a method of producing a grain oriented electromagnetic steel sheet having excellent high-frequency iron loss, Japanese Examined Patent Application Publication No. 7-42556 discloses a technique in which a grain oriented electromagnetic steel sheet having a highly developed Goss texture is used as a raw material, cold-rolled with a rolling reduction of 60 to 80% and then subjected to primary recrystallization annealing to obtain a product having a developed Goss texture and a thickness of 0.15 mm or less and comprising fine crystal grains having an average grain diameter of 1 mm or less.

However, this method comprises removing the forsterite undercoating from the grain oriented electromagnetic steel sheet, and performing rolling and recrystallization annealing, and thus this method costs much and is unsuitable for mass production.

Japanese Unexamined Patent Application Publication Nos. 64-5539, 2-57635, 7-76732 and 7-197126 disclose a method of producing a grain oriented electromagnetic steel thin sheet by using surface energy as a driving force without using an inhibitor.

However, there is a problem in which final annealing must be performed at a high temperature under conditions for suppressing the formation of a surface oxide in order to use the surface energy. For example, Japanese Unexamined Patent Application Publication No. 64-55339 discloses that a vacuum, an inert gas, a hydrogen gas, or a mixture of hydrogen gas and nitrogen gas must be used as an atmosphere of final annealing at a temperature of 1180° C. Japanese Unexamined Patent Application Publication No. 2-57635 recommends using an inert gas atmosphere, a hydrogen gas, or a mixed atmosphere of hydrogen gas and inert gas at a temperature of 950 to 1100° C. and further reducing the pressure of the gas. Furthermore, Japanese Unexamined Patent Application Publication No. 7-197126 discloses that final annealing is performed at a temperature of 1000 to 1300° C. in a non-oxidizing atmosphere at an oxygen partial pressure of 0.5 Pa or less or a vacuum.

As described above, in order to obtain good magnetic properties by using the surface energy, an inert gas or hydrogen is used as the atmosphere of final annealing, and a vacuum condition is required as a recommended condition. However, in view of equipment, it is very difficult to set both a high temperature and vacuum, thereby increasing the cost. When the surface energy is utilized, only the {110} plane can be basically selected, and growth of Goss grains in the <001> orientation coinciding with the rolling direction is not selected.

In the grain oriented electromagnetic steel sheet, the magnetic properties are improved by orienting the easy magnetization axis <001> in the rolling direction, and thus good magnetic properties are basically not obtained only by selecting the {110} plane.

Therefore, the rolling conditions and annealing conditions for obtaining good magnetic properties by a method using the surface energy are extremely limited, and thus the magnetic properties become unstable.

As described above, a method of obtaining a good high-frequency iron loss with a high cost efficiency has not yet been found.

DISCLOSURE OF INVENTION (Problem To Be Solved By The Invention)

As described above, the conventional techniques cannot achieve the object to produce a grain oriented electromagnetic steel sheet having good magnetic properties at low cost, and economically produce a grain oriented electromagnetic steel sheet having good punching quality without forming a forsterite undercoating on the surface.

In consideration of the above situation, in a first aspect of the present invention, an object of the present invention is to provide a completely new grain oriented electromagnetic steel sheet excellent in processability and magnetic properties and economically advantageous, and a useful method of producing the same. The application of the steel sheet is not limited, but the steel sheet is ideally used as core materials of small-sized transformers, such as an EI core and the like.

In a second aspect of the present invention, an object of the present invention is to provide a grain oriented electromagnetic steel sheet further satisfying two-direction magnetic properties suitable for EI core materials, and a useful method of producing the steel sheet.

In consideration of the above situation, in a third aspect of the present invention, an object of the present invention is to provide a grain oriented electromagnetic steel sheet having highly developed Goss orientation and thus a high magnetic flux density, fine grains appropriately present in secondary recrystallized grains, and excellent iron loss in the high frequency region, and a useful method of producing the steel sheet.

(Means For Solving The Problem)

In a process for producing a grain oriented electromagnetic steel sheet, inhibitor elements, for example, MnS, MnSe or AlN, are generally contained in a steel slab used as a starting raw material in order to selectively grow Goss orientation crystal grains. Therefore, in finish annealing, a so-called purification annealing process, i.e., annealing at a high temperature of 1200 to 1300° C. in a pure hydrogen stream, is required, and it is thus very difficult to avoid the problems of forming a coating, coarsening the grains and increasing the cost.

On the other hand, as a result of intensive research on the reason for secondary recrystallization of {110} <001> orientation grains, the inventors found that grain boundaries having an orientation difference angle of 20 to 45° in a primary recrystallized structure play an important role, and reported this finding in Acta Material, Vol. 45 (1997), p.1285. This shows that the function of the inhibitor is to produce a difference between the moving speeds of high-energy grain boundaries and other grain boundaries, and even if the inhibitor is not used, secondary recrystallization is allowed to take place by producing a difference between the moving speeds of the grain boundaries.

On the basis of this finding, the inventors proposed a technique for developing Goss orientation crystal grains by secondary recrystallization of a material not containing the inhibitor component (Japanese Unexamined Patent Application Publication No. 2000-129356).

As a result of further improvement based on the above-described technique and intensive research for obtaining a grain oriented electromagnetic steel sheet suitable for small-sized electric apparatuses such as an EI core, in which punching processability is regarded as important, the first aspect of the present invention has been developed.

The gist of the first aspect of the present invention lies in the point that a production method without the formation of an undercoating mainly composed of forsterite is used, a steel raw material containing substantially no inhibitor component is used, and the ultimate temperature of final annealing is kept down to 1000° C. or lower to leave fine crystal grains, effectively improving an iron loss.

Namely, the construction of the first aspect of the present invention is as follows:

1-1. A grain oriented electromagnetic steel sheet having excellent magnetic properties without an undercoating mainly composed of forsterite ($Mg_2SiO_4$) has a composition containing 1.0 to 8.0% by mass, preferably 2.0 to 8.0 by mass, of Si, wherein secondary recrystallized grains contain fine crystal grains having a grain diameter of 0.15 mm to 0.50 mm at a rate of 2 grains/cm$^2$ or more.

1-2. The grain oriented electromagnetic steel sheet having excellent magnetic properties described above in 1-1 has the composition further containing at least one selected from 0.005 to 1.50% by mass of Ni, 0.01 to 1.50% by mass of Sn, 0.005 to 0.50% by mass of Sb, 0.01 to 1.50% by mass of Cu, 0.005 to 0.50% by mass of P, 0.005 to 0.50% by mass of Mo, and 0.01 to 1.50% by mass of Cr.

In the grain oriented electromagnetic steel sheet in the first aspect of the present invention, the N content is more preferably in the range of 10 to 100 ppm. The grain oriented electromagnetic steel sheet in the first aspect of the present invention is particularly excellent in the iron loss and punching processability.

1-3. A method of producing a grain oriented electromagnetic steel sheet having excellent magnetic properties without an undercoating mainly composed of forsterite comprises hot-rolling a steel slab having a composition containing, by % by mass, 0.08% or less of C, 1.0 to 8.0%, preferably 2.0 to 8.0%, of Si, and 0.005 to 3.0% of Mn, and Al and N decreased to 0.020% or less, preferably 100 ppm or less, and 50 ppm or less, respectively; annealing the hot-rolled sheet according to demand, then cold-rolling the sheet once, or twice or more with intermediate annealing performed therebetween, subsequently recrystallizing and annealing the cold-rolled sheet, and then final annealing the sheet at a temperature of 1000° C. or lower after an annealing separator not containing MgO is coated according to demand.

1-4. In the method of producing the grain oriented electromagnetic steel sheet described above in 1-3, the steel slab further contains, by % by mass, at least one selected from 0.005 to 1.50% of Ni, 0.01 to 1.50% of Sn, 0.005 to 0.50% of Sb, 0.01 to 1.50% of Cu, 0.005 to 0.50% of P, 0.005 to 0.50% of Mo, and 0.01 to 1.50% of Cr.

In the production method in the first aspect of the present invention, recrystallization annealing is preferably performed in a low oxidizing or non-oxidizing atmosphere having a dew point of 40° C. or lower. Also, final annealing is preferably performed in an atmosphere containing nitrogen and/or a low-oxidizing or non-oxidizing atmosphere having a dew point of 40° C. or lower.

Also, the slab heating temperature before hot rolling is preferably 1300° C. or lower.

Furthermore, the grain oriented electromagnetic steel sheet obtained in the present invention is preferably further coated with an insulating coating, and then baked.

In the first aspect of the present invention, by decreasing the C content of the steel slab to 0.006% or less, the decarburization step in annealing can be omitted to permit an attempt to further decrease the cost.

Particularly, when the steel slab containing over 100 ppm of Al is used, it is preferable that the steel slab contains, by % by mass, 0.006% or less of C, 2.5 to 4.5% of Si, 0.50% or less of Mn, O suppressed to 50 ppm or less, and the balance substantially composed of Fe and inevitable impurities, the atmosphere of recrystallization annealing has a dew point of 0° C. or lower, the maximum heating temperature of final annealing is 800° C. or higher, and the rate of heating from 300° C. to 800° C. in final annealing is 5 to 100° C./h.

As a result of intensive research for obtaining magnetic properties suitable for EI core materials based on the above-described technology of the inventors using a raw material not containing inhibitor components, the second aspect of the present invention has been developed.

The gist of the second aspect of the present invention lies in that a production method without the formation of an undercoating mainly composed of forsterite is used, a steel raw material containing substantially no inhibitor component is used, and the ultimate temperature of final annealing is kept down to 975° C. or lower to leave a predetermined amount of fine crystal grains, effectively improving the iron loss in the direction perpendicular to the rolling direction. The gist also lies in that the grains are coarsened before final cold rolling to further improve the magnetic flux density and the iron loss in the direction perpendicular to the rolling direction.

Namely, the construction of the second aspect of the present invention is as follows:

2-1. A grain oriented electromagnetic steel sheet having excellent magnetic properties without an undercoating mainly composed of forsterite ($Mg_2SiO_4$) has a composition containing 1.0 to 8.0% by mass, preferably 2.0 to 8.0 by mass, of Si, wherein secondary recrystallized grains contain fine crystal grains having a grain diameter of 0.15 mm to 0.50 mm at a rate of 2 grains/cm$^2$ or more, the iron loss ($W_{L15/50}$) in the rolling direction is 1.40 W/kg or less, and the iron loss ($W_{C15/50}$) in the direction perpendicular to the rolling direction is 2.6 times or less as large as that in the rolling direction.

2-2. In the grain oriented electromagnetic steel sheet having excellent magnetic properties described above in 2-1, the magnetic flux density ($B_{L50}$) in the rolling direction is 1.85 T or more, and the magnetic flux density ($B_{C50}$) in the direction perpendicular to the rolling direction is 1.70 T or more.

2-3. The grain oriented electromagnetic steel sheet having excellent magnetic properties described above in 2-1 or 2-2 has the composition further containing, by % by weight, at least one selected from 0.005 to 1.50% of Ni, 0.01 to 1.50% of Sn, 0.005 to 0.50% of Sb. 0.01 to 1.50% of Cu, 0.005 to 0.50% of P, 0.005 to 0.50% of Mo, and 0.01 to 1.50% of Cr.

The grain oriented electromagnetic steel sheet in the second aspect of the present invention has excellent iron losses in the rolling direction and the direction perpendicular to the rolling direction, and excellent punching quality.

2-4. A method of producing a grain oriented electromagnetic steel sheet having excellent magnetic properties without an undercoating mainly composed of forsterite comprises hot-rolling a steel slab having a composition containing, by % by mass, 0.08% or less of C, 1.0 to 8.0%, preferably 2.0 to 8.0%, of Si, 0.005 to 3.0% of Mn, Al decreased to 0.020% or less, preferably 100 ppm or less, and N decreased to 50 ppm or less; annealing the hot-rolled sheet according to demand, cold-rolling the sheet once, or twice or more with intermediate annealing performed therebetween, recrystallizing and annealing the cold-rolled sheet to obtain a grain diameter of 30 to 80 $\mu$m after annealing, and then final annealing the sheet at a temperature of 975° C. or lower after an annealing separator not containing MgO is coated according to demand.

2-5. A method of producing a grain oriented electromagnetic steel sheet having excellent magnetic properties without an undercoating mainly composed of forsterite comprises hot-rolling a steel slab having a composition containing, by % by mass, 0.08% or less of C, 1.0 to 8.0%, preferably 2.0 to 8.0%, of Si, 0.005 to 3.0% of Mn, Al decreased to 0.020% or less, preferably 100 ppm or less, and N decreased to 50 ppm or less; annealing the hot-rolled sheet according to demand, cold-rolling the sheet once, or twice or more with intermediate annealing performed therebetween, to obtain a grain diameter of 150 $\mu$m or more before final cold rolling, recrystallizing and annealing the cold-rolled sheet to a grain diameter of 30 to 80 $\mu$m after annealing, and then final annealing the sheet at a temperature of 975° C. or lower after an annealing separator not containing MgO is coated according to demand.

2-6. In the method of producing the grain oriented electromagnetic steel sheet described above in 2-4 or 2-5, the steel sheet further contains, by % by mass, at least one selected from 0.005 to 1.50% of Ni, 0.01 to 1.50% of Sn, 0.005 to 0.50% of Sb, 0.01 to 1.50% of Cu, 0.005 to 0.50% of P, 0.005 to 0.50% of Mo, and 0.01 to 1.50% of Cr.

In the production method in the second aspect of the present invention, the conditions and preferred conditions of the first aspect of the present invention may be used.

As a result of intensive research finding the probability that magnetic properties suitable for a high-frequency transformer can be obtained based on the technology of the present invention using a raw material not containing inhibitor components, and optimizing the properties, the third aspect of the present invention has been developed.

The gist of the third aspect of the present invention lies in the point that a production method without forming an undercoating mainly composed of forsterite is used, a steel raw material containing substantially no inhibitor component is used, and the ultimate temperature of final annealing is kept down to 975° C. or lower to leave fine crystal grains in secondary recrystallized grains, significantly improving the high-frequency iron loss as compared with a conventional grain oriented electromagnetic steel sheet. In order to secure an area ratio of Goss orientation grains of 50% or more to obtain a good high-frequency iron loss, it is effective to set the grain diameter before final cold rolling to less than 150 $\mu$m.

Namely, the construction of the third aspect of the present invention is as follows:

3-1. A grain oriented electromagnetic steel sheet having excellent magnetic properties without an undercoating mainly composed of forsterite ($Mg_2SiO_4$) has a composition containing 1.0 to 8.0% by mass, preferably 2.0 to 8.0 by mass, of Si, wherein the average grain diameter of secondary recrystallized grains in the surface of the steel sheet, which is measured for the grains except fine grains having a grain diameter of 1 mm or less, is 5 mm or more, the secondary recrystallized grains contain fine crystal grains having a grain diameter of 0.15 mm to 0.50 mm at a rate of 2 grains/cm$^2$ or more and fine crystal grains having a grain diameter of 0.15 mm to 1.00 mm at a rate of 10 grains/cm$^2$ or more, and the area ratio of crystal grains with an orientation difference of 20° or less from the {110}<001> orientation is 50% or more.

3-2. The grain oriented electromagnetic steel sheet having excellent magnetic properties described above in 3-1 has the composition further containing, by % by mass, at least one selected from 0.005 to 1.50% of Ni, 0.01 to 1.50% of Sn, 0.005 to 0.50% of Sb. 0.01 to 1.50% of Cu, 0.005 to 0.50% of P, 0.005 to 0.50% of Mo, and 0.01 to 1.50% of Cr.

The grain oriented electromagnetic steel sheet in the third aspect of the present invention has the property of a low high-frequency iron loss.

3-3. A method of producing a grain oriented electromagnetic steel sheet having excellent magnetic properties without an undercoating mainly composed of forsterite comprises hot-rolling a steel slab having a composition containing, by % by mass, 0.08% or less of C, 1.0 to 8.0%, preferably 2.0 to 8.0%, of Si, 0.005 to 3.0% of Mn, and Al decreased to 0.020% or less, preferably 100 ppm or less, and N decreased to 50 ppm or less, annealing the hot-rolled sheet according to demand, cold-rolling the sheet once, or twice or more with intermediate annealing performed therebetween, to obtain a grain diameter of less than 150 μm before final cold rolling, recrystallizing and annealing the cold-rolled sheet to obtain a grain diameter of 30 to 80 μm after annealing, and then final annealing the sheet at a temperature of 975° C. or lower after an annealing separator not containing MgO is coated according to demand.

In the third aspect of the present invention, the formation of the forsterite undercoating in final annealing is suppressed to obtain a smooth surface, which is suitable for high-frequency magnetic properties.

3-4. In the method of producing the grain oriented electromagnetic steel sheet described above in 3-3, the steel slab further contains, by % by mass, at least one selected from 0.005 to 1.50% of Ni, 0.01 to 1.50% of Sn, 0.005 to 0.50% of Sb, 0.01 to 1.50% of Cu, 0.005 to 0.50% of P, 0.005 to 0.50% of Mo, and 0.01 to 1.50% of Cr.

In the third aspect of the present invention, the conditions and preferred conditions in the first or second aspect of the present invention may be used.

BEST MODE FOR CARRYING OUT THE INVENTION (First Embodiment—Operation)

A first embodiment (aspect) of the present invention is described. Experiment resulting in the success of the first embodiment is first described (Experiment 1).

A steel slab having a composition free from inhibitor components and containing, by % by mass, 0.0020% of C, 3.5% of Si, 0.04% of Mn, Al and N decreased to 20 ppm and 8 ppm, respectively, and other components decreased to 30 ppm or less was produced by continuous casting. Then, the steel slab was heated to 1150° C., and then hot-rolled to form a hot-rolled sheet of 3.0 mm in thickness. The hot-rolled sheet was soaked at 850° C. for 1 minute in a nitrogen atmosphere, and then rapidly cooled.

Then, after a final thickness of 0.35 mm was obtained by cold rolling, recrystallization annealing was carried out by soaking at 930° C. for 20 seconds in two types of atmospheres including an atmosphere containing 50 vol % of hydrogen and 50 vol % of nitrogen and having a dew point of −30° C., and an atmosphere containing 50 vol % of hydrogen and 50 vol % of nitrogen and having a dew point of 50° C.

Then, final annealing was performed. In the final annealing, the temperature was increased from room temperature to 875° C. at a rate of 50° C./h in a nitrogen atmosphere having a dew point of −20° C., kept for 50 hours, and then further increased to various temperatures at a rate of 20° C./h in the atmosphere changed to a hydrogen atmosphere.

After final annealing, an organic coating (thickness: 1 $\mu$m) comprising aluminum bichromate, an acrylic resin emulsion and boric acid was coated.

By using the thus-obtained product sheet (Al reduced to 10 ppm, and other components being the same as or reduced to lower than the levels of the slab components except N), an EI core was formed, and its iron loss ($W_{15/50}$) was measured. For a comparison, an EI core formed by using a commercial grain oriented electromagnetic steel sheet having the same thickness was measured by the same method.

Figure 1:
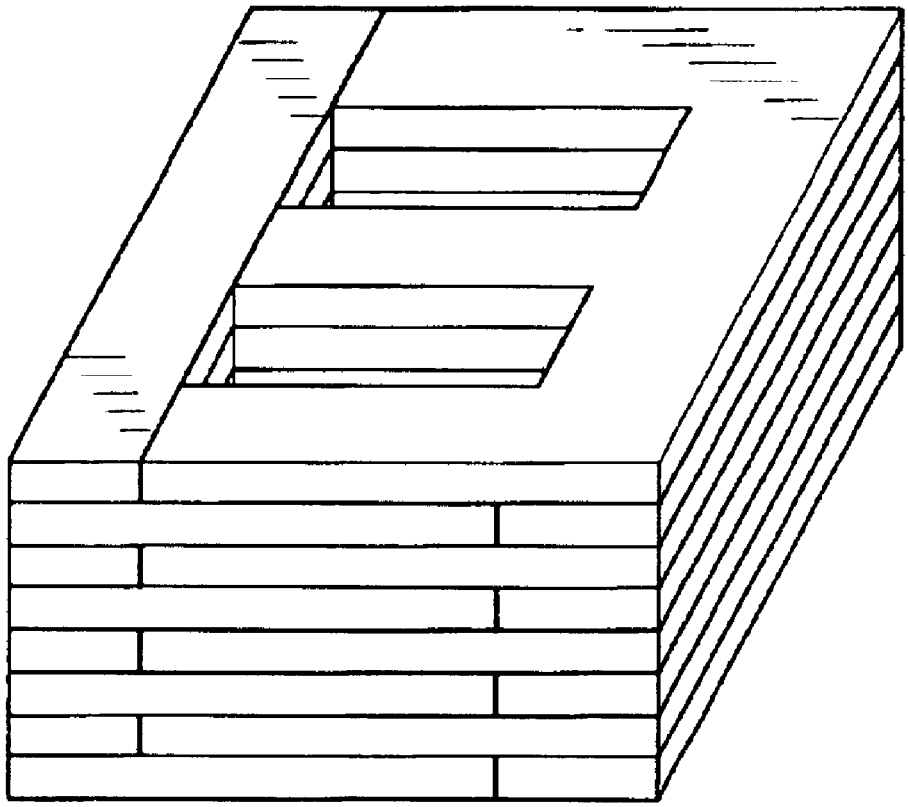
FIG. 1 is a drawing showing the shape of an EI core typical as a small-sized transformer.
Figure 2:
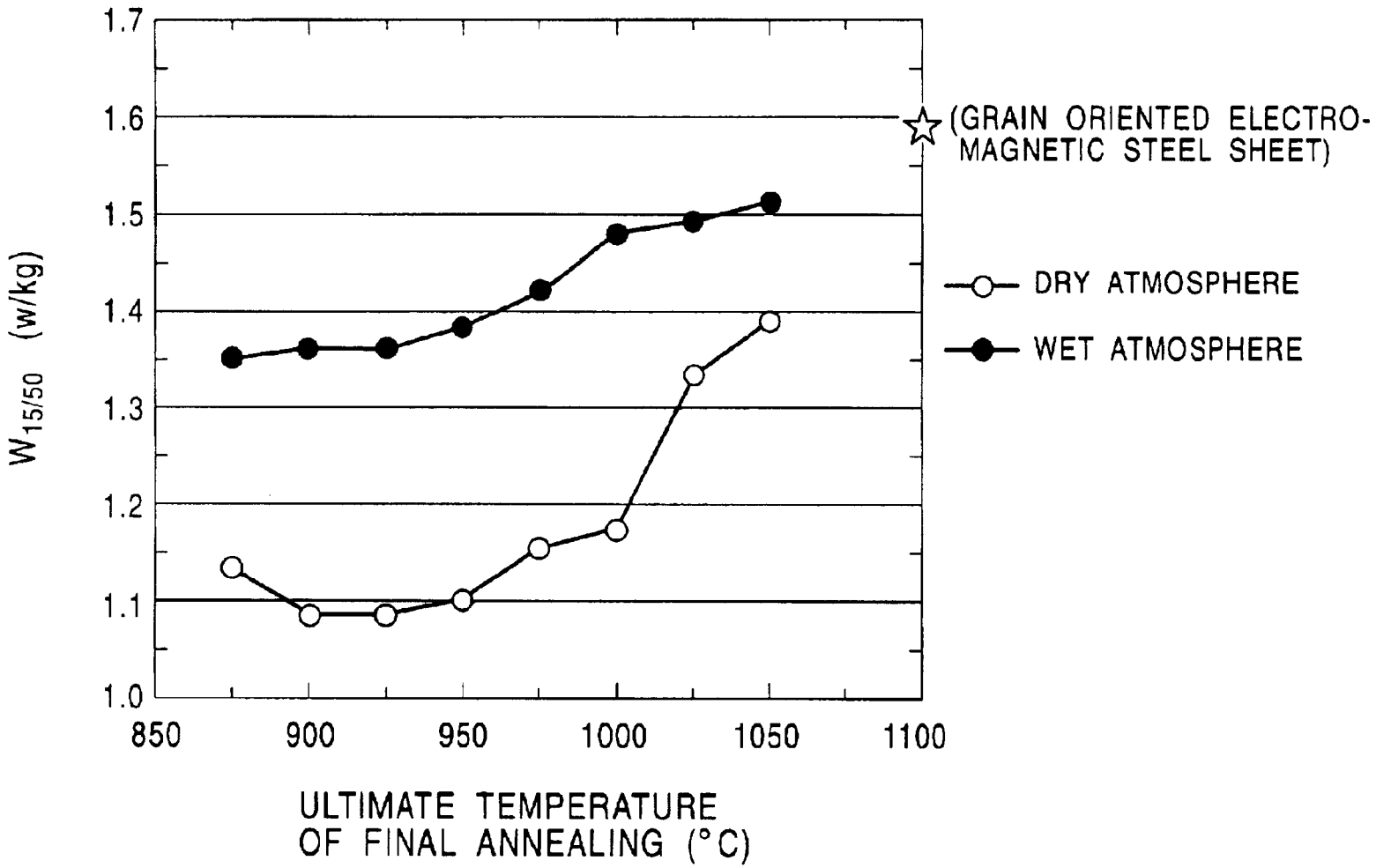
FIG. 2 is a graph showing the relationship between the ultimate temperature and atmosphere of final annealing and the magnetic property in the rolling direction of a grain oriented electromagnetic steel sheet.

FIG. 2 shows the results of measurement of the relationship between the ultimate temperature of final annealing and the magnetic property. Although the ultimate temperature of final annealing of the commercial grain oriented electromagnetic steel sheet is not known, the commercial grain oriented electromagnetic steel sheet is also shown in the graph for comparison.

This figure indicates that in recrystallization annealing in a dry atmosphere with a dew point of −30° C., a good iron loss is obtained in the range of ultimate temperatures of final annealing of 875 to 950° C., while the iron loss deteriorates at an ultimate temperature of over 1000° C. However, even when the iron loss deteriorates, the iron loss is better than that of the commercial grain oriented electromagnetic steel sheet.

On the other hand, in recrystallization annealing in a wet atmosphere with a dew point of 50° C., the iron loss is worse than that in the dry atmosphere, and only an iron loss close to that of the commercial grain oriented electromagnetic steel sheet can be obtained.

Next, in order to make clear the reason why the good iron loss was obtained in recrystallization annealing in a dry atmosphere, the crystal structure was examined.

Figure 3:
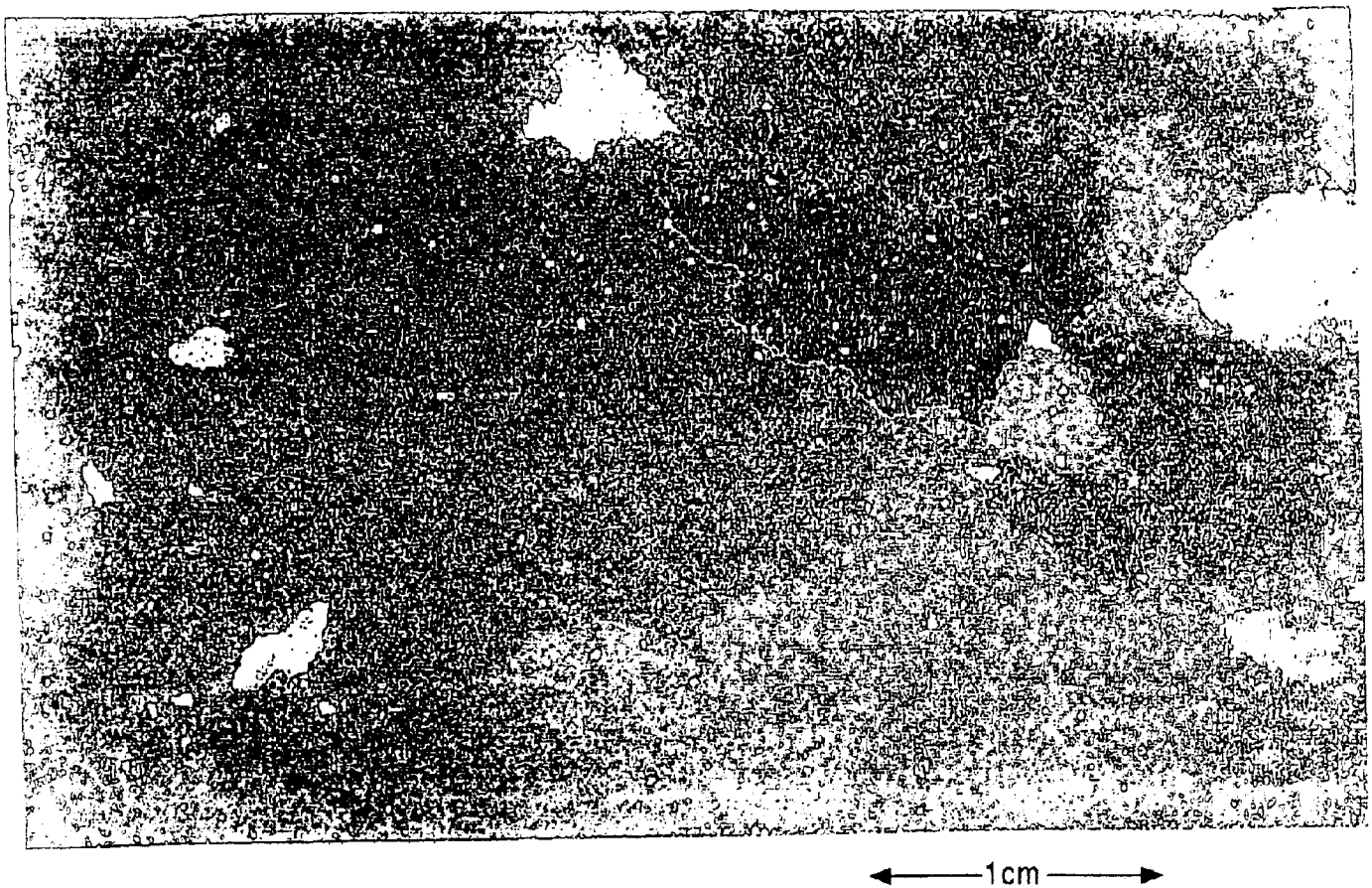
FIG. 3 is a photograph showing the crystal structure of a test material of the electromagnetic steel sheet shown in FIG. 2 after final annealing.

FIG. 3 shows the crystal structure after final annealing.

FIG. 3 indicates that fine crystal grains having a grain diameter of about 0.15 to 0.50 mm are scattered in secondary recrystallized coarse grains of as large as several cm. As a result of measurement of a sectional structure, it was found that the fine grains pass through the sheet in the thickness direction.

It is thus found that the existence rate of fine crystal grains (passing through the sheet in the thickness direction unless otherwise stated) having a grain diameter of 0.15 to 0.50 mm and the iron loss of the EI core have a strong correlation therebetween.

Figure 4:
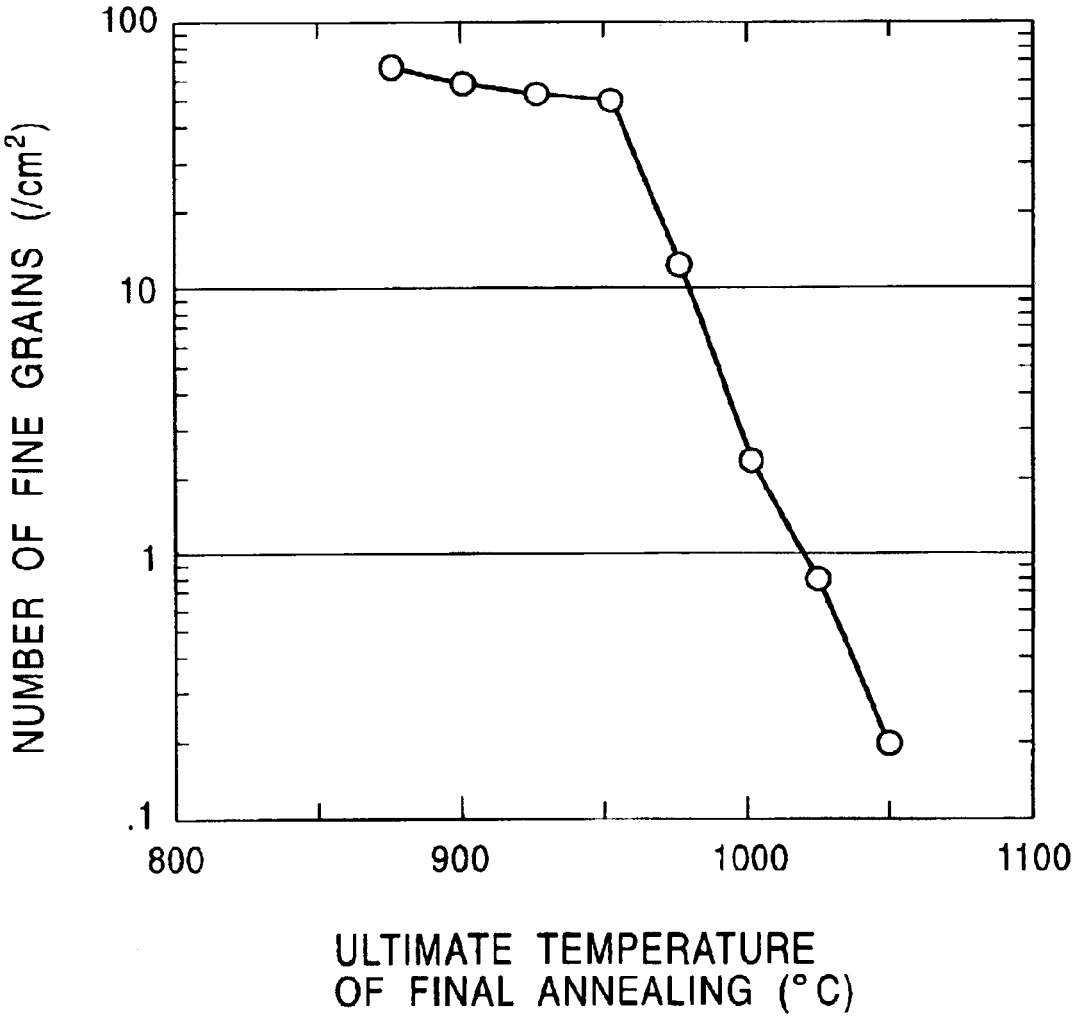
FIG. 4 is a graph showing the relationship between the ultimate temperature of final annealing and the existence rate of fine grains of the test material shown in FIG. 2.

FIG. 4 shows the results of measurement of the relationship between the ultimate temperature of final annealing and the existence rate of fine grains. The existence rate of fine grains was determined by measuring the number of fine crystal grains of 0.15 to 0.50 mm in diameter (corresponding to the diameter of a circle) within a 3-cm square region of the surface of the steel sheet.

FIG. 4 indicates that the number of fine grains decreases as the ultimate temperature increases. Namely, at an ultimate temperature of final annealing of 1000° C. or lower, the rate of the fine crystal grains is 2 grains/cm$^2$ or more, while at an ultimate temperature of 950° C. or lower, the rate is 50 grains/cm$^2$ or more.

Figure 5:
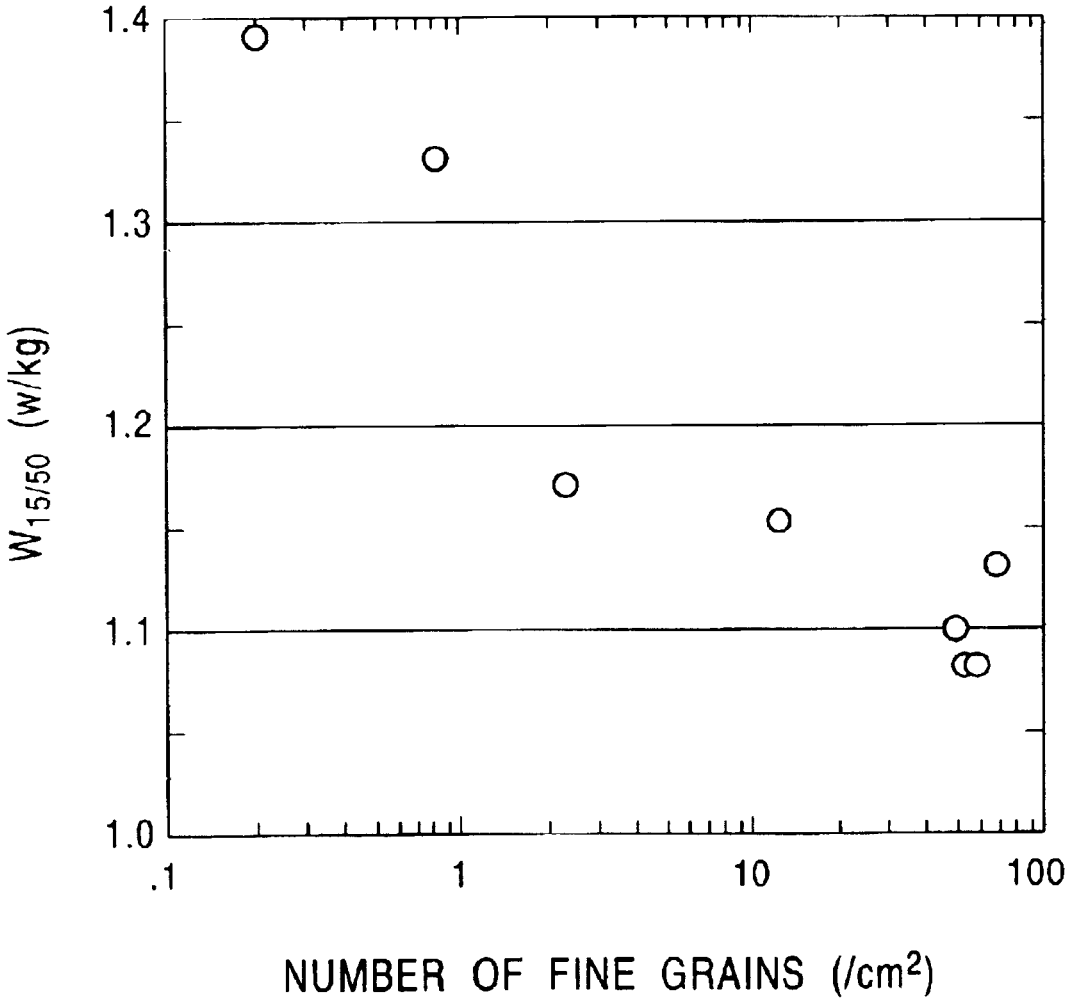
FIG. 5 is a graph showing the relationship between the existence rate of fine grains and the EI core iron loss of the test material shown in FIG. 2.

FIG. 5 shows the result of measurement of the relationship between the existence rate of fine grains and the EI core iron loss.

As shown in FIG. 5, it is made clear that with a rate of fine crystal grains of 2 grains/cm$^2$ or more, preferably 50 grains/cm$^2$ or more, a good iron loss is obtained.

Next, in order to evaluate punching quality, continuous punching into a 17-mm square (material: SKD-11) was carried out by using a 25-ton press and commercial punching oil under conditions of a punching rate of 350 strokes/min and a clearance of 6% of thickness until the burr height reached 50 $\mu$m.

Table 1 shows the results of measurement of the relationship between the ultimate temperature of final annealing and the number of times of punching.

TABLE 1

| Material annealed in dry atmosphere | | Material annealed in wet atmosphere | |
|---|---|---|---|
| Ultimate temperature (° C.) | Number of times of punching (10,000 times) | Ultimate temperature (° C.) | Number of times of punching (10,000 times) |
| 875 | >300 | 875 | 100 |
| 900 | >300 | 900 | 90 |
| 925 | >300 | 925 | 80 |
| 950 | 250 | 950 | 50 |
| 975 | 230 | 975 | 30 |
| 1000 | 200 | 1000 | 20 |
| 1025 | 120 | 1025 | 20 |
| 1050 | 100 | 1050 | 20 |

Comparative Example (Grain oriented electromagnetic steel sheet) Number of times of punching: 5,000 times Table 1 indicates that in the case of recrystallization annealing in a dry atmosphere, the punching quality is best, and in the case of recrystallization in a wet atmosphere, the punching quality is worse, and particularly, with the commercial grain oriented electromagnetic steel sheet having the forsterite undercoating, the punching quality significantly deteriorates.

It is also found that in the case of recrystallization annealing in a dry atmosphere, the number of times of punching is good at an ultimate temperature of 1000° C. or lower, and the punching quality is liable to deteriorate as the ultimate temperature increases.

The commercial grain oriented electromagnetic steel sheet has an undercoating mainly composed of forsterite, and forms an internal oxide layer mainly composed of silica by recrystallization annealing in a wet atmosphere, thereby deteriorating the punching quality. However, even in recrystallization annealing in a dry atmosphere, dependency of the number of times of punching on the ultimate temperature was observed.

Therefore, as a result of investigation for making clear the reason for this, it was found that the nitrogen content of steel after final annealing also affects the punching quality.

As a result of examination, it was found that the nitrogen content of steel increases during retention at 875° C., and decreases due to denitrification as the temperature increases to 950° C. or higher.

Figure 6:
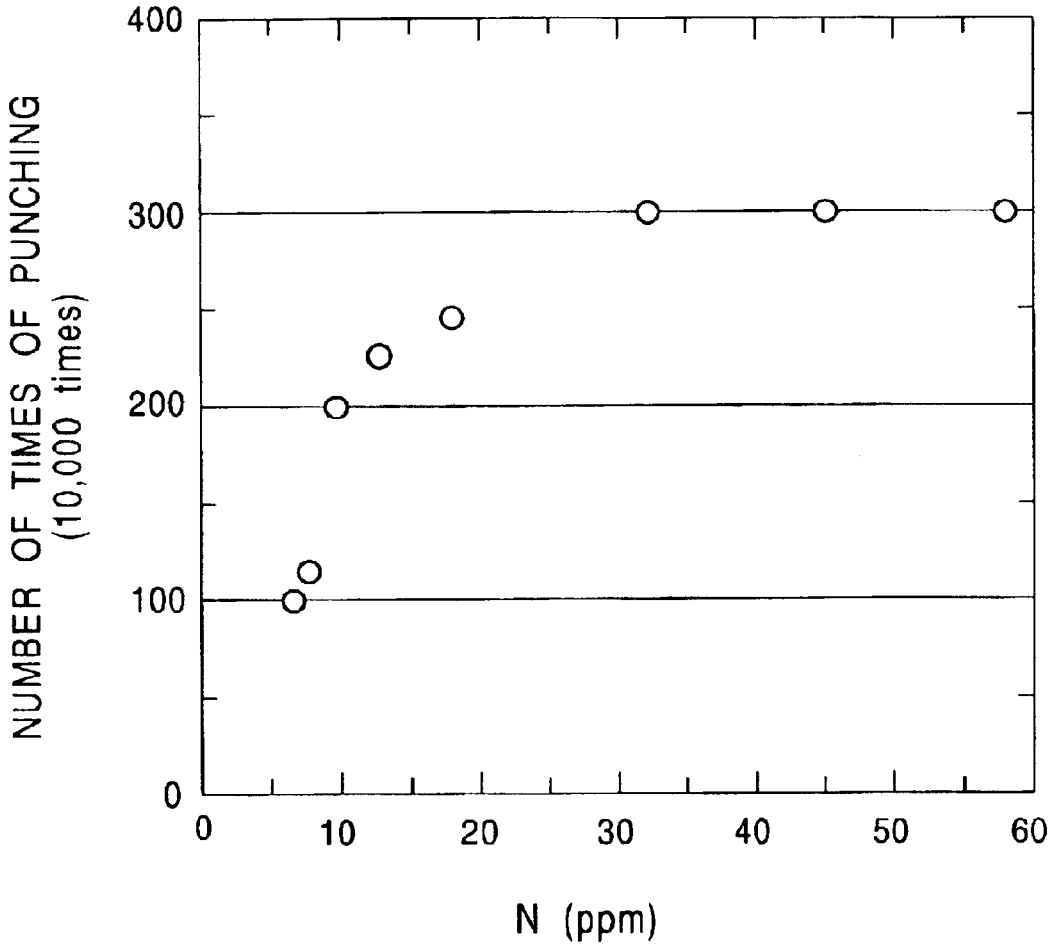
FIG. 6 is a graph showing the relationship between the N content of steel and the number of times of punching of the test material shown in FIG. 2.

FIG. 6 shows the relationship between the N content of steel and the number of times of punching. It is notable as shown in FIG. 6 that with an N content of steel of 10 ppm or more, the punching quality is significantly improved.

As described above, the iron loss can be effectively improved by eliminating the surface oxides such as the undercoating, the internal oxide layer, and the like by recrystallization annealing in a dry atmosphere, and by keeping down the ultimate temperature of final annealing to 1000° C. or lower, leaving fine crystal grains. Also, without the undercoating (glass coating) mainly composed of forsterite ($Mg_2SiO_4$), the punching quality can be significantly improved by adding 10 ppm or more of N to steel.

According to the present invention, recrystallization annealing is performed in a low oxidizing or non-oxidizing atmosphere having a dew point of 40° C. or lower to remove the surface oxides such as the forsterite undercoating, the undercoating, and the like, and the ultimate temperature of final annealing is kept down to 1000° C. or lower to leave fine crystal grains. Although the reason why this operation contributes to a decrease in the iron loss is not always made clear, the inventors think the reason as follows.

First, when recrystallization annealing is performed in a low oxidizing or non-oxidizing atmosphere to prevent the formation of the surface oxides, possibly, a magnetically smooth surface is maintained, and a magnetic wall readily moves to decrease a hystresis loss. Furthermore, the presence of fine crystal grains in secondary recrystallized grains possibly causes subdivision of magnetic domains to decrease an eddy current loss. The conventional technique using the inhibitor can achieve a low iron loss only when the inhibitor components (S, Se, N and the like) are purified by annealing at a high temperature of about 1000° C. or higher, but the method of the present invention not using the inhibitor can achieve a low iron loss after the completion of secondary recrystallization even when purification is not performed. Therefore, the method of keeping down the ultimate temperature of final annealing leaving fine grains is considered effective.

In the present invention, the conceivable reason why secondary recrystallization is developed in steel not containing the inhibitor components is the following.

As a result of intensive research on the reason for secondary recrystallization of Goss orientation grains, the inventors found that a grain boundary having an orientation difference angle of 20 to 45° in the primary recrystallized structure plays an important role, and reported this finding in Acta Material, Vol. 45 (1997), p. 1285.

Figure 7:
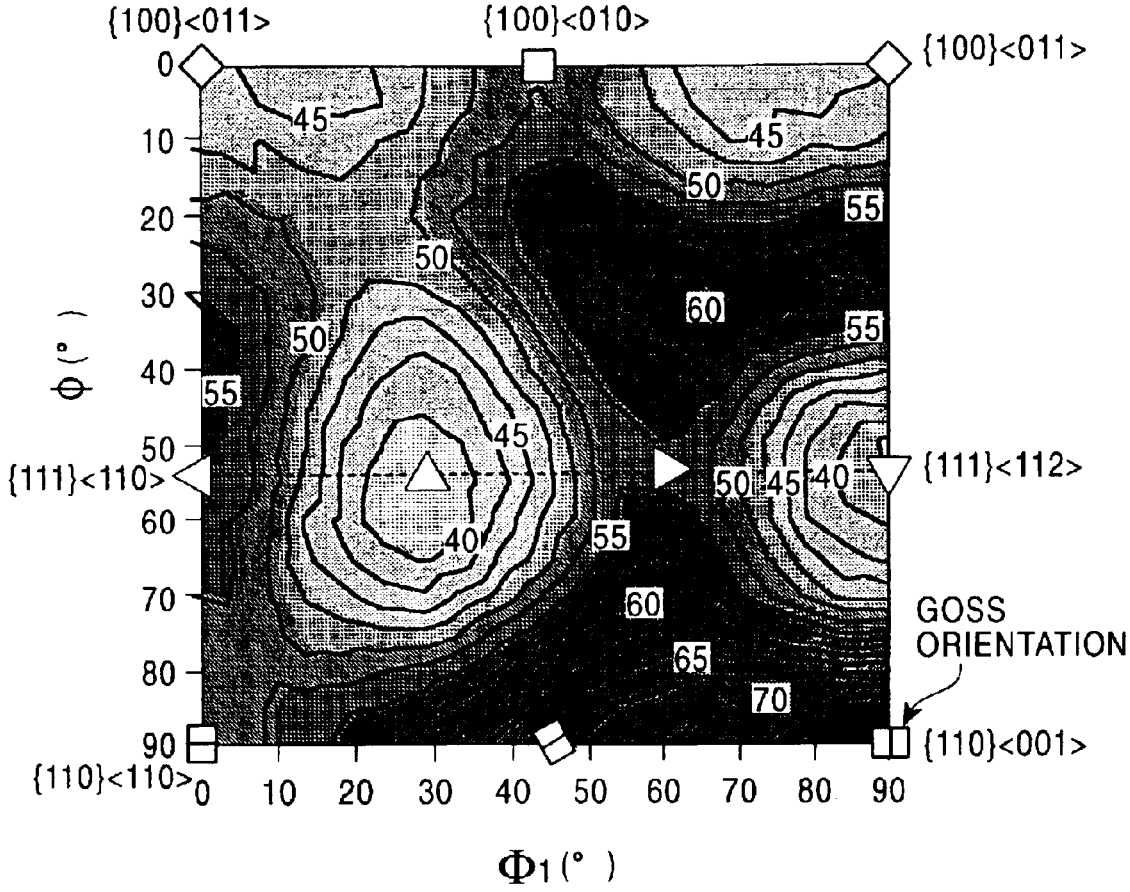
FIG. 7 is a drawing showing the existence frequencies of grain boundaries with an orientation difference angle of 20 to 45° in a primary recrystallized structure of a grain oriented electromagnetic steel sheet.

The primary recrystallized structure of the grain oriented electromagnetic steel sheet immediately before the secondary recrystallization was analyzed to examine the ratio (%) of grain boundaries having an orientation difference angle of 20 to 45° to the total grain boundaries around crystal grains having various crystal orientations. The results are shown in FIG. 7. In FIG. 7, the crystal orientation space is indicated by using a section of $\Phi_2$=45° of the Eulerian angles ($\Phi_L$, $\Phi$, $\Phi_2$), and main orientations such as the Goss orientation and the like are schematically shown.

FIG. 7 shows the existence frequencies of grain boundaries with orientation difference angles of 20 to 45° in the primary recrystallized structure of the grain oriented electromagnetic steel sheet, the Goss orientation having a highest rate. According to the experimental data of C. G. Dunn et al. (AIME Transaction, Vol. 188 (1949), P. 368), the grain boundaries having an orientation difference angle of 20 to 45° are high-energy grain boundaries. The high-energy grain boundaries have a large free space in the boundaries and a disordered structure. Diffusion along grain boundaries is a process in which atoms move through the grain boundaries, and thus the high-energy grain boundaries having a large free space have a high diffusion rate.

It is known that secondary recrystallization is developed accompanying growth and coarsening due to diffusion control by the precipitates called the inhibitor. Coarsening of the precipitates on the high-energy grain boundaries preferentially proceeds during final annealing, and thus pinning of the grain boundaries of Goss orientation is preferentially removed to start movement of the grain boundaries, thereby possibly growing Goss orientation grains.

As a result of further progress of the above research, the inventors found that the fundamental factor of preferential growth of the Goss orientation grains in secondary recrystallization is the distribution state of the high-energy grain boundaries in the primary recrystallized structure, and the function of the inhibitor is to produce a difference between the moving velocities of the grain boundaries of the Goss orientation grains, which are high-energy grain boundaries, and other grain boundaries. Namely, since coarsening of the inhibitor on the high-energy grain boundaries preferentially proceeds in secondary recrystallization annealing, pinning by the inhibitor on the high-energy grain boundaries is preferentially removed to start movement of the grain boundaries.

According to this theory, therefore, if the difference between the moving velocities of the grain boundaries can be produced, secondary recrystallization in the Goss orientation can be made without using the inhibitor.

Since the impurity elements present in steel are easily segregated on the grain boundaries, particularly the high-energy grain boundaries, there is possibly no difference between the moving velocities of the high-energy grain boundaries and other grain boundaries when steel contains large amounts of impurity elements.

Therefore, by highly purifying a raw material to remove the influence of the impurity elements, the original difference between the moving velocities depending upon the structure of the high-energy grain boundaries is elicited to permit secondary recrystallization in the Goss orientation.

Furthermore, according to the present invention, the reason why the punching quality is further significantly improved by controlling the N content of steel to 10 ppm or more is possibly that a small amount of solute nitrogen as interstitial dissolved element has an influence. Also, the presence of fine crystal grains themselves scattered in the secondary recrystallized grains, which are possibly increased by remaining N, possibly contributes to improvement in the punching quality.

In the conventional technique, it has been said that the inhibitor must be finely diffused in steel in order to develop secondary recrystallized grains, and thus a steel slab must be heated to a high temperature of above 1300° C. to 1400° C. before hot rolling. In order to prevent coarsening of crystal grains by high-temperature heating to form a homogeneous structure, steel conventionally contains 0.04% to 0.08% of C. However, based on the idea of the present invention that secondary recrystallization can be made with a highly-purified raw material, the inhibitor need not be diffused in steel. Therefore, the heating temperature of the slab can be decreased.

Furthermore, it is unnecessary to add C to the starting raw material, and progress decarburization in primary recrystallization annealing, and thus primary recrystallization annealing can be performed in a dry atmosphere to suppress the formation of $SiO_2$ in the surface layer of the steel sheet. As a result, the formation of the forsterite undercoating can be further suppressed.

When the steel slab contains over 100 ppm of Al, as a means for securing fine crystal grains having a grain diameter of 0.15 to 0.50 mm at a ratio of 2 grains/cm$^2$ or more to obtain a good iron loss, it is preferably to set (1) the rate of heating from 300° C. to 800° C. to 5 to 100° C./h, and (2) the maximum heating temperature to 800° C. or higher.

The reason why the behavior of secondary recrystallization depends upon the heating rate of secondary recrystallization annealing when steel contains a large amount of Al is not made clear. However, it is presumed that with a heating rate of as low as less than 5° C./h, small amounts of impurity elements are concentrated and precipitated before grain growth to partially suppress grain growth in some cases. While with a heating rate of as high as over 100° C./h, there is substantially no time difference between the temperature of movement of high-energy grain boundaries and the temperature of movement of low-energy grain boundaries, and thus all grain boundaries move at substantially the same time to exhibit the behavior of normal grain growth in some cases.

When the slab contains over 100 ppm (0.020% or less) of Al, the above methods (1) and (2) for improving the iron loss are effective for the case in which the slab composition satisfies 0.0060% or less of C, 2.5 to 4.5% of Si, 0.50% or less of Mn, and 50 ppm or less of 0 (all in % by mass) besides Al and N, and the balance is preferably composed of Fe and inevitable impurities. The Al content is more preferably less than 150 ppm. Furthermore, the dew point of final annealing is preferably 0° C. or less.

(First Embodiment—Limitation and Preferred Range)

A description will now be made of the reasons for limiting the features of the first embodiment of the present invention.

First, the grain oriented electromagnetic steel sheet of the first embodiment of the present invention must contain as a component, by % by mass, 1.0 to 8.0% of, preferably 2.0 to 8.0% of, Si.

This is because with a Si content of less than 1.0%, the sufficient effect of improving the iron loss cannot be obtained, while with a Si content of over 8.0%, processability deteriorates. In order to obtain the excellent effect of improving the iron loss, the Si content is preferably in the range of 2.0% to 8.0%.

In order to secure processability, it is preferable to add 10 ppm or more of N. However, in order to avoid deterioration of the iron loss, the amount of N added is preferably 100 ppm or less.

In order to decrease the iron loss of the steel sheet of the present invention, secondary recrystallized grains must contain fine crystal grains having a grain diameter of 0.15 mm to 0.50 mm at a rate of 2 grains/$cm^2$ or more, preferably 50 grains/$cm^2$ or more.

When the fine grains have a grain diameter of less than 0.15 mm or over 0.50 mm, the effect of subdividing magnetic domains is small, and thus do not contribute to a decrease in the iron loss. Therefore, consideration is given to the existence rate of the fine crystal grains having a grain diameter in the range of 0.15 mm to 0.50 mm, but with the fine crystal grains with an existence rate of less than 2 grains/$cm^2$, the effect of subdividing magnetic domains is decreased to fail to expect a sufficient improvement in the iron loss. Although the upper limit of the existence rate of the fine crystal grains is not limited, the upper limit is preferably about 1000 grains/$cm^2$ because an excessively high rate decreases the magnetic flux density.

In order to secure good punching quality, a major premise is that the undercoating mainly composed of forsterite ($Mg_2SiO_4$) is not formed on the surface of the steel sheet.

Next, the reasons for limiting the components of the raw material slab for producing the electromagnetic steel sheet of the present invention are described. In the composition below, "%" is "% by mass".

C: 0.08% or less

With the raw material having a C amount of over 0.08%, C cannot be easily decreased to about 50 to 60 ppm or less, which causes no magnetic aging, even by decarburization annealing, and thus the C amount must be limited to 0.08% or less. Particularly, in the stage of the raw material, the C amount is preferably decreased to 60 ppm (0.006%) or less in order to obtain a product having a smooth surface by intermediate annealing or recrystallization annealing in a dry atmosphere without decarburization.

Namely, by omitting decarburization, the opportunity of forming a $SiO_2$ coating in the surface layer of the steel sheet can be removed to prevent the punching quality of a product from deteriorating due to the $SiO_2$ coating, and further by a hard coating from being formed by reaction between the $SiO_2$ coating and an annealing separator in secondary recrystallization annealing. Also, the possibility of formation of coarse grains during decarburization can be avoided.

Mn: 0.005 to 3.0%

Mn is a necessary element for improving hot processability, but an adding amount of less than 0.005% has a low effect, while an adding amount of over 3.0% decreases the magnetic flux density. Therefore, the Mn amount is 0.005 to 3.0%.

In view of the magnetic properties and the alloy cost, the Mn amount is preferably 0.50% or less.

As described above for the electromagnetic steel sheet as a product sheet, the Si amount is 1.0 to 8.0%, preferably 2.0 to 8.0%.

From the viewpoint of avoiding deterioration in the magnetic properties due to y-transformation in annealing or the like in a high temperature region, the Si content is preferably 2.5% or more. Also, from the viewpoint of securing the saturation magnetic flux density, the Si content is preferably 4.5% or less.

Al: 0.020% or less (preferably 100 ppm or less), N: 50 ppm or less

In order to sufficiently develop secondary recrystallization, the Al content must be decreased to 0.020% or less, preferably less than 150 ppm, more preferably 100 ppm or less, and the N content must be decreased to 50 ppm or less, preferably 30 ppm or less.

Furthermore, it is advantageous to minimize the inhibitor forming elements S, Se and the like (the elements generally contained in the grain oriented electromagnetic steel sheet in order to form the inhibitor) to 50 ppm or less, preferably 30 ppm or less.

In order to prevent deterioration in the iron loss and secure processability, it is advantageous to decrease the nitride forming elements, Ti, Nb, Ta, V and the like, to 50 ppm or less each. Since B is both a nitride forming element and an inhibitor forming element, and has an influence even when the content is small, the B content is preferably 10 ppm or less.

Also, O may be a harmful element which inhibits the generation of secondary recrystallized grains, and may be left in matrix to cause deterioration in the magnetic properties, and thus the O content is 50 ppm or less, and preferably 30 ppm or less.

Although the essential components and the inhibited components are described above, the other elements described below can also be appropriately added in the present invention.

Namely, in order to improve the structure of a hot-rolled sheet to improve the magnetic properties, Ni can be added. However, with an adding amount of less than 0.005%, the magnetic properties such as an iron loss and the like are less improved, while with an adding amount of over 1.50%, secondary recrystallization is instabilized to deteriorate the magnetic properties such as an iron loss and the like. Therefore, the amount of Ni added is preferably 0.005 to 1.50%, and more preferably 0.01% or more.

Furthermore, in order to improve the iron loss, 0.01 to 1.50% of Sn, 0.005 to 0.50% of Sb, 0.01 to 1.50% of Cu, 0.005 to 0.50% of P, 0.005 to 0.50% of Mo and 0.01 to 1.50% of Cr can be added singly or in a mixture. However, with adding amounts smaller than lower limits, the effect of improving the iron loss is small, while with adding amounts larger than upper limits, development of secondary recrystallized grains is suppressed to cause difficulties in obtaining a good iron loss. Therefore, any of these elements is preferably added within the above range.

Other Elements

The balance except the above-described contained elements is preferably composed of Fe and inevitable impurities.

Of the above slab components, Mn, Si, Cr, Sb, Sn, Cu, Mo, Ni, P and most of the nitride forming elements are substantially the same in the composition of the slab and the composition of the grain oriented electromagnetic steel sheet as a product. Among the other components, the C and Al contents of the product sheet are decreased to 50 ppm or less and 100 ppm or less, respectively, and the contents of the elements other than the above-described elements are also decreased to 50 ppm or less. The analytical limit value of each of the elements C, N, B, S and P is about 0.0001%, and the limit values of the other elements are about 0.001%.

Next, the production method of the present invention is described.

A slab is produced from melted steel prepared to the above-described preferable composition by a conventional ingot-making method or continuous casting method. Alternatively, a thin cast slab of 100 mm or less in thickness may be produced directly by a direct casting method.

Although the slab is hot-rolled by a conventional heating method, the slab may be hot-rolled immediately after casting without heating. For the thin cast slab, hot rolling may be performed, or a subsequent step may be performed without hot rolling.

A general process for producing a grain oriented electromagnetic steel sheet uses a heating temperature (slab heating temperature) of above 1300 to 1450° C. before hot rolling, but in the present invention, the slab heating temperature (the rolling start temperature when the slab is rolled without heating after casting) may be a lower temperature, for example, 1200 to 1300° C. because there is no need to dissolve the inhibitor. Hot rolling may be performed according to a conventional method.

Then, the hot-rolled sheet is annealed according to demand. However, in order to highly develop the Goss structure in the product sheet, the hot-rolled annealing temperature is preferably 800° C. to 1050° C. This is because with a hot-rolled sheet annealing temperature of less than 800° C., the band structure produced in hot rolling remains, while with a hot-rolled sheet annealing temperature of over 1050° C., the grains after hot-rolled sheet annealing are significantly coarsened. In both cases, development of the Goss structure of the product sheet deteriorates, resulting in a decrease in the magnetic flux density.

After hot-rolled sheet annealing, cold rolling is performed to obtain a final thickness. In this step, cold rolling may be performed once to obtain the final thickness, or may be performed twice or more with intermediate annealing performed therebetween to obtain the final thickness.

In cold rolling, in order to develop the Goss structure, it is effective both to increase the rolling temperature to 100 to 250° C., and to perform aging once or several times in the temperature range of 100 to 250° C. during the course of cold rolling.

Then, recrystallization annealing is performed to decrease the C content to 60 ppm or less, which causes no magnetic aging, preferably 50 ppm or less, and more preferably 30 ppm or less.

Recrystallization annealing (primary recrystallization annealing) after final cold rolling (one time of cold rolling or final cold rolling of a plurality of times of cold rolling) is preferably performed in the range of 800 to 1000° C.

As the atmosphere of recrystallization annealing, for example, an inert atmosphere of a single gas such as a hydrogen atmosphere, a nitrogen atmosphere or an argon atmosphere, or an atmosphere of a mixture thereof may be used.

The atmosphere of recrystallization annealing is preferably a dry atmosphere having a dew point of 40° C. or lower, preferably 0° C. or lower, and a low oxidizing or non-oxidizing atmosphere is preferably used. Under these atmospheric conditions, surface oxides such as the undercoating, the internal oxide layer, and the like can easily be eliminated. Namely, under the above conditions, the formation of surface oxides such as $SiO_2$ and the like is preferably suppressed as much as possible in order to maintain a smooth surface and obtain a good iron loss.

By using the above atmosphere, the formation of a hard coating on the surfaces of the electromagnetic steel sheet can be prevented in final annealing or the like, thereby significantly improving the punching quality.

Furthermore, a technique of increasing the Si amount by a siliconizing method may be performed at any desired time after final cold rolling, for example, after final cold rolling, after recrystallization annealing or after final annealing.

Then, an annealing separator is applied according to demand. However, in the present invention, it is important to avoid using MgO which reacts with silica to form forsterite.

Therefore, it is most preferable not to apply the annealing separator, but when the annealing separator is added, a material which does not react with silica, such as colloidal silica, alumina power, BN powder or the like, is used.

In coating the separator, electrostatic coating is effective for suppressing the formation of oxides without taking in moisture.

Then, final annealing is performed to develop a secondary recrystallized structure.

In order to develop secondary recrystallization annealing and secure 10 ppm or more of solute nitrogen, it is effective that the atmosphere of final annealing contains nitrogen.

Also, in order to suppress the formation of oxides, a low oxidizing or non-oxidizing atmosphere having a dew point of 40° C. or lower, preferably 0° C. or lower, is preferably used. This is because with an excessively high dew point, the surface oxides are excessively produced to deteriorate not only the iron loss but also the punching quality.

Furthermore, in order to generate secondary recrystallization, final annealing is preferably performed at 800° C. or higher. Since the rate of heating to 800° C. has less influence on the magnetic properties except in the case described below, the heating rate may be set to any condition. The maximum ultimate temperature must be 1000° C.

or lower, preferably 950° C. or lower, in order to form fine crystal grains having a grain diameter of 0.15 mm to 0.50 mm corresponding to a circle at a rate of 2 grains/cm$^2$ or more, preferably 50 grains/cm$^2$ or more, in the secondary recrystallized grains to decrease the iron loss.

Although the lower limit of the dew point in each annealing is not limited, the possible lower limit is generally about −50° C. from the viewpoint of the process.

When the steel slab has an Al content of over 100 ppm, in order to obtain the good iron loss, final annealing is preferably performed under a further condition in which (1) the rate of heating from 300° C. to 800° C. is 5 to 100° C./h, and (2) the highest heating temperature is 800° C. or higher. This method is particularly effective for the slab composition satisfying 0.0060% of C, 2.5 to 4.5% of Si, 0.50% or less of Mn and 50 ppm or less of 0 (% by mass), and the final annealing described below is preferably performed with a dew point of 0° C. or lower.

In this way, the grain oriented electromagnetic steel sheet can be produced, in which the secondary recrystallized grains are steadily grown, and hard coatings such as the forsterite undercoating and the like are not formed on the surfaces. When steel sheets are laminated to assemble an electric motor or transformer, it is effective to perform insulation coating on the surfaces of the steel sheets in order to improve the iron loss. Although the insulation coating is not limited, organic coating containing a resin is preferred for securing good punching quality or lubricity. However, when weldability is regarded as important, inorganic coating is applied.

Examples of such coatings include organic types such as acryl, epoxy, vinyl, phenol, styrene, and melamine resin coatings, and the like; and semi-organic types obtained by adding inorganic colloid, a phosphoric acid compound, a chromic acid compound or the like to the organic resins.

The coatings are generally formed by coating a treatment solution (a solution of the above coating component) and then baking the resultant coating in the temperature range of about 100 to 350° C.

(Second Embodiment—Operation)

A second embodiment (aspect) of the present invention is described. First, experiment leading to the success of the present invention is described (Experiment 2-1).

A steel slab having a composition free from inhibitor components and containing, by % by mass, 0.0025% of C, 3.4% of Si, 0.06% of Mn, Al and N decreased to 30 ppm and 12 ppm, respectively, and other components decreased to 30 ppm or less was produced by continuous casting. Then, the steel slab was heated to 1200° C., and then hot-rolled to form a hot-rolled sheet of 2.5 mm in thickness. The hot-rolled sheet was soaked at 950° C. for 1 minute in a nitrogen atmosphere, and then rapidly cooled.

Then, after a final thickness of 0.35 mm was obtained by cold rolling, recrystallization annealing was performed by soaking at 930° C. for 20 seconds in an atmosphere containing 50 vol % of hydrogen and 50 vol % of nitrogen and having a dew point of −30° C. Then, a sample to which an annealing separator was not applied, and a sample to which a slurry mixture of MgO and water was applied as an annealing separator were formed.

Then, final annealing was performed. In the final annealing, the temperature was increased from room temperature to 875° C. at a rate of 50° C./h in a nitrogen atmosphere having a dew point of −20° C., kept at this temperature for 50 hours, and then further increased to various temperatures at a rate of 25° C./h.

The thus-obtained product sheets (Al reduced to 10 ppm, N reduced to about 30 ppm, and other components being the same as or reduced to lower than the levels of the slab components) were measured with respect to iron loss ($W_{15/50}$). For a comparison, the iron loss ($W_{15/50}$) of a commercial grain oriented electromagnetic steel sheet having the same thickness was measured.

Figure 8:
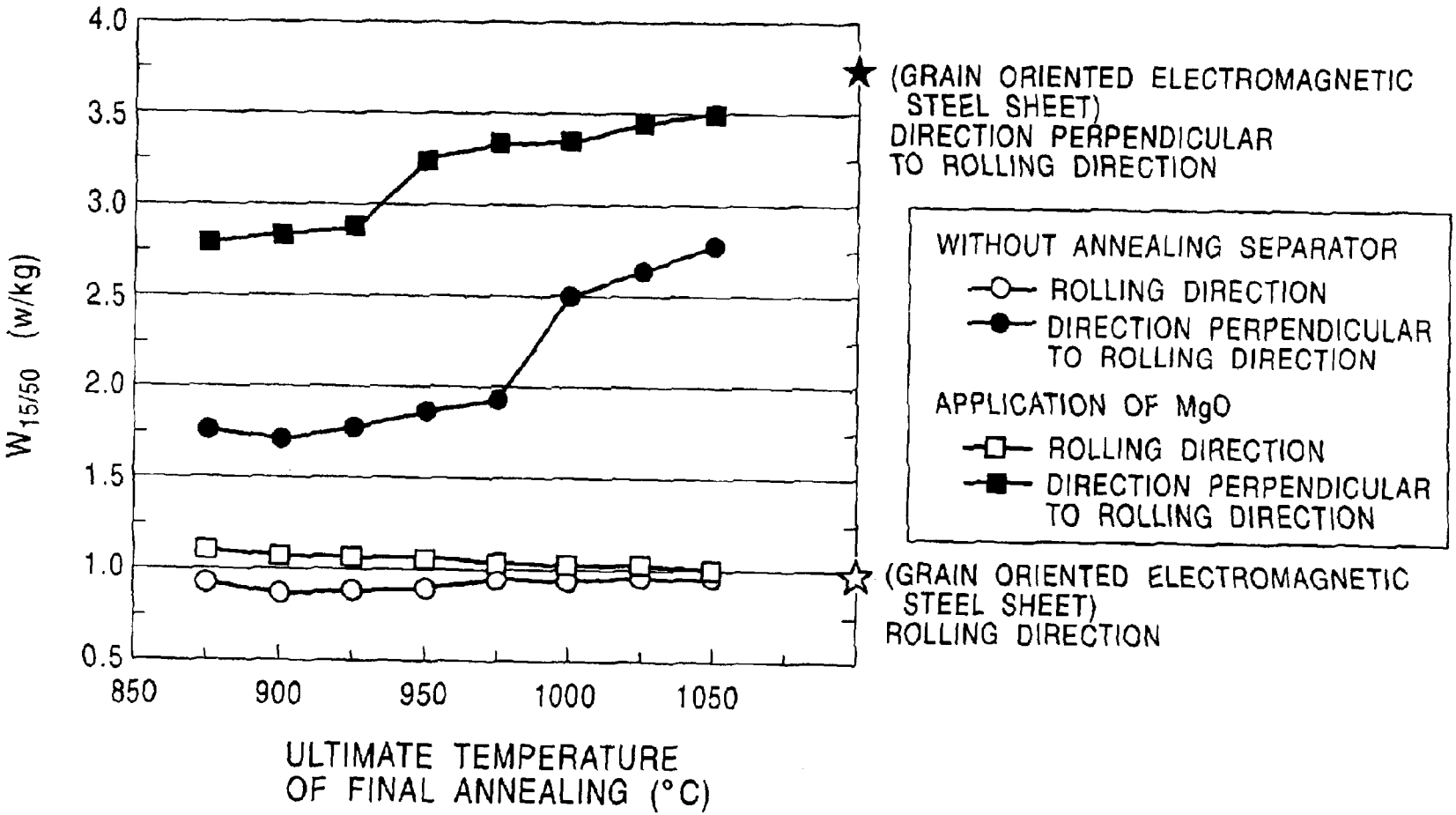
FIG. 8 is a graph showing the relationship between the ultimate temperature of final annealing, the presence of an annealing separator and the iron loss in each of the rolling direction and the direction perpendicular to the rolling direction of a grain oriented electromagnetic steel sheet.

FIG. 8 shows the results of measurement of the relationship between the ultimate temperature of final annealing and the iron loss in each of the rolling direction and the direction perpendicular to the rolling direction. Although the ultimate temperature of final annealing of the commercial grain oriented electromagnetic steel sheet is unknown, the ultimate temperature thereof is also shown in the figure (this applies to FIGS. 9 and 10).

This figure indicates that in the sample to which the annealing separator was not applied, the iron loss in the rolling direction is substantially constant with an ultimate temperature of final annealing of 875° C. or higher, while the iron loss in the direction perpendicular to the rolling direction is particularly good in the ultimate temperature range of 875 to 975° C., and abruptly deteriorates when ultimate temperature exceeds 975° C. However, even when the iron loss deteriorates, the iron loss is superior to that of the commercial grain oriented electromagnetic steel sheet.

On the other hand, in the sample to which MgO was applied as the annealing separator, particularly the iron loss in the direction perpendicular to the rolling direction is inferior to that of the sample to which the annealing separator was not applied, and the iron loss abruptly deteriorates when the ultimate temperature of final annealing exceeds 950° C., thereby obtaining only an iron loss close to the commercial grain oriented electromagnetic steel sheet.

Figure 9:
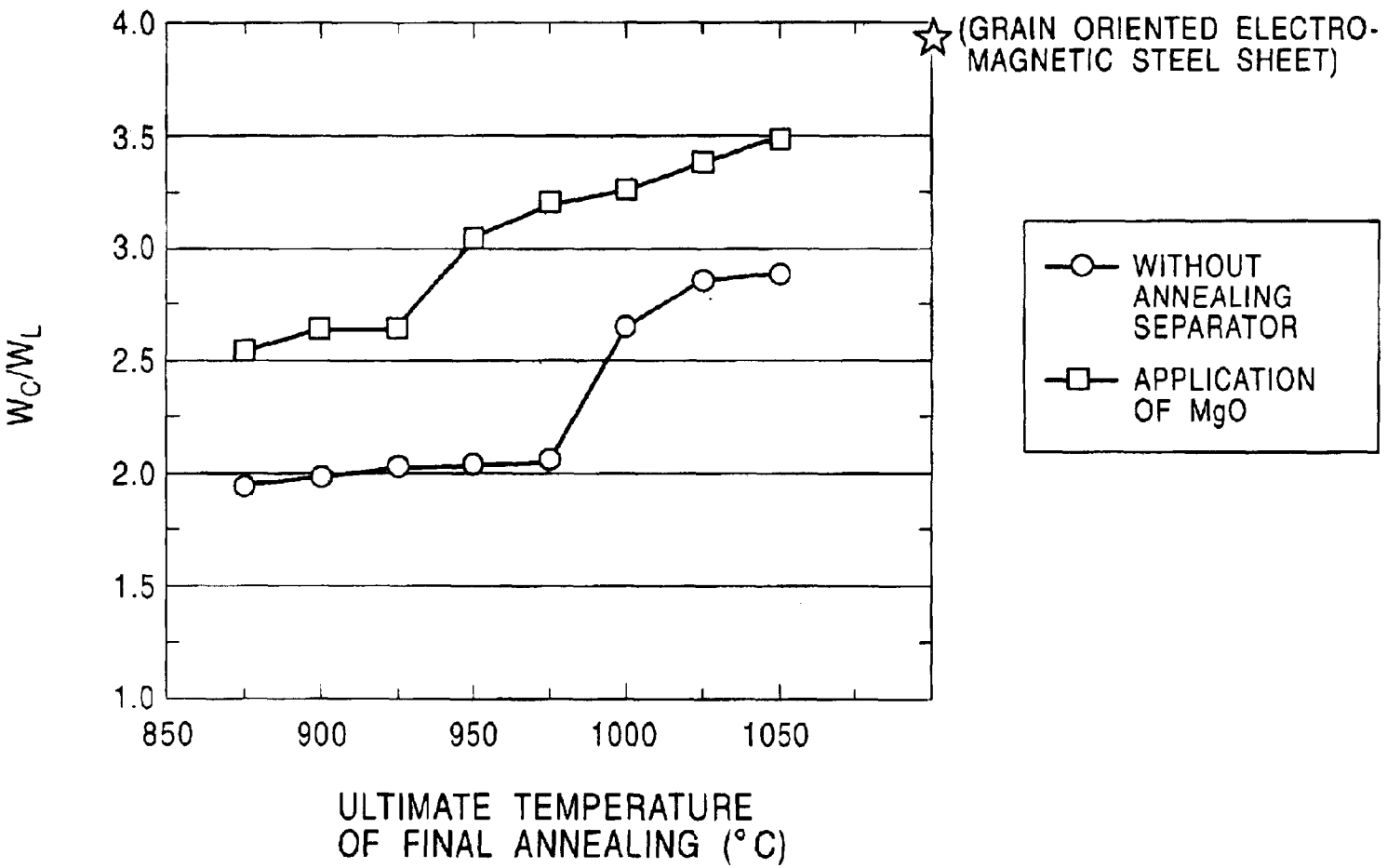
FIG. 9 is a graph showing the relationship between the ultimate temperature of final annealing and the ratio of the iron loss in the direction perpendicular to the rolling direction to the iron loss in the rolling direction of the experimental material shown in FIG. 8.
Figure 10:
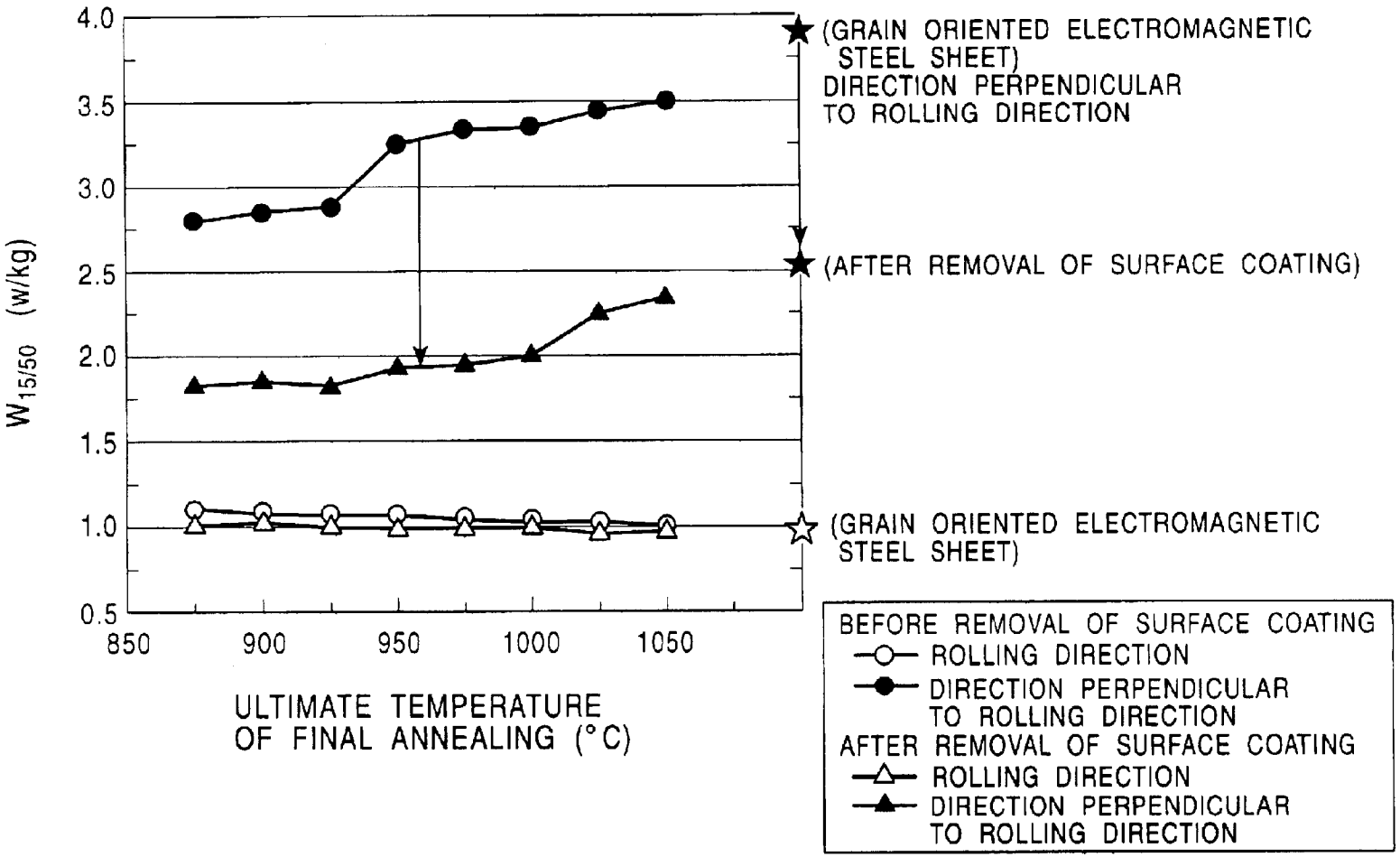
FIG. 10 is a graph showing comparison of changes in the iron loss in each of the rolling direction and the direction perpendicular to the rolling direction with the ultimate temperature of final annealing between before and after removal of a surface coating of each of the grain oriented electromagnetic steel sheet (the experimental material shown in FIG. 8).

FIG. 9 shows a comparison of the ratio of the iron loss in the direction perpendicular to the rolling direction to that in the rolling direction between presence and absence of the annealing separator.

As shown in the figure, the iron loss ratio of the commercial grain oriented electromagnetic steel sheet is about 4, exhibiting extremely high anisotropy. However, in the case of final annealing at 975° C. or lower without the annealing separator being applied, the iron loss ratio is 2.6 or less, and the anisotropy is significantly decreased as compared with the commercial grain oriented electromagnetic steel sheet. The significant improvement in the iron loss in the direction perpendicular to the rolling direction suggests that the samples are very useful as a material for an EI core affected by the iron loss in the direction perpendicular to the rolling direction, as compared with existing grain oriented electromagnetic steel sheets.

Next, in order to elucidate the reason why a good iron loss is obtained, particularly, in the direction perpendicular to the rolling direction to decrease the anisotropy of the iron loss when the annealing separator is not applied, the iron loss of each of the sample to which the annealing separator was applied, and the commercial grain oriented electromagnetic steel sheet was measured after the surface oxide coating was pickled, and then the surface was smoothed by electropolishing. The results are summarized in FIG. 10.

This figure indicates newly found matter that in both the sample to which the annealing separator was applied, and the commercial grain oriented electromagnetic steel sheet, the iron loss in the direction perpendicular to the rolling direction is improved by removing the oxide coating from the surface and further smoothing the surface.

As a result of the same treatment of the sample to which the annealing separator was not applied, the iron loss was little changed.

This result suggests that the forsterite undercoating formed on the surface of the steel sheet significantly deteriorates the iron loss in the direction perpendicular to the rolling direction.

Next, an examination was made of the crystal structure of the sample to which the annealing separator was not applied, and which exhibited a good iron loss with low anisotropy.

Figure 11:
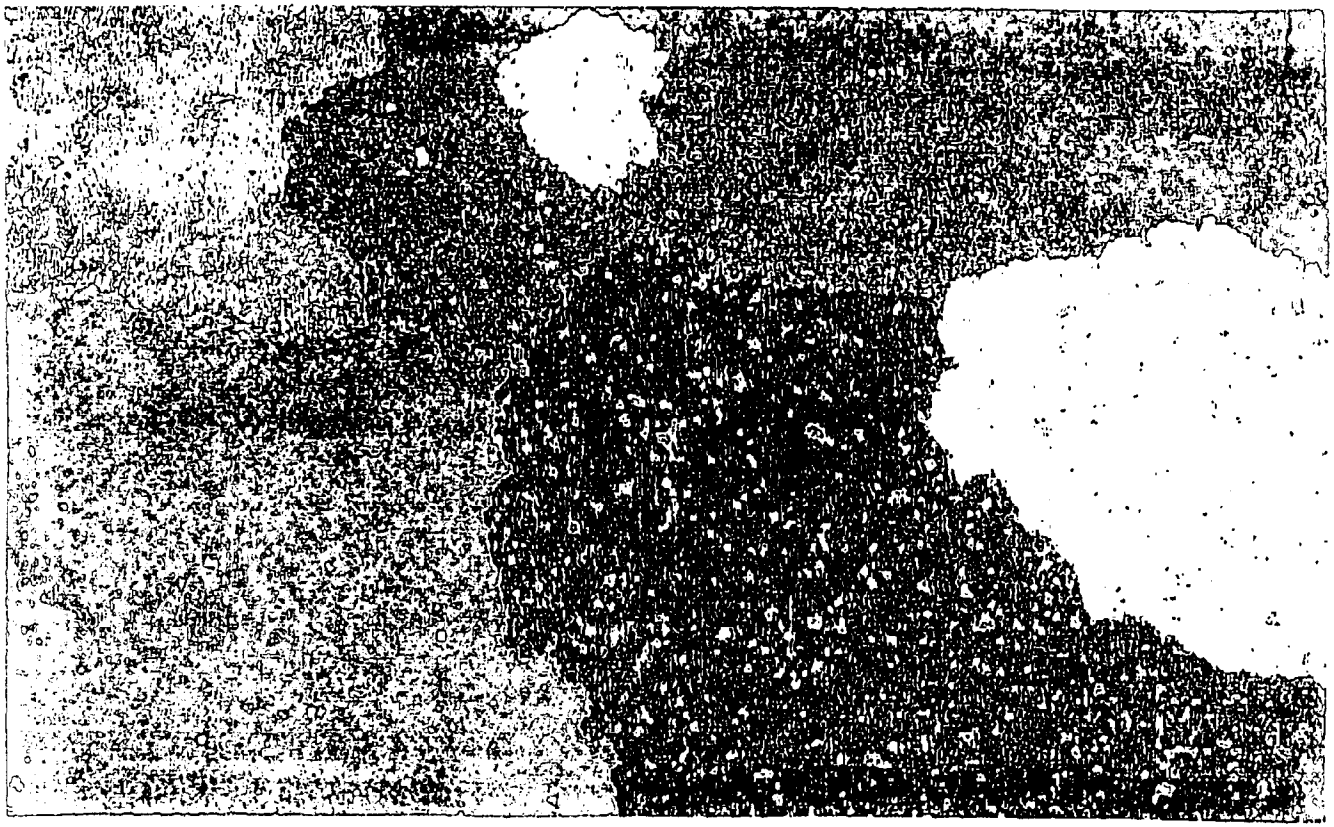
FIG. 11 is a photograph showing the crystal structure of the grain oriented electromagnetic steel sheet (the experimental material shown in FIG. 8) after being maintained at 875° C.

FIG. 11 shows the crystal structure after final annealing. This figure indicates that fine crystal grains having a grain diameter of about 0.15 to 0.50 mm are scattered in coarse secondary recrystallized grains of several cm. The existence rate of the fine grains was determined by measuring the number of fine crystal grains in a 3-cm square region of the surface of the steel sheet.

It is thus found that the existence rate of fine crystal grains having a grain diameter of 0.15 to 0.50 mm and the iron loss in the direction perpendicular to the rolling direction have a strong correlation.

The fine grains decrease in number as the ultimate temperature of final annealing increases, and disappear at around 1050° C.

Figure 12:
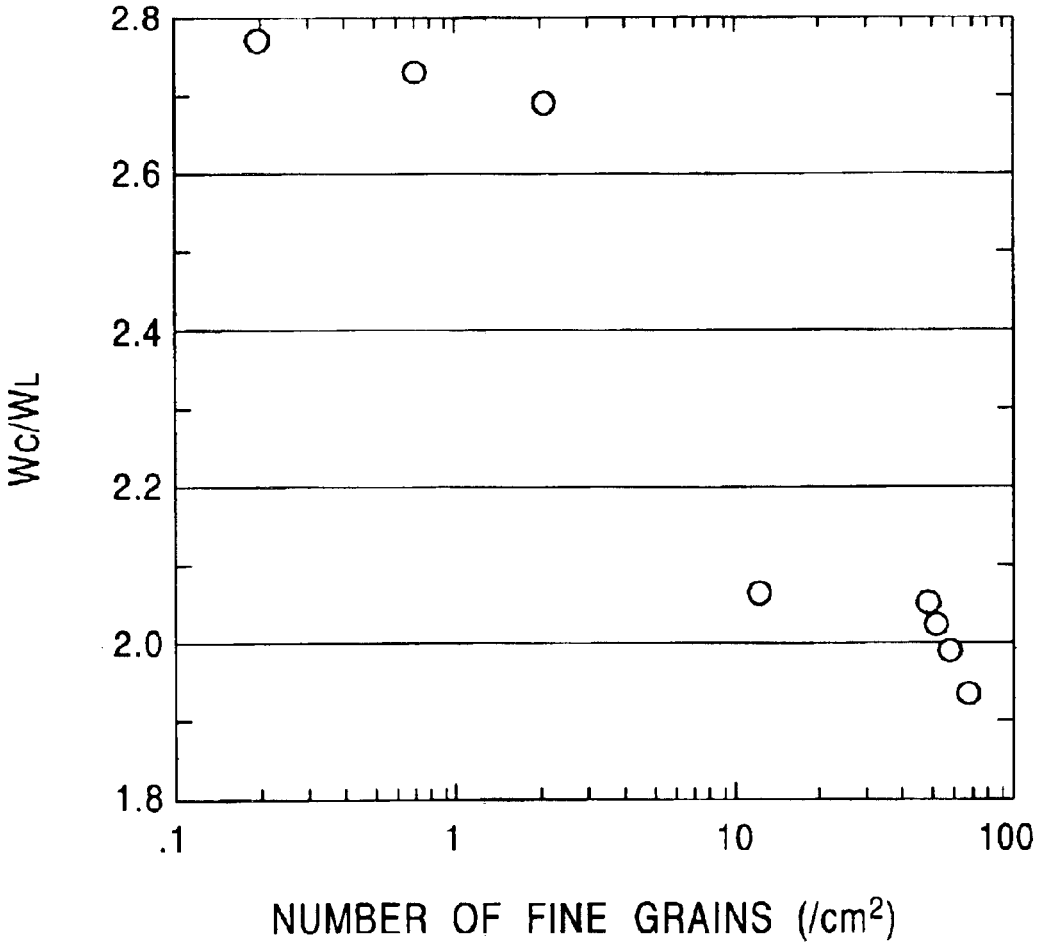
FIG. 12 is a graph showing the relationship between the existence rate of fine grains and the ratio of the iron loss in the direction perpendicular to the rolling direction to the iron loss in the rolling direction of the experimental material shown in FIG. 8.

FIG. 12 shows the results of measurement of the relationship between the existence rate of fine grains and the ratio of the iron loss in the direction perpendicular to the rolling direction to that in the rolling direction.

The figure indicates that the iron loss in the direction perpendicular to the rolling direction is improved as the rate of the fine crystal grains increases. Namely, when the existence rate of the fine crystal grains having a grain diameter of 0.15 to 0.50 mm is 3 grains/cm$^2$ or more, preferably 10 grains/cm$^2$ or more, the iron loss in the direction perpendicular to the rolling direction is significantly improved.

When the ultimate temperature of final annealing is 1000° C. or lower, the secondary recrystallized grains contain 2 grains/cm$^2$ or more of fine crystal grains having a grain diameter of 0.15 mm to 0.50 mm and passing through the sheet in the thickness direction, and when the temperature is 975° C. or lower, 10 grains/cm$^2$ or more of fine grains can be secured.

Next, in order to obtain knowledge about an improvement in the magnetic flux density, experiment was carried out by changing the grain diameter before cold rolling under various hot-rolled sheet annealing conditions (Experiment 2-2).

A steel slab having a composition free from inhibitor components and containing, by % by mass, 0.023% of C, 3.4% of Si, 0.06% of Mn, Al and N decreased to 50 ppm and 22 ppm, respectively, and other components decreased to 30 ppm or less was produced by continuous casting. Then, the steel slab was heated to 1200° C., and then hot-rolled to form a hot-rolled sheet of 3.2 mm in thickness. The hot-rolled sheet was annealed at various temperatures for various soaking times in a nitrogen atmosphere, and then rapidly cooled.

Then, after cold rolling was performed at a temperature of 200° C. to obtain a final thickness of 0.30 mm, decarburization and recrystallization annealing was performed by soaking at 930° C. for 45 seconds in an atmosphere containing 50 vol % of hydrogen and 50 vol % of nitrogen and having a dew point of 35° C. Then, final annealing was performed without the annealing separator being applied. In the final annealing, the temperature was increased from room temperature to 875° C. at a rate of 50° C./h in a nitrogen atmosphere having a dew point of −20° C., and then kept at this temperature for 50 hours.

The thus-obtained product sheet (C decreased to 20 ppm, Al decreased to 20 ppm, N decreased to about 30 ppm, and other components being the same as or decreased to lower than the levels of the slab components) was measured with respect to the magnetic flux density ($B_{50}$) and iron loss ($W_{15/50}$).

In any of experimental materials, the secondary recrystallized grains contained fine crystal grains having grain diameter of 0.15 mm to 0.50 mm at a rate of 10 grains/cm$^2$ or more.

Figure 13:
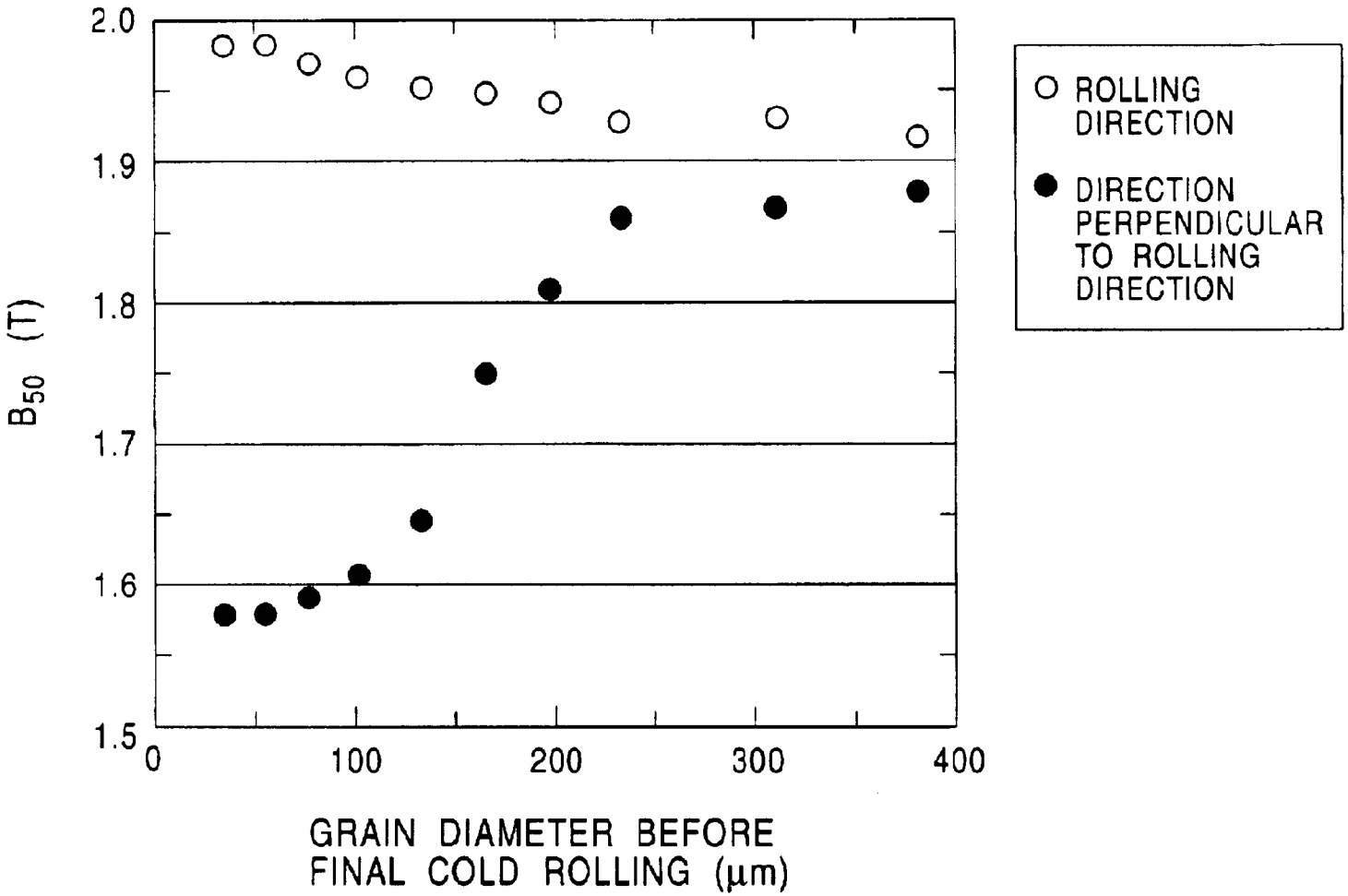
FIG. 13 is a graph showing the relationship between the grain diameter before final cold rolling and the magnetic flux densities in the rolling direction and the direction perpendicular to the rolling direction of a grain oriented electromagnetic steel sheet.
Figure 14:
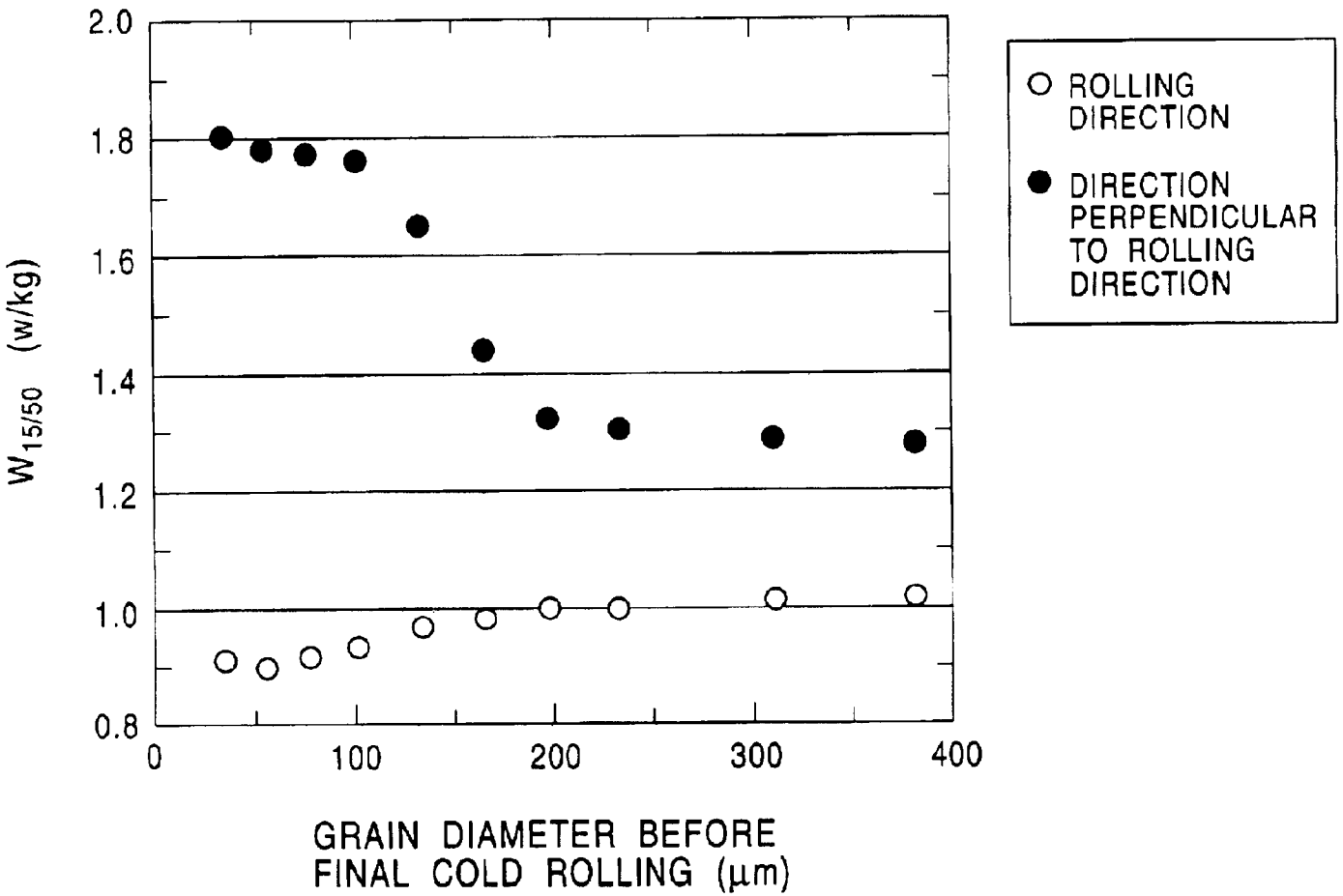
FIG. 14 is a graph showing the relationship between the grain diameter before final cold rolling and the iron losses in the rolling direction and the direction perpendicular to the rolling direction of the experimental material shown in FIG. 13.

FIGS. 13 and 14 show the results of measurement of the relationship between the grain diameter (corresponding to a circle) before final cold rolling and the magnetic properties (the magnetic flux density and iron loss) in the rolling direction and the direction perpendicular to the rolling direction.

As shown in FIG. 13, as the grains before cold rolling coarsen, the magnetic flux density in the direction perpendicular to the rolling direction is improved to decrease the anisotropy of the magnetic flux densities in the rolling direction and the direction perpendicular to the rolling direction, exhibiting that $B_{L50} \geqq 1.85$ T and $B_{C50} \geqq 1.70$ T. As newly shown in FIG. 14, the iron loss in the direction perpendicular to the rolling direction is also improved, and anisotropy of the iron loss is decreased, thereby exhibiting that ideal magnetic properties as an EI core material can be obtained.

As described above, it is newly found that the iron loss in the direction perpendicular to the rolling direction can be significantly improved by suppressing the formation of the forsterite undercoating by avoiding to use the annealing separator, and by keeping down the ultimate temperature of final annealing to 975° C. or lower leaving the fine crystal grains.

It is also newly found that the magnetic flux density and iron loss in the direction perpendicular to the rolling direction can be improved by coarsening the grains before final cold rolling.

The grain oriented electromagnetic steel sheet having the above-mentioned properties is useful as a material for the EI core not only because the iron loss of the EI core in which a magnetic flux flows in the direction perpendicular to the rolling direction is decreased, but also because it is free from an undercoating (glass coating) mainly composed of forsterite ($Mg_2SiO_4$) and is thus excellent in punching processability, as compared with a conventional grain oriented electromagnetic steel sheet.

The reason for the first finding leading to the achievement of the present invention, i.e., the reason why the iron loss in the direction perpendicular to the rolling direction is significantly improved because of removing the formation of the forsterite undercoating by not applying MgO as the annealing separator, is not always made clear. However, the inventors consider the reason as follows.

For the grain oriented electromagnetic steel sheet, it is well known that the crystal orientation of secondary recrystallized grains is integrated in the Goss orientation, that 180° magnetic domains comprising a region of 0.1 to 1.0 mm in width and having magnetization components in the rolling direction and the reverse direction are formed, and that a magnetization process is performed by movement of the boundaries of these magnetic domains.

However, it is well known that the iron loss in the rolling direction is decreased by applying tension to the surface of the steel sheet in the rolling direction. In order to apply the tension, tensile coating mainly composed of phosphate or the like, which is vitrified at high temperature, is generally performed in the method of producing the grain oriented electromagnetic steel sheet. Also, MgO generally applied as the annealing separator reacts, at high temperature, with $SiO_2$ formed in decarburization annealing and final annealing to form forsterite ($Mg_2SiO_4$) undercoating on the surface of the steel sheet, and functions to secure adhesion to the tensile coating. It is also well known that the forsterite undercoating has tensile force. As a result of evaluation of the tensile force by measuring the amount of curvature of the steel sheet, the tensile force is estimated at about 3 to 5 MPa.

However, in this case, the 180° magnetic domains have only the magnetization component in the rolling direction, and magnetization in the direction perpendicular to the rolling direction cannot be made by domain wall motion of the 180° magnetic domains. When tensile force is applied to the surface of the steel sheet by the tensile coating and the forsterite undercoating, the 180° domain structure is stabilized, and consequently magnetization in the direction perpendicular to the rolling direction is inhibited, possibly deteriorating the iron loss in the direction perpendicular to the rolling direction.

Therefore, by removing the forsterite undercoating, the 180° domain structure is instabilized to promote magnetization in the direction perpendicular to the rolling direction, thereby possibly improving the iron loss in the direction perpendicular to the rolling direction.

Next, the reason why the iron loss is decreased by keeping down the ultimate temperature of final annealing to 975° C. or lower to leave the fine crystal grains is not made clear. However, the inventors consider the reason as follows.

Namely, as described above in the first embodiment, the presence of the fine crystal grains in the secondary recrystallized grains possibly causes subdivision of the magnetic domains to decrease an eddy current loss. The conventional technique using the inhibitor can achieve a low iron loss only when the inhibitor components (S, Se, N and the like) are purified by annealing at a high temperature of about 1000° C. or higher. However, the method of present invention not using the inhibitor can achieve a low iron loss by completing secondary recrystallization without purification, and thus the method of keeping down the ultimate temperature of final annealing to 975° C. or lower to leave a desired amount of fine grains possibly effectively functions.

The possible reason why the magnetic flux density in the direction perpendicular to the rolling direction is improved by coarsening the grains before final cold rolling is that as the grains before cold rolling coarsen, the {111} structure as the primary recrystallized aggregate structure decreases, and {100} to {411} components increase instead of the {111} structure to mix the secondary recrystallized grains having {100}<011> orientation.

Finally, in the present invention, the reason why secondary recrystallization is developed in steel not containing the inhibitor components is considered as described above in the first embodiment of the present invention with reference to FIG. 7.

(Second Embodiment—Limitation and Preferred Range)

Next, the reasons for limiting the features of the second embodiment will be described.

First, the grain oriented electromagnetic steel sheet of the second embodiment of the present invention must contain as a component, by % by mass, 1.0 to 8.0% of, preferably 2.0 to 8.0% of, Si.

Like in the first embodiment, this is because with a Si content of less than 1.0%, the sufficient effect of improving the iron loss cannot be obtained, while with a Si content of over 8.0%, processability deteriorates. In order to obtain the excellent effect of improving the iron loss, the Si content is preferably in the range of 2.0% to 8.0%.

For the same reason as the steel sheet of the first embodiment, in order to decrease the iron loss, the secondary recrystallized grains must contain fine crystal grains having a grain diameter of 0.15 mm to 0.50 mm at a rate of 2 grains/$cm^2$ or more, preferably 50 grains/$cm^2$ or more. From the viewpoint of an improvement of anisotropy of the iron loss, the fine grains are present at a rate of 3 grains/$cm^2$ or more, preferably 10 grains/$cm^2$ or more. For the same reason as the first embodiment, the upper limit of the existence rate of the fine crystal grains is preferably about 1000 grains/$cm^2$.

In order to secure the superiority in the iron loss value of the steel sheet of the present invention to an existing non-oriented electromagnetic steel sheet when the steel sheet is used for the EI core, the iron loss ($W_{L15/50}$) value of the steel sheet of the present invention in the rolling direction is 1.40 W/kg or less, the iron loss ($W_{C15/50}$) of the steel sheet in the direction perpendicular to the rolling direction is 2.6 times or less as large as the iron loss ($W_{L15/50}$) in the rolling direction.

In order to secure good punching quality, a major premise is that the undercoating mainly composed of forsterite ($Mg_2SiO_4$) is not formed on the surface of the steel sheet.

Next, the limitations of the components of the raw material slab for producing the electromagnetic steel sheet of the present invention will be described. The reasons for the limitations including the preferred ranges are the same as the first embodiment. In the composition below, "%" is "% by mass".

C: 0.08% or less, preferably 0.006% or less

Mn: 0.005 to 3.0%, preferably 0.05% or less

Si: 1.0 to 8.0%, preferably 2.0 to 8.0%

Al: 0.020% or less, preferably less than 150 ppm, more preferably 100 ppm or less N: 50 ppm or less, preferably 30 ppm or less Inhibitor forming elements (S, Se, and the like): B is 10 ppm or less, and other elements are 50 ppm or less, preferably 30 ppm or less.

Nitride forming elements (Ti, Nb, Ta, V and the like): It is effective to decrease to 50 ppm or less.

O: 50 ppm or less, preferably 30 ppm or less

Elements other than the essential components and the inhibited components, which can be appropriately added (singly or in a mixture) include the following: Ni: 0.005 to 1.50%, preferably 0.01% or more, Sn: 0.01 to 1.50%, Sb: 0.005 to 0.50%, Cu: 0.01 to 1.50%, P: 0.005 to 0.50%, Mo: 0.005 to 0.50%, Cr: 0.01 to 1.5%, etc.

The balance except the above contained elements is preferably composed of Fe and inevitable impurities. The influence of the composition on the grain oriented electromagnetic steel sheet (product) composition is as described above in the first embodiment.

The production method of the present invention will be described.

A slab is produced from molten steel prepared to the above preferable composition by the conventional ingot making method or continuous casting method. A thin cast slab having a thickness of 100 mm or less may be produced directly by a direct casting method.

The slab is hot-rolled by a usual heating method, but may be hot-rolled immediately after casting without heating. The thin cast slab may be hot-rolled or transferred to a subsequent step without hot rolling.

The preferred range of slab heating temperatures (rolling start temperatures in the case of rolling without heating after casting) is the same as the first embodiment of the present invention.

Then, hot-rolled sheet annealing is performed according to demand. The temperature of hot-rolled sheet annealing is advantageously 800° C. or higher which accelerates recrystallization. However, in order to improve the magnetic flux density in the direction perpendicular to the rolling direction, it is effective that the grain diameter before final cold rolling (the one cold rolling or final cold rolling of a plurality of times of cold rolling) is 150 μm or more for obtaining $B_{C50} \geqq 1.70$ T exceeding the level of an existing non-oriented electromagnetic steel sheet. In order to set the grain diameter before final cold rolling to 150 μm or more, the temperature of annealing (hot-rolled sheet annealing or intermediate annealing) immediately before final cold rolling is preferably 1050° C. or higher.

After hot-rolled sheet annealing, cold rolling is preformed to obtain a final thickness. In this step, cold rolling may be performed by one step or two or more steps with intermediate annealing performed therebetween to obtain the final thickness.

During cold rolling, in order to develop the Goss orientation, it is effective both to increase the rolling temperature to 100 to 250° C., and to perform aging once or several times in the temperature range of 100 to 250° C. in the course of cold rolling.

Then, recrystallization annealing is performed to decrease the C content to 60 ppm or less, which causes no magnetic aging, preferably 50 ppm or less, and more preferably 30 ppm or less.

In recrystallization annealing (primary recrystallization annealing) after final cold rolling, the grain diameter after recrystallization annealing must be controlled in the range of 30 to 80 μm. This is because with a grain diameter of less than 30 μm after recrystallization annealing, secondary recrystallized grains with a low degree of orientation integration are produced to deteriorate the iron losses both in the rolling direction and the direction perpendicular to the rolling direction. On the other hand, with a grain diameter of over 80 μm after recrystallization annealing, secondary recrystallization does not occur to significantly deteriorate both the iron loss and the magnetic flux density. As an economical method for controlling the grain diameter after recrystallization annealing to 30 to 80 μm, it is recommended that recrystallization annealing is performed by soaking in the temperature range of 850 to 975° C. for a short time (60 to 360 seconds at 850° C., and about 5 to 10 seconds at 975° C. depending upon the annealing temperature). In the case of annealing at a lower temperature, annealing must be performed for a relatively long time (for example, about 10 to 3600 minutes at 800° C.).

The preferred atmosphere for recrystallization annealing is the same as the first embodiment.

Also, a technique for increasing the Si amount by a siliconizing method may be employed after final cold rolling or recrystallization annealing.

Then, the annealing separator is applied according to demand, paying attention to the same points as the first embodiment.

Then, final annealing is performed to develop secondary recrystallized structure. In order to develop secondary recrystallization, final annealing is preferably performed at 800° C. or higher. On the other hand, the maximum ultimate temperature is 975° C. or lower in order to obtain a stable state in which fine crystal grains having a grain diameter of 0.15 mm to 0.50 mm are scattered at a predetermined rate in secondary recrystallized grains resulting a stable improvement in iron loss in the direction perpendicular to the rolling direction.

The preferable conditions of the atmosphere and the heating rate of final annealing are the same as the first embodiment.

When steel sheets are laminated, it is effective to perform insulation coating on the surface of each steel sheet in order to improve the iron loss. The preferable coating and coating method are the same as the first embodiment.

(Third Embodiment—Operation)

A third embodiment (aspect) of the present invention is described. First, experiment resulting in the success of the third embodiment is described (Experiment 3-1).

A steel slab having a composition free from inhibitor components and containing, by % by mass, 0.0025% of C, 3.5% of Si, 0.04% of Mn, Al and N decreased to 50 ppm and 10 ppm, respectively, and other components reduced to 30 ppm or less was produced by continuous casting. Then, the steel slab was heated to 1250° C., and then hot-rolled to form a hot-rolled sheet of 1.6 mm in thickness. The hot-rolled sheet was soaked at 850° C. for 60 seconds in a nitrogen atmosphere, and then rapidly cooled. Then, after a final thickness of 0.20 mm was obtained by cold rolling, recrystallization annealing was performed by soaking at 920° C. for 10 seconds in an atmosphere containing 50 vol % of hydrogen and 50 vol % of nitrogen and having a dew point of −30° C.

Then, a sample to which the annealing separator was not applied, and a sample to which a slurry mixture containing MgO and water was applied as the annealing separator were formed, and these samples was subjected to final annealing. In the final annealing, the temperature was increased from room temperature to 850° C. at a rate of 50° C./h in a nitrogen atmosphere having a dew point of −20° C., kept at this temperature for 50 hours, and then further increased to various temperatures at a rate of 25° C./h.

Figure 15:
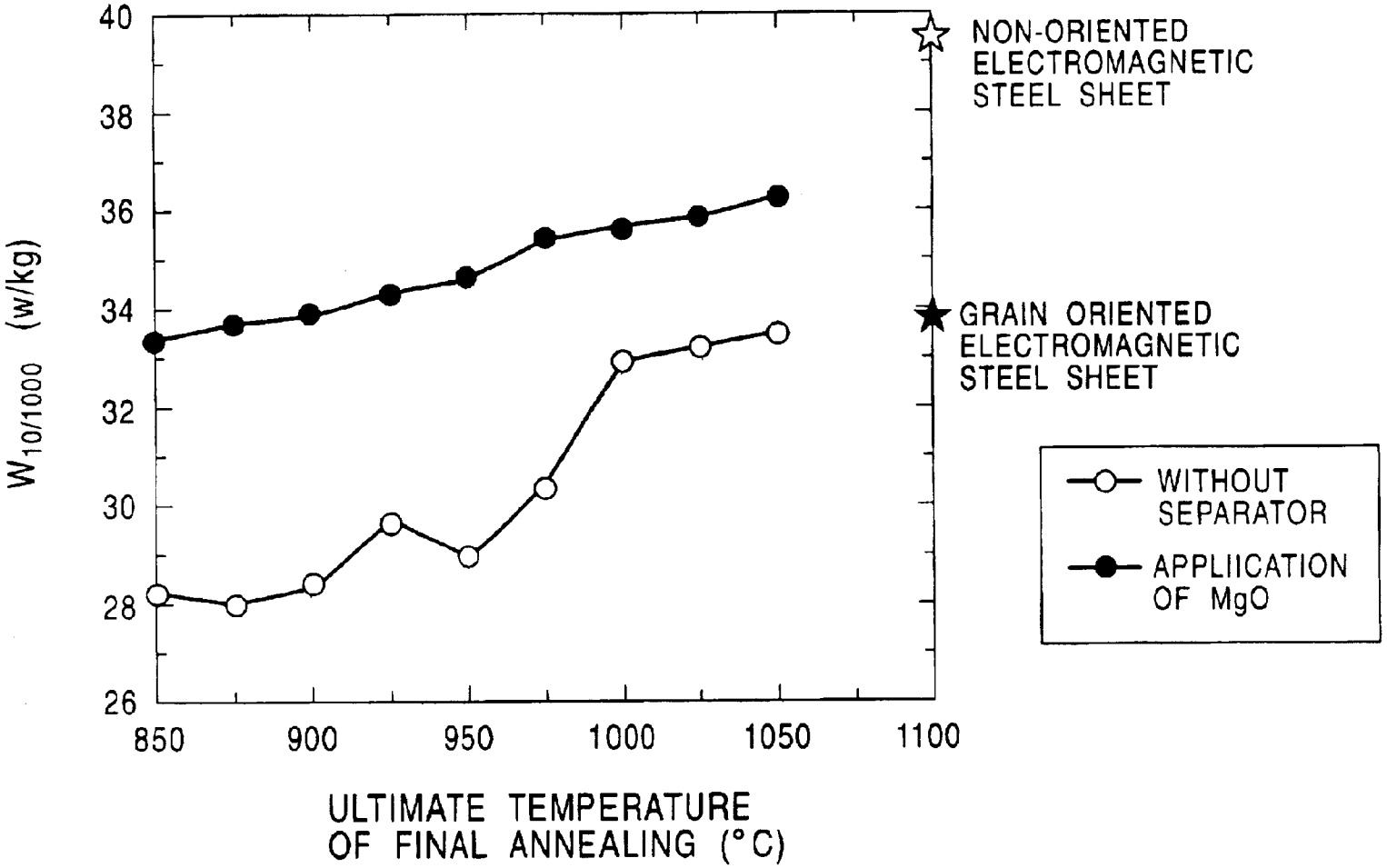
FIG. 15 is a graph showing the relationship between the ultimate temperature of final annealing, the presence of an annealing separator and the high-frequency iron loss ($W_{10/1000}$) of a grain oriented electromagnetic steel sheet.

The thus-obtained sheet products (Al decreased to 30 ppm, N decreased to about 20 ppm, and other components, being the same as or decreased to lower than the levels of the slab components) were examined with respect to the iron loss $W_{10/1000}$ (the iron loss by excitation to 1.0 T at a frequency of 1000 Hz). FIG. 15 shows the relationship between the measured iron loss and the ultimate temperature of final finish annealing.

For comparison, FIG. 15 also shows the results of measurement of the iron losses ($W_{10/1000}$) of a commercial grain oriented electromagnetic steel sheet and a non-oriented electromagnetic steel sheet. Although the ultimate temperatures of final annealing of the commercial grain oriented electromagnetic steel sheet and the non-oriented electromagnetic steel sheet are not known, the ultimate temperatures are shown on the right ordinate of the figure.

The figure indicates that in the sample to which the annealing separator was not applied, a good iron loss is obtained when the ultimate temperature of final annealing is in the range of 850 to 950° C., and the iron loss deteriorates when the ultimate temperature exceeds 1000° C.

On the other hand, in the sample to which MgO was applied as the annealing separator, the iron loss at 1000 Hz is inferior to the sample to which the annealing separator was not applied, regardless of the ultimate temperature of final annealing, and the iron loss is equivalent to the commercial grain oriented electromagnetic steel sheet at the best.

Next, in order to elucidate the reason why the good iron loss at high frequency is obtained when the annealing separator is not applied, the sample to which the annealing separator was not applied and the sample to which MgO was applied as the annealing separator, both samples exhibiting the ultimate temperature of final annealing of 850° C. in the above experiment, and the commercial grain oriented electromagnetic steel sheet were measured with respect to the iron loss $W_{17/50}$ at commercial frequency and the iron loss $W_{10/1000}$ at high frequency after the surface oxide coating of each sample was removed by chemical polishing with hydrofluoric acid, and the surface of each sample was smoothed. Comparison of the results is shown in FIGS. 16(*a*) and (*b*).

As shown in the figures, in the sample to which the annealing separator was applied, the iron loss at a high frequency of 1000 Hz is significantly improved by removing the surface oxide coating and smoothing the surface, obtaining a good value close to that of the sample to which the annealing separator was not applied. In the grain oriented electromagnetic steel sheet, the iron loss at high frequency is slightly improved by removing the surface oxide coating.

However, in the sample to which the annealing separator was applied, the iron loss at high frequency is substantially the same before and after removal of the surface oxide coating.

Figure 16:
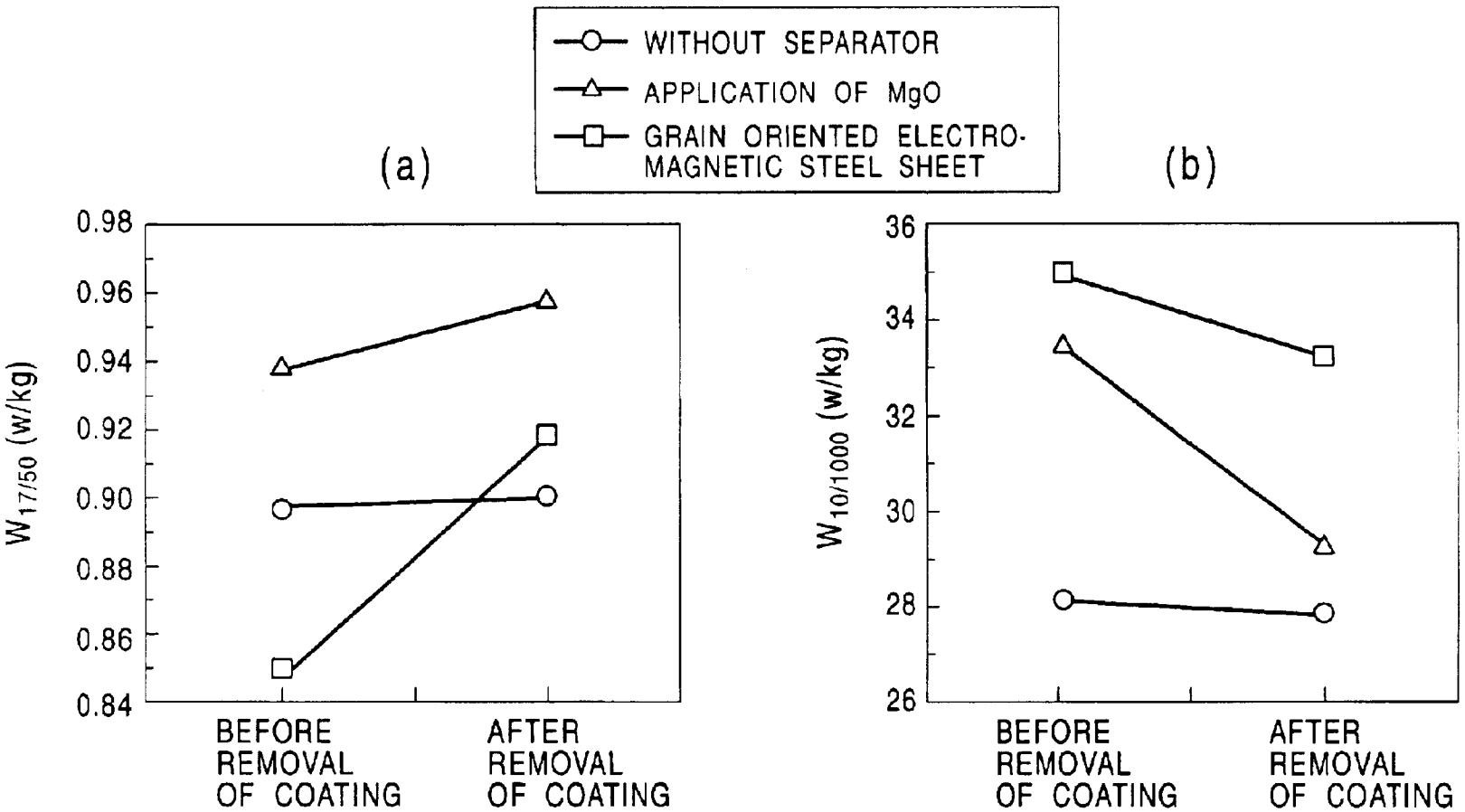
FIG. 16 is a graph showing changes in the iron loss before and after removal of a surface oxide coating of each of the experimental materials shown in FIG. 15.

The results shown in FIG. 16 suggest that the iron loss at high frequency is significantly deteriorated by the oxide coating formed on the surface of the steel sheet. Also, a comparison of the iron losses after removal of the oxide coating shows that the iron losses of the samples of this experiment are superior to that of the commercial grain oriented electromagnetic steel sheet.

In this experiment, the surfaces of the samples were finished to mirror surfaces by electropolishing, and thus it was found that an iron loss improving factor other than the surface state is present.

Therefore, in order to find the factor, the sample to which the annealing separator was not applied, and which exhibited a good iron loss at high frequency was examined with respect to its crystal structure.

Figure 17:
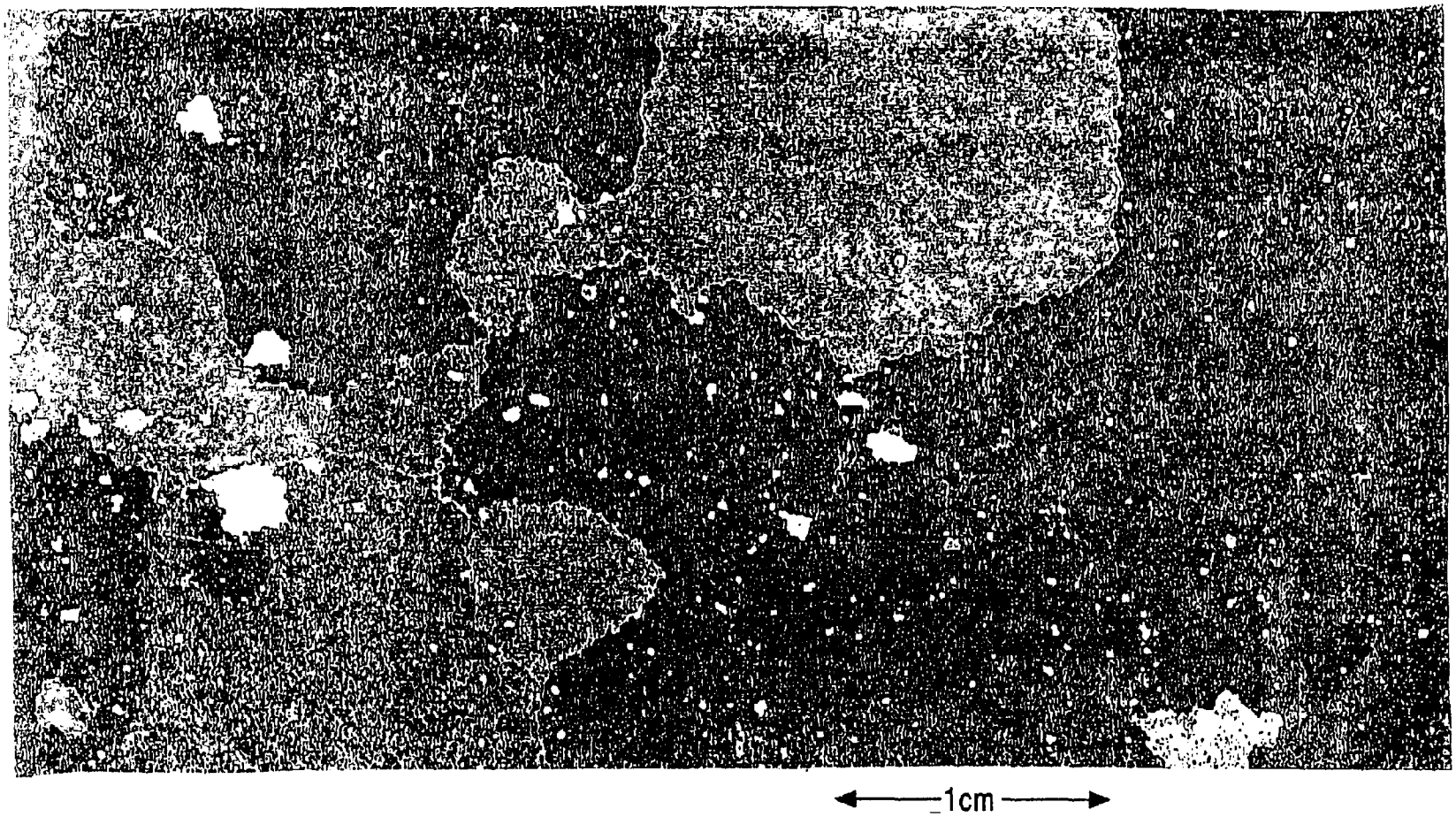
FIG. 17 is a graph showing the photofinishing structure of a grain oriented electromagnetic steel sheet (the experimental material shown in FIG. 15) after final annealing.

FIG. 17 shows the result of examination of the crystal structure after retention at 850° C.

This figure indicates that fine crystal grains having a grain diameter of about 0.15 to 1.00 mm are scattered in secondary recrystallized coarse grains of as large as several cm.

It is also found that the existence rate of the fine crystal grains having a grain diameter in the range of about 0.15 to 1.00 mm has a strong correlation with the iron loss at high frequency.

Figure 18:
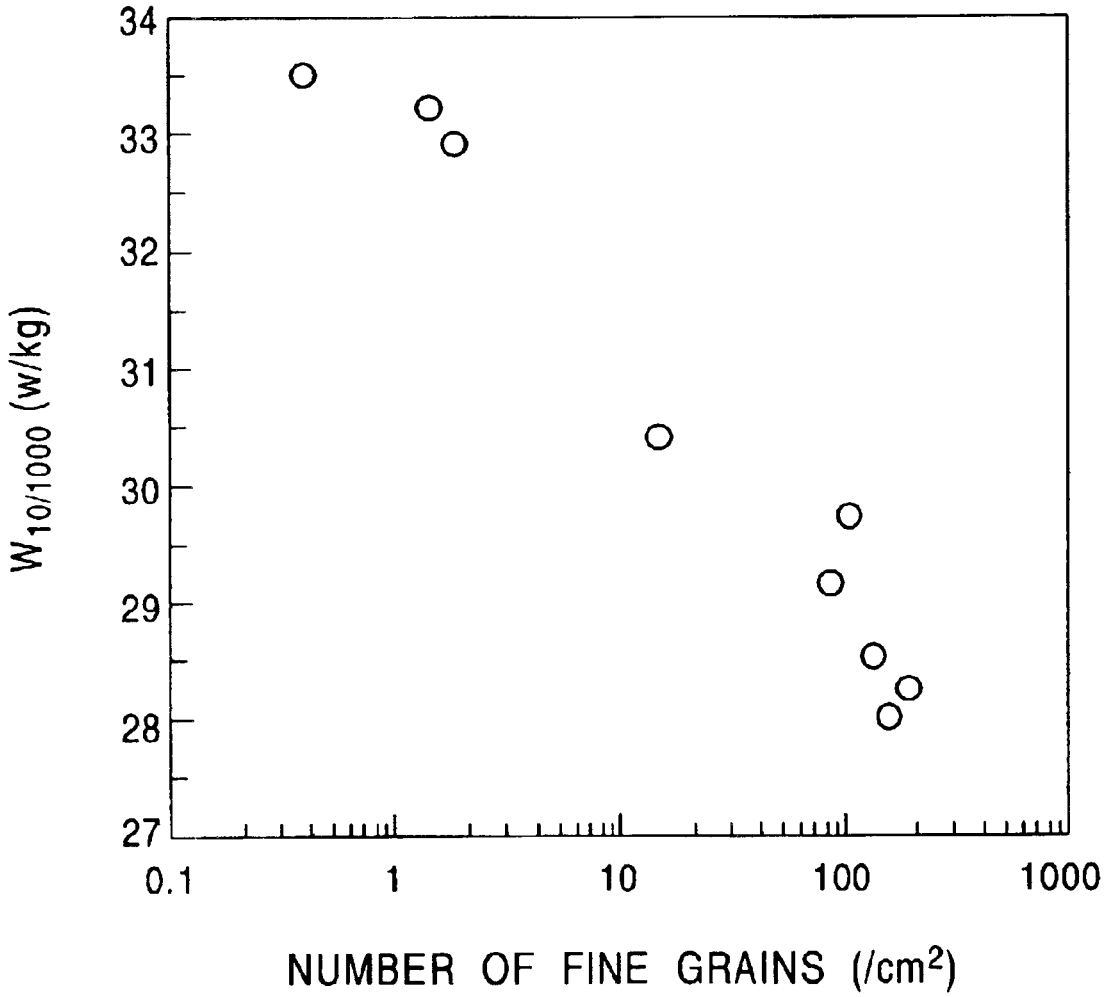
FIG. 18 is a graph showing the relationship between the number of fine grains in the secondary recrystallized grains and the high-frequency iron loss ($W_{10/1000}$) of the experimental material shown in FIG. 15.

FIG. 18 shows the results of examination of the relationship between the existence rate of fine grains and the high-frequency iron loss ($W_{10/1000}$). The existence rate of fine grains was determined by measuring the number of fine crystal grains having a grain diameter (corresponding to a circle) of 0.15 to 1.00 mm in a 3-cm square region of the surface of the steel sheet.

As shown in the figure, it is newly recognized that the high-frequency iron loss ($W_{10/1000}$) is significantly improved as the existence rate of fine crystal grains in the secondary recrystallized grains increases to, particularly, 10 grains/cm$^2$ or more.

When the ultimate temperature of final annealing is 975° C. or lower, the fine crystal grains having a grain diameter of 0.15 mm to 0.50 mm are present in the secondary recrystallized grains at a rate of 2 grains/cm$^2$ or more (because the final annealing temperature is lower than 1000° C.). However, in the third embodiment, the grain diameter of 0.15 mm to 1.00 mm is used as an index because the existence rate of the fine crystal grains having the grain diameter of 0.15 mm to 1.00 mm is thought to have a good correlation with the property concerned.

Next, in order to obtain knowledge about proper control of the production conditions for improving the high-frequency iron loss, the relationship between the high-frequency iron loss and the area ratio of Goss orientation grains, and the influence of the crystal grain diameter before cold rolling on the area ratio of Goss orientation grains were examined (Experiment 3-2).

The crystal grain diameter before cold rolling was changed to various values by changing the hot-rolled sheet annealing conditions. The area ratio of Goss orientation grains represents the existence rate of crystal grains with a shift angle of 20° or less from Goss orientation.

Namely, a steel slab having a composition free from inhibitor components and containing, by % by mass, 0.003% of C, 3.4% of Si, 0.06% of Mn, Al and N decreased to 50 ppm and 22 ppm, respectively, and other components reduced to 30 ppm or less was produced by continuous casting. Then, the steel slab was heated to 1200° C., and then hot-rolled to form a hot-rolled sheet of 1.6 mm in thickness. The hot-rolled sheet was annealed at various temperatures for various soaking times in a nitrogen atmosphere, and then rapidly cooled. Then, the grain diameter was measured before final cold rolling, and then cold rolling was performed to obtain a final thickness of 0.20 mm.

Then, recrystallization annealing was performed by soaking at 930° C. for 15 seconds in an atmosphere containing 50 vol % of hydrogen and 50 vol % of nitrogen and having a dew point of −50° C., and final annealing was performed without the annealing separator being applied. In the final annealing, the temperature was increased from room temperature to 875° C. at a rate of 50° C./h in a nitrogen atmosphere having a dew point of −20° C., and kept at this temperature for 50 hours.

The thus-obtained product sheets (Al decreased to 30 ppm, N decreased to about 25 ppm, and the other components being the same as or decreased to lower than the levels of the slab) were measured with respect to the area ratio of Goss orientation and the high-frequency iron loss ($W_{10/1000}$).

In any of experimental materials, the secondary recrystallized grains contained fine crystal grains having a grain diameter of 0.15 mm to 0.50 mm at a rate of 2 grains/cm$^2$ or more, and fine crystal grains having a grain diameter of 0.15 mm to 1.00 mm at a rate of 10 grains/cm$^2$ or more.

Figure 19:
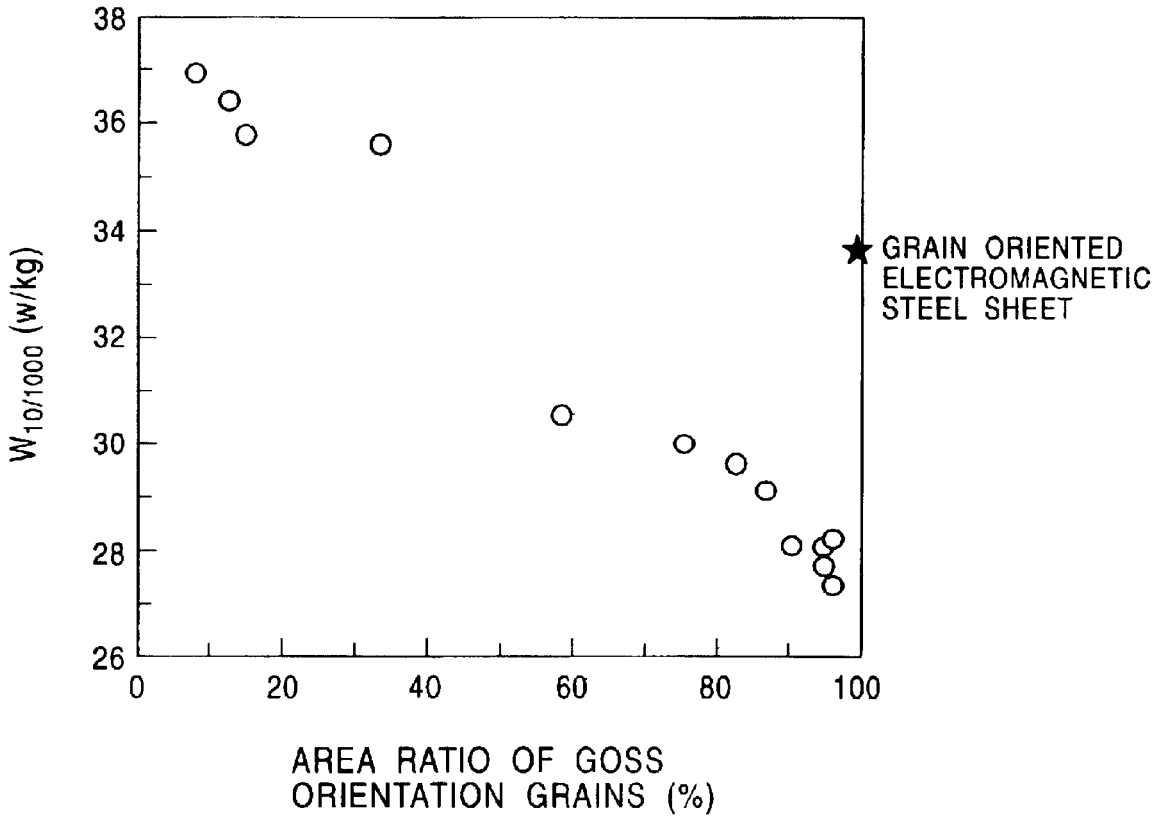
FIG. 19 is a graph showing the relationship between the high-frequency iron loss ($W_{10/1000}$) and the area ratio of Goss orientation grains of a grain oriented electromagnetic steel sheet.

FIG. 19 shows the relationship between the high-frequency iron loss ($W_{10/1000}$) and the area ratio of Goss orientation grains.

As shown in this figure, a high-frequency iron loss superior to the commercial grain oriented electromagnetic steel sheet is obtained when the area ratio of Goss orientation grains is 50% or more.

Figure 20:
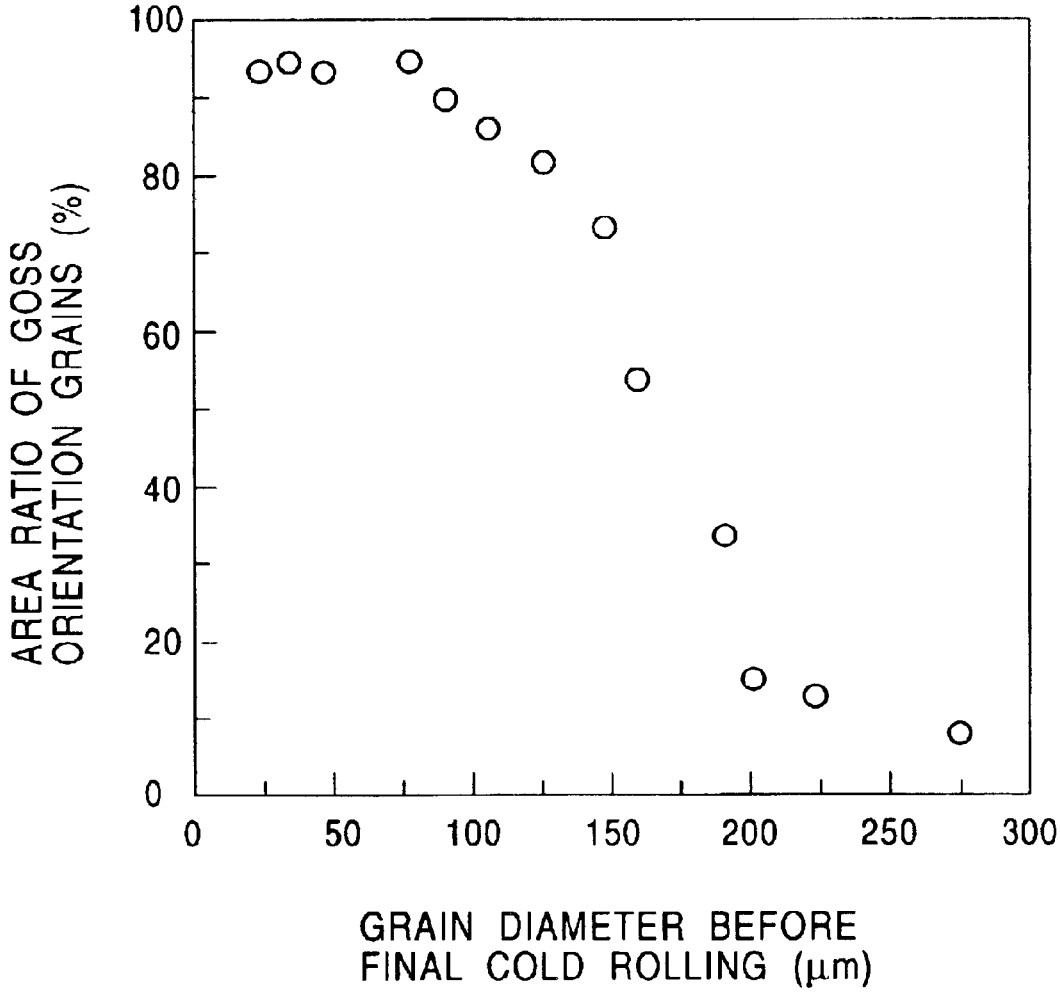
FIG. 20 is a graph showing the relationship between the grain diameter before final cold rolling and the area ratio of Goss orientation grains of the experimental material shown in FIG. 19.

FIG. 20 shows the relationship between the grain diameter before cold rolling and the area ratio of Goss orientation grains. As shown in this figure, an area ratio of Goss orientation grains of 50% or more is secured when the grain diameter before cold rolling is less than 150 $\mu$m.

As a result, it is found that as a preferred production condition for obtaining a good high-frequency iron loss, the grain diameter before final cold rolling must be less than 150 $\mu$m.

When the above experimental results are summarized, it is found that by using a high-purity raw material not containing the inhibitor, suppressing the formation of a forsterite undercoating in final annealing to form a smooth surface, and keeping down the ultimate temperature of final annealing to 975° C. or lower to leave fine crystal grains in secondary recrystallized grains, the high-frequency iron loss is significantly improved, as compared with a conventional grain oriented electromagnetic steel sheet.

It is also found that in order to secure an area ratio of Goss orientation grains of 50% or more to obtain a good high-frequency iron loss, it is effective to set a grain diameter before final cold rolling to less than 150 μm.

Although the reason for the first finding leading to the success of the present invention, i.e., the reason why the high-frequency iron loss is improved by avoiding applying the annealing separator or by not using MgO as the annealing separator to remove the formation of the forsterite undercoating, is not always known, the inventors consider the reason as follows.

MgO generally used as the annealing separator reacts at high temperature with $SiO_2$ formed in decarburization annealing and final annealing to form the forsterite ($Mg_2SiO_4$) undercoating on the surface of the steel sheet, and functions to secure adhesion to tensile coating mainly composed of a phosphate or the like. The interface between the forsterite undercoating and the base metal is a portion generally referred to as an "anchor portion" in which an oxide is mixed with the base metal in a complicated form. This complicated structure is effective for securing adhesion to the tensile coating mainly composed of a phosphate or the like, but significantly deteriorates smoothness of the base metal surface.

Magnetization in a high-frequency region produces a skin effect in which magnetization on the surface preferentially occurs, as compared with magnetization at the commercial frequency. It is thus presumed that the high-frequency iron loss is good with a highly smooth surface free from the forsterite undercoating.

Next, the reason why the iron loss is decreased by keeping down the ultimate temperature of final annealing to 975° C. or lower to leave fine crystal grains is not always known, but the inventors consider the reason as follows.

As described above in the first and second embodiments, the presence of fine crystal grains in secondary recrystallized grains possibly causes subdivision of magnetic domains to decrease the eddy current loss. The conventional technique using the inhibitor can achieve a low iron loss only when the inhibitor components (S, Se, N and the like) are purified by annealing at high temperature of about 1000° C. or higher. However, the method of the present invention not using the inhibitor can achieve a low iron loss only by completing secondary recrystallization without purification, and thus the method of keeping down the ultimate temperature of finish annealing to leave a desired amount of fine grains which pass through the sheet in the thickness direction is possibly effectively functions.

The conceivable reason why the area ratio of Goss orientation grains is increased to improve the high-frequency iron loss by suppressing coarsening of the grains before final cold rolling is that the degree of accumulation of {111} structure in the primary recrystallized texture is increased by keeping the grains fine before cold rolling, forming the primary recrystallized texture useful for growth of Goss orientation recrystallized grains.

The reason why secondary recrystallization is developed in steel not containing the inhibitor components in the present invention is considered as described above in the first embodiment with reference to FIG. 7.

(Third Embodiment—Limitation and Preferred Range)

The reasons for limiting the features of the third embodiment of the present invention will be described.

First, the electromagnetic steel sheet of the present invention must contain as a component, by % by mass, 1.0 to 8.0% of, preferably 2.0 to 8.0% of, Si.

Like in the first embodiment, this is because with a Si content of less than 1.0%, the sufficient effect of improving the iron loss cannot be obtained, while with a Si content of over 8.0%, processability deteriorates. In order to obtain the excellent effect of improving the iron loss, the Si content is preferably in the range of 2.0% to 8.0%.

Furthermore, it is necessary that the grain diameter of the secondary recrystallized grains on the surface of the steel sheet, which is measured except fine grains having a grain diameter of 1 mm or less, is 5 mm or more. This is because when the secondary recrystallized grains have a grain diameter of less than 5 mm, the area ratio of Goss orientation grains is decreased to fail to obtain a good high-frequency iron loss. In order to set the grain diameter of the secondary recrystallized grains to 5 mm or more, it is preferable to sufficiently decrease impurity elements, obtain a grain diameter of 30 to 80 μm after recrystallization annealing, and stay the grains in the temperature region of 800° C. or higher for 30 hours or more during final annealing. By satisfying these conditions, the secondary recrystallized grains can be sufficiently developed to achieve an average grain diameter of 5 mm or more.

Furthermore, in the steel sheet of the present invention, in order to decrease the high-frequency iron loss, the secondary recrystallized grains must contain fine crystal grains having a grain diameter of 0.15 mm or 1.0 mm at a rate of 10 grains/$cm^2$ or more.

Under the production conditions for obtaining the above fine grain distribution, it is possible to achieve the state in which the secondary recrystallized grains contain fine crystal grains having a grain diameter of 0.15 mm to 0.50 mm at a rate of 2 grains/$cm^2$ or more, preferably 50 grains/$cm^2$ or more. This is effective for decreasing the iron loss for the same reason as the steel sheet of the first embodiment. The upper limit of the existence rate of the fine grains (grain diameter of 0.15 mm to 0.50 mm) is preferably about 1000 grains/$cm^2$ for the same reason as the first embodiment.

The upper limit of the existence rate of fine grains having a grain diameter of 0.15 mm to 1.00 mm is preferably about 500 grains/$cm^2$.

With the fine grains having a grain diameter of less than 0.15 mm or over 1.00 mm, the effect of subdividing the magnetic domains is small, causing no contribution to a decrease in the iron loss. Therefore, the existence rate of fine crystal grains having a grain diameter in the range of 0.15 to 1.00 mm is taken into consideration. However, when the existence rate of the fine crystal grains is less than 10 grains/$cm^2$, the effect of subdividing the magnetic domains is decreased to fail to expect a sufficient improvement in the high-frequency iron loss.

In order to obtain a good high-frequency iron loss, it is also an essential condition that the area ratio of grains with an orientation shift angle of 20° or less from {110}<001> orientation, i.e., the area ratio of Goss orientation grains, is 50% or more, preferably 80% or more.

This is because when the area ratio of Goss orientation grains is less than 50%, the high-frequency iron loss is equivalent to an existing grain oriented electromagnetic steel sheet to lose the advantage of the electromagnetic steel sheet of the present invention.

Furthermore, a main premise is that the undercoating mainly compose of forsterite ($Mg_2SiO_4$) is not formed on the surface of the steel sheet in order to form a magnetically smooth plane and secure a good high-frequency iron loss.

Next, the limitations of the components of the raw material slab for producing the electromagnetic steel sheet of the present invention will be described. The reasons for the limitations including the preferred ranges are the same as the first embodiment. In the composition below, "%" is "% by mass".

C: 0.08% or less, preferably 0.006% or less

In the third embodiment, the surface smoothness of the product is very important, and thus C is more preferably 50 ppm or less.

Mn: 0.005 to 3.0%, preferably 0.50% or less

Si: 1.0 to 8.0%, preferably 2.0 to 8.0%

Al: 0.020% or less, preferably less than 150 ppm, more preferably 100 ppm or less N: 50 ppm or less, preferably 30 ppm or less Inhibitor components (S, Se, and the like): B is 10 ppm or less, and the other components are 50 ppm or less, preferably 30 ppm or less.

Nitride forming elements (Ti, Nb, Ta, V and the like): An amount of 50 ppm or less is effective.

O: 50 ppm or less, preferably 30 ppm or less

Elements other than the above necessary components and the inhibited components, which can be appropriately added (singly or in a mixture) include the following:

Ni: 0.005 to 1.50%, preferably 0.01% or more, Sn: 0.01 to 1.50%, Sb: 0.005 to 0.50%, Cu: 0.01 to 1.50%, P: 0.005 to 0.50%, Mo: 0.005 to 0.50%, Cr: 0.01 to 1.5%, etc.

These elements exhibit the effect of improving not only the iron loss at a usual frequency but also the iron loss at a high frequency in the above preferred ranges.

The balance except the above contained elements is preferably composed of Fe and inevitable impurities. The influence of the composition on the grain oriented electromagnetic steel sheet (product) composition is as described above in the first embodiment.

The production method of the present invention will be described.

A slab is produced from molten steel prepared to the above preferable composition by the conventional ingot making method or continuous casting method. A thin cast slab having a thickness of 100 mm or less may be produced directly by a direct casting method.

The slab is hot-rolled by a usual heating method, but may be hot-rolled immediately after casting without heating. The thin cast slab may be hot-rolled or transferred to a subsequent step without hot rolling.

The preferred range of slab heating temperatures (rolling start temperatures in the case of rolling without heating after casting) is the same as the first embodiment of the present invention.

Then, hot-rolled sheet annealing is performed according to demand. The temperature of hot-rolled sheet annealing is favorably 800° C. or higher which accelerates recrystallization. However, in order to improve the high-frequency iron loss by securing an area ratio of 50% or more for crystal grains with an orientation shift of 20° or less from {110}<001> orientation, it is effective that the grain diameter before final cold rolling (the one cold rolling or final cold rolling of a plurality of times of cold rolling) is less than 150 μm, preferably 120 μm or less, for obtaining a high-frequency iron loss superior to the level of an existing grain oriented electromagnetic steel sheet. In order to set the grain diameter before final cold rolling to less than '150 μm, the temperature of annealing (hot-rolled sheet annealing or intermediate annealing) immediately before final cold rolling is preferably 1000° C. or lower.

After hot-rolled sheet annealing, cold rolling is preformed to obtain a final thickness. In this step, cold rolling may be performed by one step, or two or more steps with intermediate annealing performed therebetween to obtain the final thickness.

During cold rolling, in order to develop the Goss orientation, it is effective both to increase the rolling temperature to 100 to 250° C., and to perform aging once or several times in the temperature range of 100 to 250° C. in the course of cold rolling.

Then, recrystallization annealing is performed to decrease the C content to 60 ppm or less, which causes no magnetic aging, preferably 50 ppm or less, and more preferably 30 ppm or less.

In recrystallization annealing (primary recrystallization annealing) after final cold rolling, the grain diameter after recrystallization annealing must be controlled in the range of 30 to 80 μm. This is because with a grain diameter of less than 30 μm after recrystallization, secondary recrystallized grains having an orientation apart from Goss orientation are produced to deteriorate the high-frequency iron loss. On the other hand, with a grain diameter of over 80 μm after recrystallization annealing, secondary recrystallization does not occur to deteriorate the high-frequency iron loss. In order to control the grain diameter after recrystallization annealing to 30 to 80 μm, it is economically advantageous that recrystallization annealing is continuously performed by soaking in the temperature range of 850 to 975° C. for a short time (refer to the description of the second embodiment).

The preferred atmosphere of recrystallization annealing is the same as the first embodiment of the present invention.

Also, a technique for increasing the Si amount by a siliconizing method may be employed after final cold rolling or recrystallization annealing.

Then, the annealing separator is applied according to demand, paying attention to the same points as the first embodiment.

Then, final annealing is performed to develop a secondary recrystallized structure. In order to develop secondary recrystallization, final annealing is preferably performed at 800° C. or higher. On the other hand, the maximum ultimate temperature is 975° C. or lower in order to obtain a state in which fine crystal grains having a grain diameter of 0.15 mm to 1.00 mm are scattered at a desired distribution rate in secondary recrystallized grains, improving the high-frequency iron loss.

The preferable conditions of the atmosphere and the heating rate of final annealing are the same as the first embodiment.

When steel sheets are laminated, it is effective to perform insulation coating on the surface of each steel sheet in order to improve the iron loss. The preferable coating and coating method are the same as the first embodiment.

Although the requirements and the preferred conditions of each of the first to third embodiments of the present invention are described separately, the requirements or the preferred conditions of the first embodiment may be applied to the second or third embodiment (within a range not interdicting with the object). Similarly, the requirements or the preferred conditions of the second embodiment may be freely applied to the first or third embodiment, and the requirements or the preferred conditions of the third embodiment may be freely applied to the first or second embodiment.

EXAMPLES

Example 1—First Embodiment

A steel slab having a composition free from inhibitor components and containing 0.002% of C, 3.4% of Si, 0.07% of Mn, 0.03% of Sb, Al and N decreased to 30 ppm and 9 ppm, respectively, and other components reduced to 50 ppm or less was produced by continuous casting. Then, the steel slab was heated at 1100° C. for 20 minutes, and then hot-rolled to form a hot-rolled sheet of 2.6 mm in thickness. The hot-rolled sheet was annealed by soaking at 800° C. for 60 seconds. Then, cold rolling was performed at 150° C. to obtain a final thickness of 0.30 mm.

Then, recrystallization annealing was performed by soaking at 930° C. for 10 seconds in an atmosphere containing 75 vol % of hydrogen and 25 vol % of nitrogen and having each of the various dew points shown in Table 2. Then, final annealing was performed under a condition in which the temperature was increased to 800° C. at a rate of 50° C./h in a mixed atmosphere (dew point −30° C.) containing 50 vol % of nitrogen and 50 vol % of Ar, further increased from 800° C. to 900° C. at a rate of 10° C./h, and maintained at this temperature for 30 hours. After final annealing, the N amount of steel was 33 ppm and the Al amount was 5 ppm.

Then, the finish annealed sheet was coated with a coating solution made by mixing aluminum bichromate, an emulsion resin and ethylene glycol, and baked at 300° C. to form a product.

An EI core was formed from the thus-obtained product sheet by punching, and measured with respect to its iron loss ($W_{13/50}$)

Also, the existence rate of fine crystal grains having a grain diameter of 0.05 to 0.50 mm in the product sheet was determined by measuring the number of the fine crystal grains in a 3-cm square region on the surface of the steel sheet.

Furthermore, in order to evaluate punching quality, continuous punching into a 17-mm square was carried out by using a 25-ton press (material: SKD-11) and commercial punching oil under conditions of a punching rate of 350 strokes/min and a clearance of 6% of thickness until the burr height reached 50 μm.

The obtained results are shown in Table 2.

TABLE 2

| No. | Dew point of recrystallization annealing atmosphere (° C.) | EI core loss $W_{13/50}$ (W/kg) | Number of fine grains (/cm$^2$) | Number of times of punching (10,000 times) | Remarks |
|---|---|---|---|---|---|
| 1 | −50 | 0.81 | 65.6 | >300 | Example of the invention |
| 2 | −25 | 0.82 | 68.4 | >300 | Example of the invention |
| 3 | 0 | 0.83 | 69.0 | >300 | Example of the invention |
| 4 | 20 | 0.85 | 70.6 | 250 | Example of the invention |
| 5 | 40 | 0.90 | 72.3 | 200 | Example of the invention |
| 6 | 50 | 0.99 | 73.4 | 120 | Comparative example |
| 7 | 60 | 1.03 | 74.0 | 80 | Comparative example |

As shown in Table 2, when the dew point of the recrystallization annealing atmosphere is 40° C. or lower, particularly, 0° C. or lower, a product having both excellent punching quality and iron loss is obtained.

Example 2—First Embodiment

A steel slab having a composition free from inhibitor components and containing 0.003% of C, 3.3% of Si, 0.52% of Mn, 0.08% of Cu, Al and N decreased to 50 ppm and 12 ppm, respectively, and other components reduced to 50 ppm or less was produced by continuous casting. Then, the steel slab was heated at 1200° C. for 20 minutes, and then hot-rolled to form a hot-rolled sheet of 2.2 mm in thickness. Then, the hot-rolled sheet was annealed at 900° C. for 20 seconds, and first cold rolling was performed at room temperature to obtain a thickness of 1.5 mm. After intermediate annealing at 950° C. for 30 seconds, second cold rolling was performed at room temperature under a condition in which aging was performed at 200° C. for 5 hours when the thickness was 0.90 mm in the course of cold rolling, to finish the sheet to a final thickness of 0.27 mm.

Then, recrystallization annealing was performed by soaking at 900° C. for 30 seconds in an atmosphere containing 75 vol % of hydrogen and 25 vol % of nitrogen and having a dew point of −40° C. Then, final annealing was performed under a condition in which the temperature was increased from room temperature to 900° C. at a rate of 30° C./h in each of the atmospheres shown in Table 3, and maintained at this temperature for 50 hours. After final annealing, the Al amount of steel was 30 ppm.

Then, the finish annealed sheet was coated with a coating solution made by mixing aluminum bichromate, an emulsion resin and ethylene glycol, and baked at 300° C. to form a product.

The thus-obtained product sheet was measured with respect to its iron loss ($W_{17/50}$) in an EI core formed from the sheet by punching, the existence rate of fine crystal grains having a grain diameter of 0.15 to 0.50 mm in the product sheet, and the number of times of continuous punching until the burr height reached 50 μm by the same method as Example 1. The obtained results are shown in Table 3.

TABLE 3

| No. | Final finish annealing: Atmosphere (vol %) | Final finish annealing: Dew point (° C.) | N content of steel (ppm) | EI core loss $W_{17/50}$ (W/kg) | Number of fine grains (10,000 times) | Number of times of punching (10,000 times) | Remarks |
|---|---|---|---|---|---|---|---|
| 1 | Nitrogen: 50 Hydrogen: 50 | −30 | 44 | 1.21 | 65.6 | >300 | Example of the invention |
| 2 | Nitrogen: 100 | −30 | 64 | 1.23 | 55.4 | >300 | Example of the invention |
| 3 | Nitrogen: 25 Ar: 75 | −30 | 35 | 1.22 | 65.6 | >300 | Example of the invention |
| 4 | Nitrogen: 10 Hydrogen: 90 | −30 | 16 | 1.20 | 76.0 | 270 | Example of the invention |
| 5 | Nitrogen: 100 | 0 | 69 | 1.36 | 59.2 | 220 | Example of the invention |
| 6 | Nitrogen: 100 | 50 | 75 | 1.50 | 61.9 | 150 | Comparative example |
| 7 | Hydrogen:100 | −10 | 6 | 1.56 | 89.2 | 120 | Comparative example |

As shown in Table 3, when the dew point of the atmosphere is 40° C. or lower, and the N amount of steel is 10 ppm or more, a product having both excellent punching quality and iron loss is obtained.

Example 3—First Embodiment

A steel slab having each of the compositions shown in Table 4 was heated to 1160° C., and then hot-rolled to form a hot-rolled sheet of 3.2 mm in thickness. All components other than those shown in Table 4 were decreased to 50 ppm or less, and the inhibitor components were not contained.

Then, the hot-rolled sheet was annealed by soaking at 1000° C. for 60 seconds, and then finished to a final thickness of 0.50 mm by cold rolling. Then, recrystallization annealing was performed by soaking at 980° C. for 20 seconds in an atmosphere containing 75 vol % of hydrogen and 25 vol % of nitrogen and having a dew point of −35° C. Then, final annealing was performed under a condition in which the temperature was increased to 850° C. at a rate of 10° C./h, and maintained at this temperature for 75 hours in a nitrogen atmosphere having a dew point of −40° C. In the examples of the present invention, the Al amount of steel after final annealing was 5 to 40 ppm.

Then, the finish annealed sheet was coated with a coating solution made by mixing aluminum bichromate, an acrylic emulsion resin and boric acid, and baked at 300° C. to form a product.

The thus-obtained product sheet was measured with respect to its iron loss ($W_{15/50}$) in an EI core formed from the sheet by punching, the existence rate of fine crystal grains having a grain diameter of 0.15 to 0.50 mm in the product sheet, and the number of times of continuous punching until the burr height reached 50 μm by the same method as Example 1. The obtained results are shown in Table 4.

TABLE 4

| No. | Chemical composition (mass %, ppm): C | Si | Mn | Ni | Sn | Sb | Cu | P | Cr | Mo | Al | N | EI core $W_{15/50}$ (W/kg) | Number of fine grains (/cm²) | N content of steel (ppm) | Number of times of punching (10,000 times) | Remarks |
|---|---|---|---|---|---|---|---|---|---|---|---|---|---|---|---|---|---|
| 1 | 23 | 3.44 | 0.13 | tr | tr | tr | tr | tr | tr | tr | 15 | 15 | 1.55 | 94.5 | 55 | >300 | Example of the invention |
| 2 | 33 | 3.62 | 0.15 | 0.25 | tr | tr | tr | tr | tr | tr | 37 | 23 | 1.50 | 86.7 | 60 | >300 | Example of the invention |
| 3 | 24 | 3.47 | 0.25 | tr | 0.10 | tr | tr | tr | tr | tr | 30 | 9 | 1.47 | 100.3 | 41 | >300 | Example of the invention |
| 4 | 30 | 3.35 | 0.15 | tr | tr | 0.04 | tr | tr | tr | tr | 55 | 12 | 1.47 | 50.3 | 33 | >300 | Example of the invention |
| 5 | 35 | 3.52 | 0.03 | tr | tr | tr | 0.10 | tr | tr | tr | 10 | 6 | 1.49 | 56.9 | 43 | >300 | Example of the invention |
| 6 | 36 | 3.45 | 0.10 | tr | tr | tr | tr | 0.05 | tr | tr | 32 | 15 | 1.55 | 90.5 | 48 | >300 | Example of the invention |
| 7 | 16 | 3.22 | 0.07 | tr | tr | tr | tr | tr | 0.50 | tr | 66 | 10 | 1.50 | 92.2 | 65 | >300 | Example of the invention |
| 8 | 24 | 3.33 | 0.15 | tr | tr | tr | tr | tr | tr | tr | 150 | 20 | 1.83 | 143.5 | 120 | 140 | Comparative example |

TABLE 4-continued

| No. | Chemical composition (mass %, ppm) C | Si | Mn | Ni | Sn | Sb | Cu | P | Cr | Mo | Al | N | EI core $W_{15/50}$ (W/kg) | Number of fine grains (/cm$^2$) | N content of steel (ppm) | Number of times of punching (10,000 times) | Remarks |
|---|---|---|---|---|---|---|---|---|---|---|---|---|---|---|---|---|---|
| 9 | 15 | 3.30 | 0.19 | tr | tr | tr | tr | tr | tr | tr | 50 | 78 | 1.93 | 151.0 | 114 | 120 | Comparative example |
| 10 | 45 | 2.6 | 0.48 | tr | 0.02 | 0.02 | tr | tr | tr | tr | 24 | 11 | 1.65 | 75.5 | 28 | >300 | |
| 11 | 15 | 4.4 | 0.03 | tr | tr | 0.02 | 0.05 | 0.01 | tr | tr | 23 | 12 | 1.37 | 102.4 | 23 | >300 | |
| 12 | 24 | 3.40 | 0.20 | tr | tr | tr | tr | tr | tr | 0.02 | 30 | 15 | 1.51 | 85.3 | 30 | >300 | |

In the table, C, Al and N are shown by ppm.

As shown in Table 4, by using a slab having a composition satisfying 0.003 to 0.08% of C, 2.0 to 8.0% of Si, 100 ppm or less of Al and 50 ppm or less of N, a product having excellent punching quality and iron loss is obtained.

Such a product is composed of steel containing 10 ppm or more of N, and contains secondary recrystallized grains having fine crystal grains having a diameter of 0.15 mm to 0.50 mm corresponding to a circle diameter at a rate of 2 grains/cm$^2$ or more.

Example 4—First Embodiment

Steel slabs A to D and Z each containing the components shown in Table 5 and a balance substantially composed of Fe (30 ppm or less each of other impurities, and without the inhibitor components) were produced by continuous casting, and heated at 1200° C. for 20 minutes. Then, each of the steel slabs was finished to a hot-rolled sheet of 2.6 mm in thickness by hot rolling. Then, each of the hot-rolled sheets was annealed (at 950° C. for 60 seconds), and finished to a final thickness of 0.35 mm by cold rolling. The S amount was lower than a level allowing S to function as the inhibitor. This applies to the examples below.

Among the steel slabs shown in Table 5, for steel slabs A to D, recrystallization annealing (primary recrystallization annealing) (at 930° C. for 10 seconds) was performed by a hydrogen atmosphere (a dew point of −20° C. or lower), and then final annealing (secondary recrystallization annealing) was performed at an annealing temperature of 920° C. in a nitrogen atmosphere (a dew point of −20° C.) without the annealing separator being applied. In this final annealing, the rate of heating from 300° C. to 800° C. was 20° C./h. In this example, after final annealing, the Al amount of steel was 5 to 60 ppm, and the S amount was 5 to 20 ppm.

In order to evaluate the punching quality of the thus-obtained steel sheets, a punching work was repeated by using a steel die having a diameter of 5 mm to evaluate the punching quality based on the number of times of punching until the burr height reached 50 $\mu$m. The obtained results are shown in Table 5.

TABLE 5

| Steel symbol | Chemical component (%, ratio by mass) C | Si | Mn | Al | N | S | O | Number of times of punching (1,000 times) |
|---|---|---|---|---|---|---|---|---|
| A | 0.0032 | 3.25 | 0.073 | 0.008 | 0.0015 | 0.0012 | 0.0016 | 95.0 |
| B | 0.0041 | 3.88 | 0.071 | 0.002 | 0.0043 | 0.0008 | 0.0008 | 68.5 |
| D | 0.0022 | 3.38 | 0.080 | 0.006 | 0.0024 | 0.0036 | 0.0032 | 84.0 |
| Z | 0.0060 | 3.48 | 0.074 | 0.025 | 0.0080 | 0.0030 | 0.0048 | 4.5 |

As can be seen from Table 5, when primary recrystallization annealing is performed in a nitrogen atmosphere having a dew point of 0° C. or lower, the number of times of punching reaches 60000 or more. However, with a conventional composition, when primary recrystallization annealing causing decarburization is performed with a dew point of 60° C. by a conventional means, and when finish annealing (including purification annealing) is performed at a high temperature of 1200° C. or higher (Steel Symbol Z), the number of times of punching is several thousands. In any one of Experimental materials A to D, secondary recrystallized grains were steadily grown.

In the examples of the present invention, the existence rate of fine crystal grains of 0.15 to 0.50 mm was 2 grains/cm$^2$ or more.

Example 5—First Embodiment

Steel slabs containing the components shown in Table 6 (30 ppm or less each of other impurities, and without the inhibitor components) were produced by continuous casting, and heated at 1200° C. for 20 minutes. Then, each of the steel slabs was finished to a hot-rolled sheet of 2.6 mm in thickness by hot rolling. Then, each of the hot-rolled sheets was annealed (at 1000° C. for 20 seconds), and finished to a final thickness of 0.35 mm by cold rolling. Then, primary recrystallization annealing (at 900° C. for 60 seconds) was performed in a hydrogen atmosphere having a dew point of −20° C.

Then, the thus-obtained primary recrystallized sheet was coated with the annealing separator mainly composed of $SiO_2$, and secondary recrystallization annealing was performed at an annealing temperature of 900° C. in a nitrogen atmosphere (a drew point of −10° C.) under heating from 300° C. to 800° C. at a rate of 25° C./h to obtain a grain oriented electromagnetic steel sheet. Then, the steel sheet was coated with an organic coating mainly composed of acrylic resin and vinyl acetate, and dried by baking to obtain a product. In the examples of the present invention, the Al amount of steel after final annealing was 10 to 60 ppm. Since Steel Symbol I was not decarburized, the product sheet contained substantially the same amount of C as the slab.

Table 6 also shows the magnetic properties and punching quality of the obtained products. The punching test was carried out by the same method as Example 4. Table 6 indicates that with a composition within the range of the present invention, both the magnetic properties and punching quality are improved.

In the examples of the present invention, the existence rate of fine crystal grains of 0.15 to 0.50 mm was 2 grains/cm$^2$ or more.

TABLE 6

| Steel | Chemical component (%, ratio by mass) | | | | | | Electromagnetic properties | | Number of times of punching | |
|---|---|---|---|---|---|---|---|---|---|---|
| symbol | C | Si | Mn | Al | N | O | $W_{17/50}$ (W/kg) | $B_8$ (T) | (1,000 times) | Remarks |
| E | 0.0032 | 3.25 | 0.073 | 0.008 | 0.0015 | 0.0016 | 0.986 | 1.92 | 95.0 | Example of the invention |
| F | 0.0041 | 3.38 | 0.151 | 0.002 | 0.0023 | 0.0008 | 1.121 | 1.89 | 68.5 | Example of the invention |
| H | 0.0033 | 4.01 | 0.041 | 0.003 | 0.0031 | 0.0039 | 1.139 | 1.88 | 52.5 | Example of the invention |
| I | 0.0123 | 3.38 | 0.080 | 0.006 | 0.0014 | 0.0022 | 1.536 | 1.71 | 14.0 | Comparative example |
| J | 0.0048 | 1.03 | 0.069 | 0.006 | 0.0025 | 0.0020 | 1.845 | 1.68 | 67.0 | Comparative example |
| L | 0.0021 | 3.28 | 0.075 | 0.042 | 0.0036 | 0.0011 | 1.701 | 1.72 | 72.5 | Comparative example |
| M | 0.0038 | 3.26 | 0.070 | 0.010 | 0.0072 | 0.0012 | 1.598 | 1.69 | 62.0 | Comparative example |

Example 6—First Embodiment

A steel slab containing 11 ppm of C, 2.98% of Si, 0.12% of Mn, 0.012% of Al, 0.0023% of S, 0.0014% of N, 0.0010% of O, and the balance substantially composed of Fe (30 ppm or less each of other impurities, and without the inhibitor components) was produced by continuous casting. Then, the steel slab was heated at 1200° C. for 20 minutes, and then finished to a hot-rolled sheet of 2.6 mm in thickness by hot rolling. The hot-rolled sheet was annealed (at 1000° C. for 30 seconds), and then finished to a final thickness of 0.35 mm by cold rolling. Then, primary recrystallization annealing was performed (at 970° C. for 10 seconds) in a nitrogen atmosphere having a dew point of −20° C. Then, the annealing separator mainly composed of $SiO_2$ was coated on the primarily recrystallized sheet, and secondary recrystallization annealing was performed under a condition in which the temperature was increased from 300° C. to 800° C. at a rate of 25° C./h in a nitrogen atmosphere, and maintained at each of the temperatures shown in Table 7. After final annealing, the Al amount of steel was 50 ppm and the S amount was 15 ppm.

Then, the thus-obtained grain oriented electromagnetic steel sheets were coated with an organic coating mainly composed of an acrylic resin and an epoxy resin, and baked. Table 7 also shows the magnetic properties and punching quality of the steel sheets. Table 7 indicates that in the case of secondary recrystallization annealing within the range of the present invention and the preferred range, both the magnetic properties and punching quality are improved.

In the examples of the present invention, the existence rate of fine crystal grains of 0.15 to 0.50 mm was 2 grains/cm$^2$ or more.

TABLE 7

| Secondary recrystallization annealing | Electromagnetic properties | | Number of times of punching | |
|---|---|---|---|---|
| temperature (° C.) | $W_{17/50}$ (W/kg) | $B_8$ (T) | (1,000 times) | Remarks |
| 750 | 2.381 | 1.58 | 21.5 | Comparative example |
| 775 | 2.375 | 1.57 | 33.5 | Comparative example |
| 800 | 1.246 | 1.85 | 42.5 | Example of the invention |
| 825 | 1.233 | 1.85 | 57.0 | Example of the invention |

TABLE 7-continued

| Secondary recrystallization annealing | Electromagnetic properties | | Number of times of punching | |
|---|---|---|---|---|
| temperature (° C.) | $W_{17/50}$ (W/kg) | $B_8$ (T) | (1,000 times) | Remarks |
| 850 | 1.176 | 1.88 | 58.0 | Example of the invention |
| 875 | 1.097 | 1.90 | 61.5 | Example of the invention |
| 900 | 1.084 | 1.90 | 58.5 | Example of the invention |
| 925 | 1.124 | 1.87 | 63.0 | Example of the invention |
| 950 | 1.136 | 1.88 | 60.5 | Example of the invention |
| 975 | 1.091 | 1.89 | 55.0 | Example of the invention |
| 1000 | 1.185 | 1.87 | 59.0 | Example of the invention |
| 1025 | 1.511 | 1.77 | 38.5 | Comparative example |
| 1050 | 1.489 | 1.77 | 36.0 | Comparative example |

Example 7—First Embodiment

A steel slab containing 28 ppm of C, 3.44% of Si, 0.08% of Mn, 0.004% of Al, 0.0013% of S, 0.0022% of N. 0.0008% of O, and the balance substantially composed of Fe (30 ppm or less each of other impurities, and without the inhibitor components) was produced by continuous casting. Then, the steel slab was heated at 1200° C. for 20 minutes, and then finished to a hot-rolled sheet of 2.8 mm in thickness by hot rolling. The hot-rolled sheet was annealed (at 900° C. for 60 seconds), and then finished to a final thickness of 0.30 mm by cold rolling. Then, primary recrystallization annealing was performed (at 950° C. for 20 seconds) in an atmosphere (75% $H_2$-25% $N_2$) having each of the dew points shown in Table 8. Then, the annealing separator mainly composed of $SiO_2$ was coated on the primary recrystallized sheet, and secondary recrystallization annealing was performed at an annealing temperature of 1000° C. under a condition in which the temperature was increased from 300° C. to 800° C. at a rate of 50° C./h in a nitrogen atmosphere (a drew point of −40° C.)

Then, the thus-obtained steel sheets were coated with an organic coating mainly composed of an acrylic resin and vinyl acetate, and baked to form products. In the examples of the present invention, after final annealing, the Al amount of steel was 20 ppm, and the S amount was 10 ppm.

Table 8 also shows the magnetic properties and punching quality of the obtained products. Table 8 indicates that in the examples of the present invention, both the magnetic properties and punching quality are improved.

In the examples of the present invention, the existence rate of fine crystal grains of 0.15 to 0.50 mm was 2 grains/cm$^2$ or more.

TABLE 8

| Dew point (° C.) | Electromagnetic properties $W_{17/50}$ (W/kg) | Electromagnetic properties $B_8$ (T) | Number of times of punching (1,000 times) | Remarks |
|---|---|---|---|---|
| 60 | 1.473 | 1.74 | 21.5 | Comparative example |
| 50 | 1.351 | 1.75 | 18.5 | Comparative example |
| 20 | 1.184 | 1.88 | 24.0 | Example of the invention |
| 10 | 1.097 | 1.90 | 23.5 | Example of the invention |
| 0 | 1.084 | 1.90 | 41.5 | Example of the invention |
| −10 | 1.124 | 1.87 | 52.0 | Example of the invention |
| −20 | 1.036 | 1.91 | 60.5 | Example of the invention |
| <−20 | 1.011 | 1.92 | 61.0 | Example of the invention |

Example 8—First Embodiment

A steel slab containing each of the compositions shown in Table 9 and the balance substantially composed of Fe (30 ppm or less each of other impurities, and without the inhibitor components) was produced by continuous casting. Then, the steel slab was heated at 1200° C. for 20 minutes, and then finished to a hot-rolled sheet of 2.6 mm in thickness by hot rolling. The hot-rolled sheet was annealed (at 900° C. for 30 seconds), and then finished to a final thickness of 0.50 mm by cold rolling. Then, primary recrystallization annealing (hydrogen: 75 vol %, nitrogen: 25 vol %, 950° C.-10 seconds) was performed with the dew point being changed as shown in Table 10. Then, secondary recrystallization annealing was performed at an annealing temperature of 900° C. (hydrogen: 75 vol %, nitrogen: 25 vol %, dew point −20° C.) without the annealing separator being applied. In the secondary recrystallization annealing, the rate of heating 300° C. to 800° C. was changed as shown in Table 10. In the examples (Steel Symbols O and P) of the present invention, after final annealing, the Al amount of steel was 20 to 60 ppm, and the S amount was 5 to 10 ppm. In Steel Symbols Q and R, decarburization was not performed, and thus the C contents of the product sheets were substantially the same as the slabs.

Then, the thus-obtained steel sheets were coated with an organic coating mainly composed of an acrylic resin and vinyl acetate, and baked to form products. The thus-obtained products were measured with respect to the magnetic properties and punching quality. Table 10 shows the obtained results. Table 10 indicates that in the examples of the present invention, both the magnetic properties and punching quality are improved.

In the examples of the present invention, the existence rate of fine crystal grains of 0.15 to 0.50 mm was 2 grains/cm$^2$ or more.

TABLE 9

| Steel symbol | Chemical component (%, ratio by mass) C | Si | Mn | Al | N | S | O |
|---|---|---|---|---|---|---|---|
| O | 0.0021 | 3.41 | 0.070 | 0.008 | 0.0015 | 0.0011 | 0.0021 |
| Q | 0.0124 | 3.10 | 0.068 | 0.005 | 0.0031 | 0.0009 | 0.0022 |
| R | 0.0368 | 3.34 | 0.082 | 0.006 | 0.0026 | 0.0015 | 0.0018 |

TABLE 10

| Steel symbol | Dew point (° C.) | Heating rate (° C./s) | Electromagnetic properties $W_{17/50}$ (W/kg) | Electromagnetic properties $B_8$ (T) | Number of times of punching (1,000 times) | Remarks |
|---|---|---|---|---|---|---|
| O | <−20 | 20 | 1.425 | 1.912 | 63.0 | Example of the invention |
| O | <−20 | 120 | 1.535 | 1.733 | 49.5 | Comparative example |
| O | 50 | 20 | 1.825 | 1.652 | 13.0 | Comparative example |
| O | 50 | 120 | 2.000 | 1.621 | 9.5 | Comparative example |
| Q | <−20 | 20 | 1.525 | 1.674 | 42.5 | Comparative example |
| Q | <−20 | 120 | 1.731 | 1.658 | 31.0 | Comparative example |
| Q | 50 | 20 | 1.656 | 1.843 | 7.5 | Comparative example |
| Q | 50 | 120 | 1.535 | 1.682 | 8.5 | Comparative example |
| R | <−20 | 20 | 1.668 | 1.656 | 36.0 | Comparative example |
| R | <−20 | 120 | 1.689 | 1.643 | 43.5 | Comparative example |
| R | 50 | 20 | 1.812 | 1.837 | 4.5 | Comparative example |
| R | 50 | 120 | 1.780 | 1.682 | 4.0 | Comparative example |

Example 9—First Embodiment

A steel slab containing each of the compositions shown in Table 9 was produced by continuous casting. Then, the steel slab was heated at 1150° C. for 30 minutes, and then finished to a hot-rolled sheet of 2.6 mm in thickness by hot rolling. The hot-rolled sheet was annealed (at 950° C. for 30 seconds), and cold rolled to an intermediate thickness of 0.80 mm. After intermediate annealing at 950° C., the annealed sheet was finished to a final thickness of 0.10 mm by cold rolling. Then, primary recrystallization annealing (hydrogen atmosphere, 950° C.-20 seconds) was performed with the dew point being changed as shown in Table 11. Then, secondary recrystallization annealing was performed at an annealing temperature of 900° C. in a nitrogen atmosphere without the annealing separator being applied. In the secondary recrystallization annealing, the rate of heating 300° C. to 800° C. was changed as shown in Table 11. In the examples (Steel Symbols O and P) of the present invention, after final annealing, the Al amount of steel was 20 to 60 ppm, and the S amount was 5 to 15 ppm. In Steel Symbols Q and R, decarburization was not performed, and thus the C contents of the product sheets were substantially the same as the slabs.

Then, the thus-obtained steel sheets were coated with a semi-organic coating mainly composed of an acrylic resin and chromic acid type inorganic material, and baked to form products. The thus-obtained products were measured with respect to the magnetic properties and punching quality. Table 11 shows the obtained results. Table 11 indicates that the product produced under the conditions of the present invention is excellent in both the magnetic properties and punching quality.

In the examples of the present invention, the existence rate of fine crystal grains of 0.15 to 0.50 mm was 2 grains/cm$^2$ or more.

TABLE 11

| Steel symbol | Dew point (° C.) | Heating rate (° C./s) | Electromagnetic properties $W_{17/50}$ (w/kg) | Electromagnetic properties $B_8$ (T) | Number of times of punching (1,000 times) | Remarks |
|---|---|---|---|---|---|---|
| O | <−20 | 20 | 0.821 | 1.910 | 91.0 | Example of the invention |
| O | <−20 | 120 | 1.928 | 1.741 | 69.5 | Comparative example |
| O | 50 | 20 | 1.196 | 1.823 | 15.0 | Comparative example |
| O | 50 | 120 | 1.600 | 1.649 | 23.0 | Comparative example |
| Q | <−20 | 20 | 1.240 | 1.775 | 61.0 | Comparative example |
| Q | <−20 | 120 | 1.622 | 1.667 | 32.0 | Comparative example |
| Q | 50 | 20 | 1.396 | 1.805 | 19.0 | Comparative example |
| Q | 50 | 120 | 1.523 | 1.709 | 18.5 | Comparative example |
| R | <−20 | 20 | 1.264 | 1.823 | 53.5 | Comparative example |
| R | <−20 | 120 | 1.611 | 1.655 | 40.5 | Comparative example |
| R | 50 | 20 | 1.382 | 1.810 | 11.5 | Comparative example |
| R | 50 | 120 | 1.780 | 1.611 | 9.5 | Comparative example |

Example 10—Second Embodiment

A steel slab having a composition containing 0.005% of C, 3.4% of Si, 0.07% of Mn, 0.03% of Sb, and Al and N decreased to 20 ppm and 19 ppm, respectively (30 ppm or less each of other components, and without an inhibitor components) was produced by continuous casting. Then, the steel slab was heated at 1100° C. for 20 minutes, and then hot-rolled to form a hot-rolled sheet of 2.6 mm in thickness. Then, the hot-rolled sheet was annealed by soaking at 1000° C. for 60 seconds. The annealed sheet was then finished to a final thickness of 0.35 mm by cold rolling at room temperature. After hot-rolled sheet annealing, the grain diameter before final cold rolling was 130 $\mu$m.

Then, recrystallization annealing (a dew point of −30° C.) was performed in an atmosphere containing 75 vol % of hydrogen and 25 vol % of nitrogen under the conditions shown in Table 12. After the crystal grain diameter was measured after recrystallization annealing, final annealing was performed under a condition in which the temperature was increased to 800° C. at a rate of 50° C./h in a mixed atmosphere having a dew point of −25° C. and containing 25 vol % of nitrogen and 75 vol % of hydrogen, increased from 800° C. to 860° C. at a rate of 10° C./h, and maintained at this temperature for 20 hours. In the examples of the present invention, after final annealing, the Al amount of steel was 10 ppm, and the N amount was 30 ppm.

Then, the finish annealed sheet was coated with a coating solution made by mixing aluminum bichromate, an emulsion resin and ethylene glycol, and baked at 300° C. to form a product.

The thus-obtained product sheets were measured with respect to the magnetic properties, and an EI core was formed from each of the thus-obtained product sheets by punching, and measured with respect to its iron loss ($W_{15/50}$) after stress relief annealing at 750° C. for 2 hours in nitrogen.

The obtained results are shown in Table 12.

For comparison, Table 12 also shows the iron loss ($W_{15/50}$) measured for an EI core produced by using each of a conventional grain oriented electromagnetic steel sheet and a non-oriented electromagnetic steel sheet having the same thickness of 0.35 mm.

TABLE 12

| No. | Recrystallization annealing Temp. (° C.) | Time (s) | Grain diameter (μm) | $W_{L15/50}$ in rolling direction of product sheet (w/kg) | Iron loss ratio $W_{C15/50}/W_{L15/50}$ (w/kg) | Iron loss of EI core $W_{15/50}$ (w/kg) | Remarks |
|---|---|---|---|---|---|---|---|
| 1 | 900 | 30 | 35 | 0.93 | 1.96 | 1.22 | Example of the invention |
| 2 | 925 | 30 | 47 | 0.90 | 1.94 | 1.19 | Example of the invention |
| 3 | 950 | 30 | 55 | 0.89 | 1.93 | 1.17 | Example of the invention |
| 4 | 975 | 10 | 71 | 0.89 | 1.90 | 1.15 | Example of the invention |
| 5 | 800 | 3600 | 78 | 0.93 | 2.24 | 1.33 | Example of the invention |
| 6 | 840 | 30 | 24 | 1.64 | 2.28 | 1.99 | Comparative example |
| 7 | 1000 | 30 | 122 | 1.55 | 2.00 | 1.97 | Comparative example |
| 8 | Grain oriented electromagnetic steel sheet | | | 0.90 | 4.03 | 1.52 | Comparative example |
| 9 | Non-oriented electromagnetic steel sheet | | | 1.90 | 1.29 | 2.11 | Comparative example |

As shown in Table 12, when the grain diameter after recrystallization annealing is controlled in the range of 30 to 80 μm, a product can be obtained, in which the iron loss ($W_{L15/50}$) in the rolling direction is 1.40 W/kg or less, and the iron loss ($W_{C15/50}$) in the direction perpendicular to the rolling direction is 2.6 times or less as large as that ($W_{L15/50}$) in the rolling direction. It is thus found that a good iron loss can be obtained in application to the EI core.

In the examples of the present invention, the existence rate of fine crystal grains of 0.15 to 0.50 mm is 3 grains/$cm^2$ or more.

Example 11—Second Embodiment

A steel slab having a composition containing 0.023% of C, 3.3% of Si, 0.12% of Mn, and Al and N decreased to 40 ppm and 14 ppm, respectively (30 ppm or less each of other components, and without an inhibitor components) was produced by continuous casting. Then, the steel slab was heated at 1200° C. for 20 minutes, and then hot-rolled to form a hot-rolled sheet of 2.2 mm in thickness. Then, the hot-rolled sheet was annealed at 1100° C. for 20 seconds. The annealed sheet was then finished to a final thickness of 0.35 mm by cold rolling at 240° C. under a condition in which aging was performed at 200° C. for 5 hours when the thickness was 0.90 mm in the course of rolling. The grain diameter before final cold rolling was 280 μm.

Then, recrystallization annealing including decarburization was performed in an atmosphere containing 75 vol % of hydrogen and 25 vol % of nitrogen and having a dew point of 50° C. under the conditions shown in Table 13. After the crystal grain diameter was measured after recrystallization annealing, colloidal silica ($SiO_2$) was coated as the annealing separator, and then final annealing (an annealing atmosphere containing 75 vol % of hydrogen and 25 vol % of nitrogen, and having a dew point of −20° C.) was performed under a condition in which the temperature was increased from room temperature to 900° C. at a rate of 30° C./h, and maintained at this temperature for 50 hours. In the examples of the present invention, after final annealing, the C amount of steel was 10 ppm, the Al amount of steel was 10 ppm, and the N amount of steel was 15 ppm.

Then, the finish annealed sheet was coated with a coating solution made by mixing aluminum bichromate, an emulsion resin and ethylene glycol, and baked at 300° C. to form a product.

The thus-obtained product sheets were measured with respect to the magnetic properties, and an EI core formed formed from each of the thus-obtained product sheets by punching, was measured with respect to its iron loss ($W_{15/50}$) after stress relief annealing (at 750° C. for 2 hours in nitrogen). The obtained results are shown in Table 13.

TABLE 13

| No. | Recrystallization annealing Temp. (° C.) | Time (s) | Grain diameter (μm) | $W_{L15/50}$ in rolling direction of product sheet (w/kg) | Iron loss ratio $W_{C15/50}/W_{L15/50}$ (w/kg) | Rolling direction $B_{L50}$ (T) | Direction perpendicular to rolling direction $B_{C50}$ (T) | Iron loss of EI core $W_{15/50}$ (w/kg) | Remarks |
|---|---|---|---|---|---|---|---|---|---|
| 1 | 850 | 60 | 32 | 1.05 | 1.36 | 1.95 | 1.85 | 1.12 | Example of the invention |

TABLE 13-continued

| No. | Recrystallization annealing Temp. (° C.) | Time (s) | Grain diameter (μm) | $W_{L15/50}$ in rolling direction of product sheet (w/kg) | Iron loss ratio $W_{C15/50}/W_{L15/50}$ (w/kg) | Rolling direction $B_{L50}$ (T) | Direction perpendicular to rolling direction $B_{C50}$ (T) | Iron loss of EI core $W_{15/50}$ (w/kg) | Remarks |
|---|---|---|---|---|---|---|---|---|---|
| 2 | 875 | 60 | 45 | 1.03 | 1.33 | 1.95 | 1.87 | 1.08 | Example of the invention |
| 3 | 900 | 60 | 57 | 1.04 | 1.24 | 1.92 | 1.90 | 1.06 | Example of the invention |
| 4 | 925 | 30 | 70 | 1.08 | 1.20 | 1.90 | 1.91 | 1.10 | Example of the invention |
| 5 | 800 | 3600 | 75 | 1.15 | 1.44 | 1.94 | 1.78 | 1.25 | Example of the invention |
| 6 | 800 | 30 | 20 | 1.85 | 1.50 | 1.75 | 1.63 | 1.97 | Comparative example |
| 7 | 1000 | 30 | 111 | 1.99 | 1.44 | 1.73 | 1.60 | 2.03 | Comparative example |

As shown in Table 13, when the grain diameter after recrystallization annealing is controlled in the range of 30 to 80 μm, a product can be obtained, in which the iron loss ($W_{L15/50}$) in the rolling direction is 1.40 W/kg or less, and the iron loss ($W_{C15/50}$) in the direction perpendicular to the rolling direction is 2.6 times or less as large as that ($W_{L15/50}$) in the rolling direction. It is thus found that a good iron loss can be obtained in application to the EI core.

In the examples of the present invention, the existence rate of fine crystal grains of 0.15 to 0.50 mm is 3 grains/cm$^2$ or more.

Example 12—Second Embodiment

Steel slabs containing the components shown in Table 14 (30 ppm or less each of other impurities, and without the inhibitor components) were heated to 1160° C., and hot-rolled to form hot-rolled sheets of 2.6 mm in thickness. Then, each of the hot-rolled sheets was annealed by soaking at 1000° C. for 30 seconds. The crystal grain diameter before the start of cold rolling was 30 to 60 μm. Then, each annealed sheet was finished to a final thickness of 0.30 mm by cold rolling. Then, primary recrystallization annealing was performed by soaking at 980° C. for 20 seconds in an atmosphere containing 50 vol % of hydrogen and 50 vol % of nitrogen, and having a dew point of −30° C. After the grain diameter after recrystallization annealing was measured, final annealing was performed in a nitrogen atmosphere having a dew point of −40° C. under a condition in which the temperature was increased to 850° C. at a rate of 10° C./h, and maintained at this temperature for 75 hours without the annealing separator being applied. In the examples of the present invention, after final annealing, the Al amount of steel was 5 to 30 ppm, and the N amount was 15 to 50 ppm.

Then, the steel sheet was coated with a coating solution made by mixing aluminum phosphate, potassium bichromate and boric acid, and baked at 300° C. to obtain a product.

The thus-obtained product sheet was measured with respect to the magnetic properties, and an EI core produced by using each of the product sheets was measured with respect to its iron loss ($W_{15/50}$) after stress relief annealing (at 750° C. for 2 hours in nitrogen). The obtained results are shown in Table 14.

TABLE 14

| No. | Chemical composition (mass %, ppm) C | Si | Mn | Ni | Sn | Sb | Cu | P | Cr | Al | N | Recrystallized grain diameter (μm) | $W_{L15/50}$ in rolling direction (W/kg) | Iron loss ratio $W_{C15/50}/W_{L15/50}$ | EI core $W_{15/50}$ (W/kg) | Remarks |
|---|---|---|---|---|---|---|---|---|---|---|---|---|---|---|---|---|
| 1 | 15 | 3.32 | 0.12 | tr | tr | tr | tr | tr | tr | 30 | 20 | 56 | 0.85 | 2.04 | 1.20 | Example of the invention |
| 2 | 14 | 3.40 | 0.05 | 0.30 | tr | tr | tr | tr | tr | 17 | 13 | 65 | 0.80 | 1.95 | 1.15 | Example of the invention |
| 3 | 20 | 3.45 | 0.22 | tr | 0.14 | tr | tr | tr | tr | 50 | 25 | 44 | 0.85 | 1.77 | 1.10 | Example of the invention |
| 4 | 24 | 3.22 | 0.13 | tr | tr | 0.03 | tr | tr | tr | 66 | 12 | 63 | 0.83 | 1.75 | 1.07 | Example of the invention |
| 5 | 22 | 3.32 | 0.08 | tr | tr | tr | 0.15 | tr | tr | 25 | 6 | 67 | 0.81 | 1.84 | 1.10 | Example of the invention |
| 6 | 16 | 3.45 | 0.10 | tr | tr | tr | tr | 0.08 | tr | 30 | 15 | 48 | 0.83 | 1.95 | 1.17 | Example of the invention |

TABLE 14-continued

| No. | Chemical composition (mass %, ppm) C | Si | Mn | Ni | Sn | Sb | Cu | P | Cr | Al | N | Recrystallized grain diameter (μm) | $W_{L15/50}$ in rolling direction (W/kg) | Iron loss ratio $W_{C15/50}/W_{L15/50}$ | EI core $W_{15/50\ (W/kg)}$ | Remarks |
|---|---|---|---|---|---|---|---|---|---|---|---|---|---|---|---|---|
| 7 | 20 | 3.40 | 0.37 | tr | tr | tr | tr | tr | 0.50 | 35 | 10 | 50 | 0.80 | 1.80 | 1.08 | Example of the invention |
| 8 | 13 | 3.37 | 0.16 | tr | tr | tr | tr | tr | tr | 250 | 20 | 13 | 1.88 | 1.56 | 2.23 | Comparative example |
| 9 | 16 | 3.41 | 0.20 | tr | tr | tr | tr | tr | tr | 50 | 85 | 19 | 2.10 | 1.44 | 2.33 | Comparative example |

Table 14 indicates that by using a slab of a component system satisfying 0.003 to 0.08% of C, 2.0% to 8.0% of Si, 100 ppm or less of Al, and 30 ppm or less of N, a product can be obtained, in which the iron loss ($W_{L15/50}$) in the rolling direction is 1.40 W/kg or less, and the iron loss ($W_{C15/50}$) in the direction perpendicular to the rolling direction is 2.6 times or less as large as that ($W_{L15/50}$) in the rolling direction.

In the examples of the present invention, the existence rate of fine crystal grains of 0.15 to 0.50 mm was 3 grains/cm$^2$ or more.

Example 13—Third Embodiment

A steel slab containing 0.002% of C, 3.5% of Si, 0.05% of Mn, 0.02% of Sb, Al and N decreased to 40 ppm and 9 ppm, respectively, and 20 ppm or less each of other impurities (without the inhibitor components) was produced by continuous casting, and heated at 1100° C. for 20 minutes. Then, the steel slab was hot-rolled to form a hot-rolled sheet of 2.6 mm in thickness. Then, the hot-rolled sheet was annealed by soaking at 1000° C. for 60 seconds. Then, first cold rolling was performed at room temperature to obtain an intermediate thickness of 1.60 mm, and intermediate annealing was performed by soaking at 850° C. for 10 seconds. The crystal grain diameter after intermediate annealing was 70 μm.

Then, the annealed sheet was finished to a final thickness of 0.20 mm by second cold rolling at room temperature under a condition in which aging was performed at 200° C. for 5 hours when the thickness was 0.90 mm in the course of cold rolling. Then, recrystallization annealing was performed in a mixed atmosphere containing 75 vol % of hydrogen and 25 vol % of nitrogen (a dew point of −50° C.) under the conditions shown in Table 15. After the grain diameter after recrystallization annealing was measured, final annealing was performed under a condition in which the temperature was increased to 800° C. at a rate of 50° C./h in an atmosphere having a dew point of −50° C. and containing 25 vol % of nitrogen and 75 vol % of hydrogen, increased from 800° C. to 830° C. at a rage of 10° C./h, and maintained at this temperature for 50 hours without the annealing separator being applied. In the examples of the present invention, after final annealing, the Al amount of steel was 20 ppm, and the N amount was 20 ppm.

Then, the steel sheet was coated with a coating solution made by mixing aluminum bichromate, an emulsion resin and ethylene glycol, and baked at 300° C. to obtain a product.

The thus-obtained product sheet was measured with respect to the average grain diameter of the secondary recrystallized grains on the surface of the steel sheet except fine grains of 1 mm or less.

Also, the existence rate of fine crystal grains having a grain diameter of 0.15 mm to 1.00 mm in the secondary recrystallized grains was determined by measuring the number of the fine crystal grains in a 3-cm square region of the surface of the steel sheet.

Furthermore, crystal orientation of the product sheet was measured in a region of 30×280 mm by X-ray diffraction to measure the rate (area fraction) of crystal grains having Goss orientation allowing 20° of the deviation angle from ideal {110}<001> orientation (area fraction of Goss orientation grains).

Furthermore, a high-frequency iron loss (frequency: 400 Hz, 1000 Hz) was measured at a frequency of each of 400 Hz and 1000 Hz.

The obtained results are shown in Table 15.

For comparison, Table 15 also shows the results of the same measurement conducted for a grain oriented electromagnetic steel sheet and a non-oriented electromagnetic steel sheet having the same thickness of 0.20 mm.

TABLE 15

| No. | Recrystallization annealing Temp. (° C.) | Time (s) | Grain diameter (μm) | Iron loss of product sheet $W_{10/400}$ (w/kg) | $W_{10/1000}$ (w/kg) | Average grain diameter of product sheet (mm) | Rate of fine grains of product sheet (/cm$^2$) | Area ratio of Goss orientation grains of product sheet (%) | Remarks |
|---|---|---|---|---|---|---|---|---|---|
| 1 | 880 | 30 | 33 | 6.7 | 28.0 | 37 | 219 | 94 | Example of the invention |

TABLE 15-continued

| No. | Recrystallization annealing Temp. (° C.) | Time (s) | Grain diameter (μm) | Iron loss of product sheet $W_{10/400}$ (w/kg) | $W_{10/1000}$ (w/kg) | Average grain diameter of product sheet (mm) | Rate of fine grains of product sheet (/cm²) | Area ratio of Goss orientation grains of product sheet (%) | Remarks |
|---|---|---|---|---|---|---|---|---|---|
| 2 | 915 | 30 | 44 | 6.1 | 27.1 | 45 | 188 | 99 | Example of the invention |
| 3 | 940 | 30 | 55 | 6.5 | 28.6 | 34 | 198 | 95 | Example of the invention |
| 4 | 965 | 10 | 70 | 6.8 | 29.0 | 25 | 156 | 95 | Example of the invention |
| 5 | 800 | 3600 | 77 | 7.3 | 29.7 | 18 | 133 | 88 | Example of the invention |
| 6 | 800 | 30 | 23 | 8.9 | 33.7 | 5 | 28 | 70 | Comparative example |
| 7 | 1000 | 30 | 120 | 9.4 | 34.1 | 3 | 197 | 66 | Comparative example |
| 8 | Grain oriented electromagnetic steel sheet | | | 8.5 | 34.0 | 22 | 0.2 | 98 | Comparative example |
| 9 | Non-oriented electromagnetic steel sheet | | | 11.0 | 39.8 | 0.10 | — | 5 | Comparative example |

Table 15 indicates that in any of the examples of the present invention satisfying the requirements of the present invention, a high-frequency iron loss superior to a conventional grain oriented electromagnetic steel sheet is obtained.

In the examples of the present invention, the existence rate of fine crystal grains of 0.15 to 0.50 mm was 2 grains/cm² or more.

Example 14—Third Embodiment

A steel slab containing 0.003% of C, 3.6% of Si, 0.12% of Mn, and Al and N decreased to 30 ppm and 10 ppm, respectively, (30 ppm or less each of other impurities, and without the inhibitor components) was produced by continuous casting, and heated at 1200° C. for 20 minutes. Then, the steel slab was hot-rolled to form a hot-rolled sheet of 2.2 mm in thickness, and the hot-rolled sheet was annealed by soaking at 900° C. for 30 seconds. Then, first cold rolling was performed at room temperature to finish the sheet to a thickness of 0.30 mm, and intermediate annealing was performed under the conditions shown in Table 16. Then, the annealed sheet was finished to a final thickness of 0.10 mm by second cold rolling at room temperature.

Then, recrystallization annealing was performed by soaking at 900° C. for 10 seconds in an atmosphere containing 75 vol % of hydrogen and 25 vol % of nitrogen and having a dew point of −50° C. After the grain diameter after recrystallization annealing was measured, colloidal silica was applied as the annealing separator, and then final annealing was performed under a condition in which the temperature was increased from room temperature to 900° C. at a rate of 30° C./h, and maintained at this temperature for 50 hours (atmosphere, hydrogen: 75 vol %, nitrogen: 25 vol %, dew point: −30° C.). In the examples of the present invention, after final annealing, the Al amount of steel was 10 ppm, and the N amount was 20 ppm.

Then, the steel sheet was coated with a coating solution made by mixing aluminum bichromate, an emulsion resin and ethylene glycol, and baked at 300° C. to obtain a product.

The thus-obtained product sheet was measured with respect to the average grain diameter of the secondary recrystallized grains, the existence rate of fine crystal grains, the area ratio of Goss orientation grains, and the high-frequency iron loss at each of the frequencies in the same manner as Example 13.

The obtained results are shown in Table 16.

For comparison, Table 16 also shows the results of the same measurement conducted for a non-oriented electromagnetic steel sheet having the same thickness of 0.10 mm and a composition containing 6.5% of Si.

TABLE 16

| No. | Intermediate annealing Temp. (° C.) | Time (s) | Grain diameter (μm) | Grain diameter after recrystallization annealing (μm) | Iron loss of product sheet $W_{10/400}$ (W/kg) | $W_{10/1000}$ (W/kg) | Average grain diameter of product sheet (mm) | Rate of fine grains of product sheet (/cm²) | Area ratio of Goss orientation grains of product sheet (%) | Remarks |
|---|---|---|---|---|---|---|---|---|---|---|
| 1 | 850 | 30 | 30 | 46 | 4.7 | 18.0 | 23 | 202 | 83 | Example of the invention |

TABLE 16-continued

| No. | Intermediate annealing Temp. (° C.) | Time (s) | Grain diameter (μm) | Grain diameter after recrystallization annealing (μm) | Iron loss of product sheet $W_{10/400}$ (W/kg) | $W_{10/1000}$ (W/kg) | Average grain diameter of product sheet (mm) | Rate of fine grains of product sheet (/cm²) | Area ratio of Goss orientation grains of product sheet (%) | Remarks |
|---|---|---|---|---|---|---|---|---|---|---|
| 2 | 900 | 30 | 43 | 49 | 4.1 | 17.0 | 25 | 105 | 91 | Example of the invention |
| 3 | 925 | 30 | 51 | 52 | 5.0 | 18.6 | 18 | 133 | 80 | Example of the invention |
| 4 | 950 | 10 | 66 | 43 | 5.2 | 18.8 | 15 | 175 | 73 | Example of the invention |
| 5 | 800 | 3600 | 73 | 35 | 5.3 | 18.7 | 13 | 83 | 81 | Example of the invention |
| 6 | 1000 | 30 | 330 | 28 | 9.4 | 24.3 | 17 | 76 | 26 | Comparative example |
| 7 | (Electromagnetic steel sheet containing 6.5% Si) | | | — | 5.7 | 19.0 | 0.25 | — | 4 | Comparative example |

Table 16 indicates that in any of the examples of the present invention satisfying the requirements of the present invention, a high-frequency iron loss superior to the conventional non-oriented electromagnetic steel sheet containing 6.5% of Si is obtained.

In the examples of the present invention, the existence rate of fine crystal grains of 0.15 to 0.50 mm was 2 grains/cm² or more.

Example 15—Third Embodiment

Steel slabs having the compositions shown in Table 17 (30 ppm or less each of other components, and without the inhibitor components)were produced by continuous casting, and heated to 1160° C. Then, each of the steel slabs was hot-rolled to form a hot-rolled sheet of 1.6 mm in thickness, and the hot-rolled sheet was annealed by soaking at 850° C. for 30 seconds. Then, cold rolling was performed to finish the sheet to a final thickness of 0.23 mm. Before cold rolling, the grain diameter was 40 to 60 μm.

Then, recrystallization annealing was performed by soaking at 950° C. for 10 seconds in an atmosphere containing 50 vol % of hydrogen and 50 vol % of nitrogen and having a dew point of −30° C. After the grain diameter after recrystallization annealing was measured, final annealing was performed under a condition in which the temperature was increased to 850° C. at a rate of 10° C./h, and maintained at this temperature for 75 hours in a nitrogen atmosphere having a dew point of −40° C., without the annealing separator being applied. In the examples of the present invention, after final annealing, the Al amount of steel was 5 to 30 ppm, and the N amount was 20 to 40 ppm.

Then, the steel sheet was coated with a coating solution made by mixing aluminum phosphate, potassium bichromate, and boric acid, and baked at 300° C. to obtain a product.

The thus-obtained product sheet was measured with respect to the average grain diameter of the secondary recrystallized grains, the existence rate of fine crystal grains, the area ratio of Goss orientation grains, and the high-frequency iron loss at a frequency of 1000 Hz in the same manner as Example 13.

The obtained results are shown in Table 18.

For comparison, Table 18 also shows the results of the same measurement conducted for a grain oriented electromagnetic steel sheet having the same thickness of 0.23 mm.

TABLE 17

| No. | Chemical composition (mass %, ppm) C | Si | Mn | Ni | Sn | Sb | Cu | P | Cr | Al | N |
|---|---|---|---|---|---|---|---|---|---|---|---|
| 1 | 25 | 3.52 | 0.10 | tr | tr | tr | tr | tr | tr | 20 | 21 |
| 2 | 24 | 3.50 | 0.05 | 0.50 | tr | tr | tr | tr | tr | 20 | 19 |
| 3 | 30 | 3.53 | 0.20 | tr | 0.04 | tr | tr | tr | tr | 50 | 22 |
| 4 | 33 | 3.62 | 0.15 | tr | tr | 0.04 | tr | tr | tr | 60 | 22 |
| 5 | 25 | 3.52 | 0.08 | tr | tr | tr | 0.10 | tr | tr | 10 | 15 |
| 6 | 13 | 3.51 | 0.12 | tr | tr | tr | tr | 0.04 | tr | 30 | 12 |
| 7 | 41 | 3.30 | 0.07 | tr | tr | tr | tr | tr | 0.30 | 30 | 10 |
| 8 | 23 | 3.48 | 0.06 | tr | tr | tr | tr | tr | tr | 240 | 20 |
| 9 | 15 | 3.49 | 0.20 | tr | tr | tr | tr | tr | tr | 50 | 80 |
| 10 | (Grain oriented electromagnetic steel sheet) | | | | | | | | | | |

TABLE 18

| No. | Grain diameter after recrystallization annealing (μm) | Iron loss of product sheet $W_{10/1000}$ (W/kg) | Average grain diameter of secondary recrystallized grains (mm) | Rate of fine grains (/cm²) | Area fraction of Goss orientation grains (%) | Remarks |
|---|---|---|---|---|---|---|
| 1 | 45 | 32.0 | 45 | 98 | 87 | Example of the invention |
| 2 | 45 | 30.5 | 55 | 66 | 89 | Example of the invention |
| 3 | 44 | 31.0 | 23 | 115 | 90 | Example of the invention |
| 4 | 43 | 30.6 | 46 | 55 | 91 | Example of the invention |
| 5 | 45 | 31.2 | 44 | 68 | 90 | Example of the invention |
| 6 | 49 | 31.2 | 33 | 102 | 90 | Example of the invention |
| 7 | 50 | 30.5 | 27 | 99 | 85 | Example of the invention |
| 8 | 12 | 43.5 | 5 | 150 | 20 | Comparative example |
| 9 | 20 | 36.8 | 5 | 221 | 35 | Comparative example |
| 10 | Grain oriented electromagnetic steel sheet | 35.2 | 25 | 0.1 | 95 | Comparative example |

Table 18 indicates that in any of the examples of the present invention satisfying the requirements of the present invention, a high-frequency iron loss superior to the conventional grain oriented electromagnetic steel sheet is obtained.

In the examples of the present invention, the existence rate of fine crystal grains of 0.15 to 0.50 mm was 2 grains/cm² or more.

INDUSTRIAL APPLICABILITY

According to the present invention, an excellent grain oriented electromagnetic steel sheet not having a hard coating such as a forsterite undercoating or the like on its surface can be remarkably economically produced. The grain oriented electromagnetic steel sheet is excellent in punching quality and a like, and can thus significantly economize the process for producing, for example, an EI core.

Also, in the present invention, a grain oriented electromagnetic steel sheet having excellent properties such as good punching quality, a low iron loss and/or high-frequency iron loss, magnetic properties with low anisotropy, etc. can be stably obtained by using a raw material containing high-purity components without an inhibitor.

Particularly, in the first embodiment of the present invention, a grain oriented electromagnetic steel sheet having the properties of excellent punching quality and iron loss can be stably obtained, in the second embodiment of the present invention, a grain oriented electromagnetic steel sheet having the properties of excellent punching quality and magnetic properties, and low anisotropy in the magnetic properties can be stably obtained, and in the third embodiment, a grain oriented electromagnetic steel sheet having the properties of an excellent high-frequency iron loss can be stably obtained.

Furthermore, in the present invention, a raw material does not contain inhibitor components, and thus a slab need not be heated at high temperature, and subjected to decarburization annealing and high-temperature purification annealing, thereby causing the great advantage that mass production can be realized at low cost.

In the first and second embodiments of the present invention, the use of an EI core as a core is mainly described. However, needless to say, application of the steel sheet of the present invention is not limited to the EI core, and the steel sheet can be used to all applications of grain oriented electromagnetic steel sheets in which processability is regarded as important.

What is claimed is:

1. A grain oriented electromagnetic steel sheet having excellent magnetic properties without an undercoating mainly composed of forsterite ($Mg_2SiO_4$), comprising a composition containing 1.0 to 8.0% by mass of Si, wherein fine crystal grains having a grain diameter of 0.15 mm to 0.50 mm are scattered in secondary recrystallized grains at a rate of 2 fine crystal grains/cm² or more.

2. The grain oriented electromagnetic steel sheet having excellent magnetic properties according to claim 1, comprising a composition further containing at least one selected from 0.005 to 1.50% by mass of Ni, 0.01 to 1.50% by mass of Sn, 0.005 to 0.50% by mass of Sb. 0.01 to 1.50% by mass of Cu, 0.005 to 0.50% by mass of P, 0.005 to 0.50% by mass of Mo, and 0.01 to 1.50% by mass of Cr.

3. The grain oriented electromagnetic steel sheet having excellent magnetic properties according to claim 1, wherein the N content is 10 to 100 ppm.

4. The grain oriented electromagnetic steel sheet having excellent magnetic properties according to claim 1, wherein the Si content is 2.0% by mass or more.

5. The grain oriented electromagnetic steel sheet having excellent magnetic properties according to claim 1, wherein the secondary recrystallized grains on the surface of the steel sheet have an average grain diameter of 5 mm or more measured except fine grains having a grain diameter of 1 mm or less, the secondary recrystallized grains contain fine crystal grains having a diameter of 0.15 mm to 1.00 mm at a rate of 10 grains/cm² or more, and the area fraction of crystal grains having {110}<001> orientation allowing 20° of the deviation angle from ideal {110} <001> orientation is 50% or more.

6. The grain oriented electromagnetic steel sheet having excellent magnetic properties according to claim 1, wherein the iron loss ($W_{L15/50}$) in the rolling direction is 1.40 W/kg or less, and the iron loss ($W_{C15/50}$) in the direction perpendicular to the rolling direction is 2.6 times or less as large as that in the rolling direction.

7. The grain oriented electromagnetic steel sheet having excellent magnetic properties according to claim 1, wherein the magnetic flux density ($B_{L50}$) in the rolling direction is 1.85 T or more, and the magnetic flux density ($B_{C50}$) in the direction perpendicular to the rolling direction is 1.70 T or more.

8. The grain oriented electromagnetic steel sheet according to claim 1, wherein the fine crystal grains are contained at a rate of about 1000 grains/$cm^2$ or less.

9. The grain oriented electromagnetic steel sheet according to claim 1, wherein the fine crystal grains are contained at a rate of about 200 grains/$cm^2$ or less.

10. The grain oriented electromagnetic steel sheet according to claim 1, wherein a diameter of the secondary recrystallized grains is about 10 to 50 mm.

* * * * *